US005545500A

United States Patent [19]

Shirai et al.

[11] Patent Number: 5,545,500

[45] Date of Patent: Aug. 13, 1996

[54] ELECTROPHOTOGRAPHIC LAYERED LIGHT RECEIVING MEMBER CONTAINING A-Si AND Ge

[75] Inventors: Shigeru Shirai, Nagahama; Shigeru Ohno, Yokohama, both of Japan

[73] Assignee: Canon Kabushiki Kaisha, Tokyo, Japan

[21] Appl. No.: 246,556

[22] Filed: May 19, 1994

Related U.S. Application Data

[63] Continuation of Ser. No. 946,149, Sep. 17, 1992, abandoned, which is a continuation of Ser. No. 759,819, Sep. 5, 1991, abandoned, which is a continuation of Ser. No. 459,288, Dec. 29, 1989, abandoned, which is a division of Ser. No. 210,223, Jun. 23, 1988, Pat. No. 4,911,998, which is a division of Ser. No. 11,505, Feb. 5, 1987, Pat. No. 4,818, 651.

[30] Foreign Application Priority Data

| | | | |
|---|---|---|---|
| Feb. 7, 1986 | [JP] | Japan | 61-23691 |
| Feb. 13, 1986 | [JP] | Japan | 61-27900 |
| Feb. 13, 1986 | [JP] | Japan | 61-27901 |
| Feb. 13, 1986 | [JP] | Japan | 61-27902 |
| Feb. 20, 1986 | [JP] | Japan | 61-33923 |
| Feb. 20, 1986 | [JP] | Japan | 61-33924 |
| Feb. 24, 1986 | [JP] | Japan | 61-37357 |

[51] Int. Cl.[6] ..... G03G 5/82; G03G 5/147

[52] U.S. Cl. ..... 430/67; 430/95

[58] Field of Search ..... 430/57, 58, 86, 430/67, 95

[56] References Cited

U.S. PATENT DOCUMENTS

| | | | |
|---|---|---|---|
| 4,490,450 | 12/1984 | Shimizu et al. | 430/57 |
| 4,598,032 | 7/1986 | Saitoh et al. | 430/84 X |
| 4,683,185 | 7/1987 | Osawa et al. | 430/57 |
| 4,818,651 | 4/1989 | Shirai et al. | 430/57 |

*Primary Examiner*—Christopher D. Rodee

*Attorney, Agent, or Firm*—Fitzpatrick, Cella, Harper & Scinto

[57] ABSTRACT

There is provided an improved light receiving member comrpsing a substrate and a light receiving layer formed by laminating a first layer having photoconductivity which is constituted with an amorphous material containing silicon atoms as the main constituent atoms and germanium atoms, and a second layer constituted with an amorphous material containing silicon atoms, carbon atoms and an element for controlling the conductivity. The germanium atoms contained in the first layer are in the state of being unevenly distributed in the entire layer region or in the partial layer region adjacent to the substrate. The first layer may contain one or more kinds selected from an element for controlling the conductivity, oxygen atoms and nitrogen atoms in the entire layer region on in the partial layer region.

13 Claims, 16 Drawing Sheets

ELECTROPHOTOGRAPHIC LAYERED LIGHT RECEIVING MEMBER CONTAINING A-SI AND GE

This application is a continuation of application Ser. No. 07/946,149, filed Sep. 17, 1992, now abandoned; which in turn, is a continution of application Ser. No. 07/759,819, filed Sep. 5, 1991, now abandoned; which in turn, is a continuation of application Ser. No. 459,288, filed Dec. 29, 1989, now abandoned; which in turn is a division of application Ser. No. 210,223, filed Jun. 23, 1988, now U.S. Pat. No. 4,911,998; which in turn, is a division of application Ser. No. 011,505, filed Feb. 5, 1987, now U.S. Pat. No. 4,818,651.

BACKGROUND OF THE INVENTION

1. Field of the Invention

This invention relates to an improved light receiving member sensitive to electromagnetic waves such as light such as ultra-violet rays, visible rays, infrared rays, X-rays and γ-rays).

2. Background of the Invention

For the photoconductive material to constitute an image-forming member for use in solid image pickup device or electrophotography, or to constitute a photoconductive layer for use in image-reading photosensor, it is required to be highly sensitive, to have a high S/N ratio [photo-current (I/P)/dark current (ID)], to have absorption spectrum characteristics suited for an electromagnetic wave to be irradiated, to be quickly responsive and to have a desired dark resistance. It is also required to be not harmful to living things, especially man, upon use.

Other than these requirements, it is required to have a property of removing a residual image within a predetermined period of time in solid image pickup device.

Particularly for image-forming members used in an electrophotographic machine which is used as a business machine at the office, causing no pollution is highly important.

From these standpoints, public attention has been focused on light receiving members comprising amorphous materials containing silicon atoms (hereinafter referred to as "A-Si"), for example, as disclosed in Offenlegungsschriftes Nos. 2746967 and 2855718 which disclose use of the light receiving member as an image-forming member in electrophotography and in Offenlegungsschrift No. 2933411 which discloses use of such light receiving member in an image-reading photosensor.

For the conventional light receiving members comprising a-Si materials, there have been made improvements in their optical, electric and photoconductive characteristics such as dark resistance, photosensitivity, and photoresponsiveness, use-environmental characteristics, economic stability and durability.

However, it is still left to make further improvements in order to make such light receiving member practically usable.

For example, in the case where such conventional light receiving member is used as an image-forming member in electrophotography with the goal of heightening the photosensitivity and dark resistance, there is often observed a residual voltage on the conventional light receiving member upon use, and when it is repeatedly used for a long period of time, fatigue due to the repeated use will be accumulated to cause the so-called ghost phenomena inviting residual images.

Further, in the preparation of the conventional light receiving member using an A-Si material, hydrogen atoms, halogen atoms such as fluorine atoms or chlorine atoms, elements for controlling the electrical conduction type such as boron atoms, or phosphorus atoms, or other kinds of atoms for improving the characteristics are selectively incorporated in a light receiving layer of the light receiving member as the layer constituents.

However, the resulting light receiving layer sometimes becomes accompanied with defects on the electrical characteristics, photoconductive characteristics and/or breakdown voltage according to the way of the incorporation of said constituents to be employed.

That is, in the case of using the light receiving member having such light receiving layer, the life of a photocarrier generated in the layer with the irradiation of light is not sufficient, the inhibition of a charge injection from the side of the substrate in a dark layer region is not sufficiently carried out, and image defects likely due to a local breakdown phenomenon (the so-called "white oval marks on half-tone copies", or other image defects due to abrasion upon using a blade for the cleaning (the so-called "white line") are apt to appear on the transferred images on a paper sheet.

Further, in the case where the above light receiving member is used in a humid atmosphere, or in the case where after being placed in that atmosphere it is used, the so-called "image flow" sometimes appears on the transferred images on a paper sheet.

Further in addition, in the case of forming a light receiving layer of a ten and some mμ in thickness on an appropriate substrate to obtain a light receiving member, the resulting light receiving layer is likely to invite undesired phenomena such as a thinner space being formed between the bottom face and the surface of this substrate, the layer being removed from the substrate and a crack being generated within the layer following the lapse of time after the light receiving member is taken out from the vacuum deposition chamber.

These phenomena are apt to occur in the case of using a cylindrical substrate to be usually used in the field of electrophotography.

Moreover, there have been proposed various so-called laser printers using a semiconductor laser emitting ray as the light source in accordance with the electrophotographic process. For such laser printer, there is an increased demand to provide an improved light receiving member having a satisfactorily rapid responsiveness to light in the long wave region in order to enhance its function. In consequence, it is required not only to make a further improvement in an A-Si material itself for use in forming the light receiving layer of the light receiving member but also to establish such a light receiving member which will not invite any of the foregoing problems and to satisfy the foregoing demand.

SUMMARY OF THE INVENTION

The object of this invention is to provide a light receiving member comprising a light receiving layer mainly composed of A-Si, free from the foregoing problems and capable of satisfying various kinds of requirements.

That is, the main object of this invention is to provide a light receiving member comprising a light receiving layer constituted with A-Si in which electrical, optical and photoconductive properties are always substantially stable and hardly depend on working circumstances, and which is excellent against optical fatigue, causes no degradation upon repeated use, excellent in durability and moisture resistance, exhibits no or minimal residual potential and provides easy production control.

Another object of this invention is to provide a light receiving member comprising a light receiving layer composed of A-Si which has a high photosensitivity in the entire visible region of light, particularly, and excellent matching properly with a semiconductor laser with rapid light response.

Another object of this invention is to provide a light receiving member comprising a light receiving layer composed of A-Si which has high photosensitivity, high S/N ratio and high electrical voltage withstanding property.

A further object of this invention is to provide a light receiving member comprising a light receiving layer composed of A-Si which is excellent in the close bondability between a support and a layer disposed on the support or between each of the laminated layers, with a dense and stable structural arrangement and of high layer quality.

A still further object of this invention is to provide a light receiving member comprising a light receiving layer composed of A-Si which is excellent in the close bondability between a support and a layer disposed on the support or between each of the laminated layers, dense and stable in view of the structural arrangement and of high layer quality.

These and other objects, as well as the features of this invention will become apparent from the following descriptions of preferred embodiments according to this invention while referring to the accompanying drawings.

DETAILED DESCRIPTION OF THE INVENTION

Figure 1:
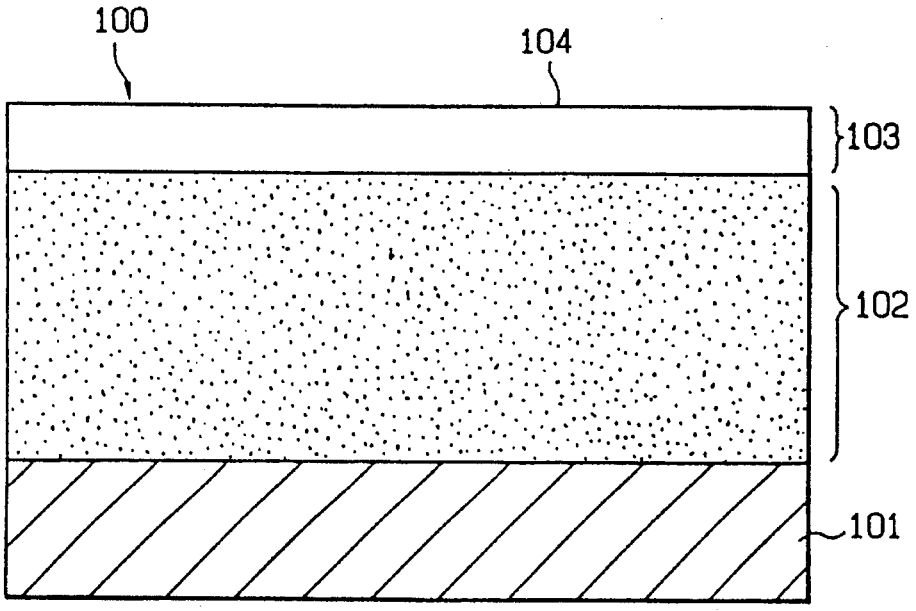
FIGS. 1 through 4 are views schematically illustrating representative examples of the light receiving member according to this invention.

The present inventors have made detailed studies for overcoming the foregoing problems on the conventional light receiving members and attaining the objects as described above and, as a result, have accomplished this invention based on the findings as described below.

As a result of the studies focusing on materiality and practical applicability of a light receiving member comprising a light receiving layer composed of A-Si for use in electrophotography, solid image-pickup device and image-reading device, the present inventors have obtained the following findings.

That is, the present inventors have found that in case where the light receiving layer composed of an amorphous material containing silicon atoms as the main constituent atoms is so structured as to have a particular two-layer structure as later described, the resulting light receiving member provides many practically excellent characteristics especially usable for electrophotography which are superior to the conventional light receiving members in any of the requirements.

In more detail, the present inventors have found that when the light receiving layer is so structured as to have two layer structure using the so-called hydrogenated amorphous silicon-germanium material, halogenated amorphous silicon-germanium materials or halogen-containing hydrogenated amorphous silicon-germanium material, namely, represented by amorphous materials containing silicon atoms a the main constituent atoms (Si), germanium atoms (Ge), and at least one of hydrogen atoms (H) and halogen atoms (X) [hereinafter referred to as "A-SiGe(H,X)"], the resulting light receiving member becomes such that brings about the foregoing unexpected effects.

Accordingly, the light receiving member to be provided according to this invention is characterized as comprising a substrate and a light receiving layer having a first layer having photoconductivity which is constituted of an amorphous material containing silicon atoms as the main constituent atoms and germanium atoms being unevenly distributed in the entire layer region or in the partial layer region adjacent to the substrate and a second layer which is constituted with an amorphous material containing silicon atoms as the main constituent atoms, carbon atoms and an element for controlling the conductivity.

As the amorphous material containing silicon atoms as the main constituent atoms to be used for the formation of the first layer, there can be used the so-called hydrogenated amorphous silicon, halogenated amorphous silicon and halogen-containing hydrogenated amorphous silicon, namely, represented by amorphous materials containing silicon atoms (Si) as the main constituent atoms and at least one kind selected from hydrogen atoms (H) and halogen atoms (X) [hereinafter referred to as A-Si(H,X)"].

As the amorphous material containing silicon atoms as the main constituent atoms to be sued for the formation of the second layer, there is used an amorphous material containing silicon atoms (Si) as the main constituent atoms, carbon atoms (C), and at least one kind selected from hydrogen atoms (H) and halogen atoms (X) [hereinafter referred to as "A-SiC(H,X)"].

And, the first layer may contain at least one kind selected from an element for controlling the conductivity, oxygen atoms and nitrogen atoms in the entire layer region or in the partial layer region.

As such element for controlling the conductivity, there can be used the so-called impurities in the field of the semiconductor, and those usable herein include atoms belonging to the Group III of the Periodic Table that provide p-type conductivity (hereinafter simply referred to as "Group III atom") or atoms belonging to the Group V of the Periodic Table that provide n-type conductivity (hereinafter simply referred to as "Group V atom"). Specifically, the Group III atoms can include B (boron), Al (aluminum), Ga (gallium), In (indium) and Tl (thallium), B and Ga being particularly preferred. The Group V atoms can include, for example, P (phosphorus), As (arsenic), Sb (antimony) and Bi (bismuth), P and As being particularly preferred.

In the case where both the first layer and the second layer contain an element for controlling conductivity, the kind of the element to be contained in the first layer can be the same as or different from that to be contained in the second layer.

As the halogen atom (X) to be contained in the first layer and/or in the second layer in case were necessary, there can be used fluorine, chlorine, bromine and iodine. Among these halogen atoms, fluorine and chlorine are most preferred.

The first layer and/or the second layer may contain hydrogen atoms (H) were necessary. In that case, the amount of the hydrogen atoms (H), the amount of the halogen atoms (X) or the sum of the amounts for the hydrogen atoms and the halogen atoms (H+X) to be incorporated in the second layer is preferably $1\times10^{2}$ to $4\times10$ atomic %, more preferably, $5\times10^{-2}$ to $3\times10$ atomic %, and most preferably, $1\times10^{-1}$ to 25 atomic %.

The light receiving member according to this invention will now be explained more specifically referring to the drawings. The description is not intended to limit the scope of the invention.

FIGS. 1 through 4 are schematic views illustrating the typical layer structures of the light receiving member of this invention, in which are shown the light receiving member 100, the substrate 101, the first layer 102, and the second layer 103 having a free surface 104. And, the numerals 105 through 110 stand for a layer region of the first layer respectively.

Substrate (101)

The substrate 101 for use in this invention may either be electroconductive or insulative. The electroconductive support can include, for example, metals such as NiCr, stainless steels, Al, Cr, Mo, Au, Nb, Ta, V, Ti, Pt and Pb or the alloys thereof.

The electrically insulative support can include, for example, films or sheets of synthetic resins such as polyester, polyethylene, polycarbonate, cellulose acetate, polypropylene, polyvinyl chloride, polyvinylidene chloride, polystyrene, and polyamide, glass, ceramic and paper. It is preferred that the electrically insulative substrate is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_3$, $Sno_2$, ITO ($In_2O_3$+$SnO_2$), etc. In the case of the synthetic resin film such as a polyester film, the electroconductivity is provided to the surface by disposing a thin film of metal such as NiCr, Al, Ag, Pd, Zn, Ni, Au, Cr, Mo, Ir, Nb, Ta, V, Tl and Pt by means of vacuum deposition, electron beam vapor deposition, sputtering, etc., or applying lamination with the metal to the surface. The substrate may be of any configuration such as cylindrical, belt-like or plate-like shape, which can be properly determined depending on the application uses. For instance, in the case of using the light receiving member shown in FIG. 1 as image forming member for use in electronic photography, it is desirably configurated into an endless belt or cylindrical form for continuous high speed reproduction. The thickness of the substrate member is properly determined so that the light receiving member as desired can be formed. In the event that flexibility is required for the light receiving member, it can be made as thin as possible within a range capable of sufficiently providing the function as the substrate. However, the thickness is usually greater than 10 μm in view of the fabrication and handling or mechanical strength of the substrate.

First Layer (102)

The first layer 102 is disposed between the substrate 101 and the second layer 103 as shown in any of FIGS. 1 through 4.

Basically, the first layer 102 is composed of A-Si(H,X) which contains germanium atoms in the state of being distributed unevenly in the entire layer or in the partial layer region adjacent to the substrate 101 (hereinafter, the uneven distribution means that the distribution of the related atoms in the layer is uniform in the direction parallel to the surface of the substrate but is uneven in the thickness direction).

The purpose of incorporating germanium atoms in the first layer of the light receiving member according to this invention is chiefly for the improvement of an absorption spectrum property in the long wavelength region of the light receiving member.

That is, the light receiving member according to this invention gives excellent various properties by incorporating germanium atoms in the first layer. Particularly, it becomes more sensitive to light of wavelengths broadly ranging from short wavelength to long wavelength covering visible light and it also becomes quickly responsive to light.

This effect becomes more significant when a semiconductor laser emitting ray is used as the light source.

In the first layer of the light receiving member according to this invention, it may contain germanium atoms either in the entire layer region or in the partial layer region adjacent to the substrate.

In the latter case, the first layer comes to have a layer constitution that a constituent layer containing germanium atoms and another constituent layer not containing germanium atoms are laminated in this order from the side of the substrate.

Figure 2:
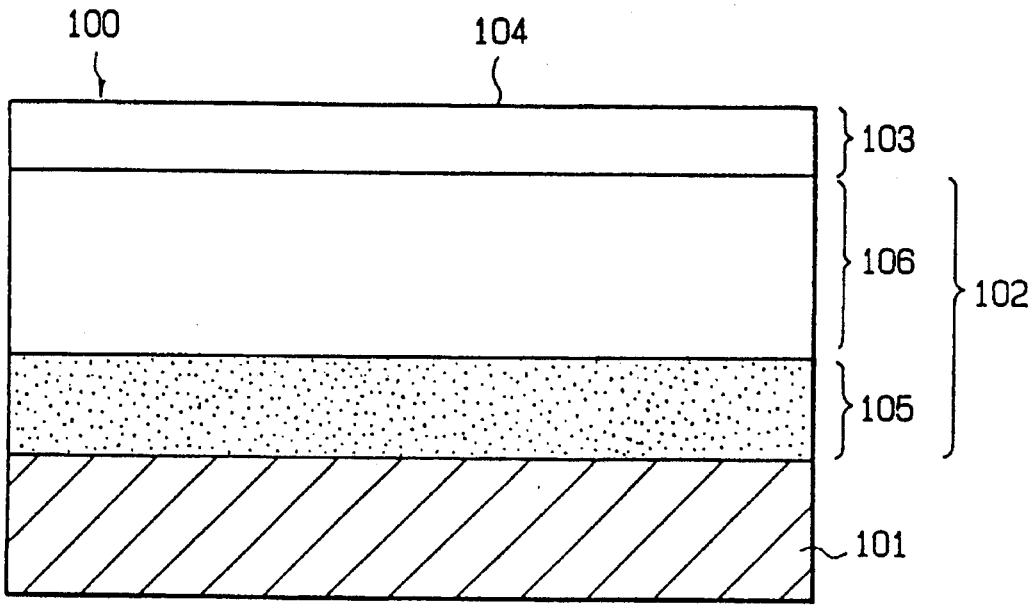

FIG. 2 shows the latter case in which are shown the substrate 101, the first layer 102 having a first constituent layer region 105 which is constituted with A-Si(H,X) containing germanium atoms (hereinafter referred to as "A-SiGe(H,X)") and a second constituent layer region 106 which is constituted with A-Si(H,X) not containing germanium atoms.

And either in the case where germanium atoms are incorporated in the entire layer region or in the case where incorporated only in the partial layer region, germanium atoms are distributed unevenly in the first layer 102 or the first constituent layer region 105.

In order to bring about desired objective characteristics by the incorporation of germanium atoms in the first layer 102 or in the first constituent layer region 105, various appropriate distributing states may be taken upon desired requirements.

For example, when germanium atoms are so distributed in the first layer 102 or in the first constituent layer region 105 that their distributing concentration is decreased thicknesswise toward the second layer 103 from the side of the substrate, the affinity of the first layer 102 with the second layer 103 becomes improved. And, when the distributing concentration of germanium atoms is extremely heightened in the layer region 105 adjacent to the substrate, the light of long wavelength, which can be hardly absorbed in the constituent layer or the layer region near the free surface side of the light receiving layer when a light of long wavelength such as a semiconductor emitting ray is used as the light source, can be substantially and completely absorbed in the constituent layer or in the layer region respectively adjacent to the support for the light receiving layer. And this is directed to prevent the interference caused by the light reflected from the surface of the substrate.

As above explained, in the first layer of the light receiving member according to this invention, germanium atoms are distributed unevenly and continuously in the direction of the layer thickness in the entire layer region or the partial constituent layer region.

In the following, an explanation is made of the typical examples when germanium atoms are so distributed that their thicknesswise distributing concentration is decreased toward the interface with the second layer from the side of the substrate, with reference to FIGS. 5 through 13.

In FIGS. 5 through 13, the abscissa represents the distribution concentration C of germanium atoms and the ordinate represents the thickness of the first layer 102 or the first constituent layer region 105; and $t_B$ represents the interface position between the substrate and the first layer 102 or the first constituent layer region 105 and $t_T$ represents the interface position between the first layer 102 and the second layer 103, or the interface position between the first constituent layer region 105 and the second constituent layer region 106.

Figure 5:
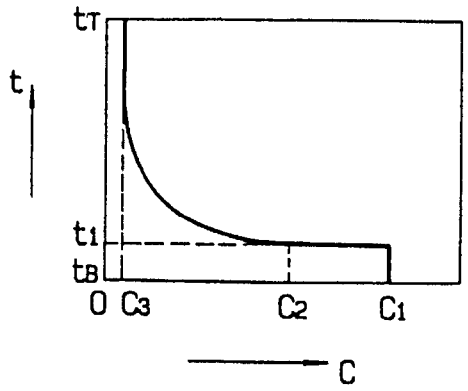
FIGS. 5 through 13 are views illustrating the thicknesswise distribution of germanium atoms, the thicknesswise distribution of oxygen atoms, carbon atoms, or nitrogen atoms, or the thicknesswise distribution of the Group III atoms or the Group V atoms in the constituent layer of the light receiving member according to this invention, the ordinate representing the thickness of the layer and the abscissa representing the distribution concentration of respective atoms.

FIG. 5 shows the first typical example of the thicknesswise distribution of germanium atoms in the first layer or first constituent layer region. In this example, the germanium atoms are distributed in the way that the concentration C remains constant at a value $C_1$ in the range from position $t_B$ to position $t_1$, and the concentration C gradually and continuously decreases from $C_2$ in the range from position $t_1$ to position $t_T$, where the concentration of the germanium atoms becomes $C_3$.

Figure 6:
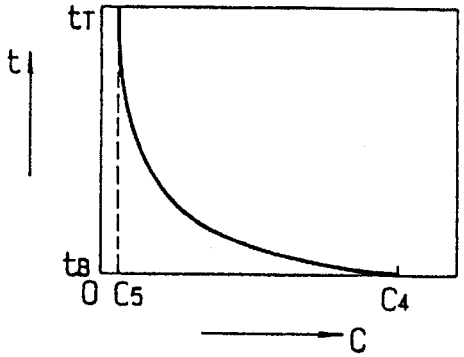

In the example shown in FIG. 6, the distribution concentration C of the germanium atoms contained in the first layer or the first constituent layer region is such that concentration $C_4$ at position $t_B$ continuously decreases to concentration $C_5$ at position tT.

Figure 7:
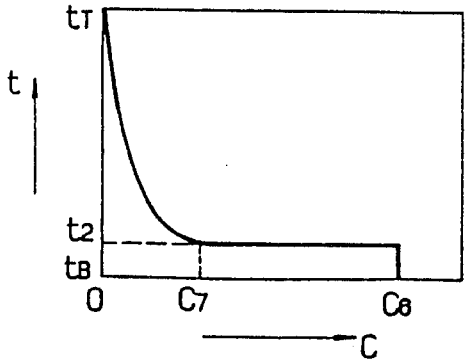

In the example shown in FIG. 7, the distribution concentration C of the germanium atoms is such that concentration $C_6$ remains constant in the range from position $t_B$ and position $t_2$ and it gradually and continuously decreases in the range from position $t_2$ and position $t_T$. The concentration at position $t_T$ is substantially zero.

Figure 8:
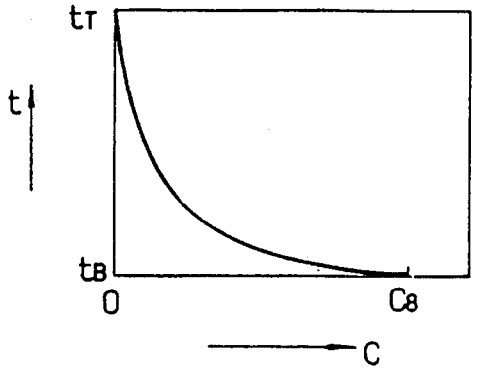

In the example shown in FIG. 8, the distribution concentration C of the germanium atoms is such that concentration $C_8$ gradually and continuously decreases in the range from position $t_B$ and position $t_T$ at which it is substantially zero.

Figure 9:
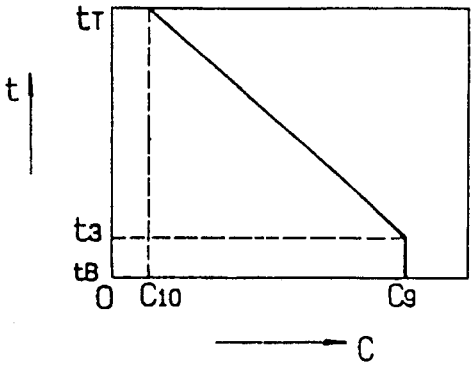

In the example shown in FIG. 9, the distribution concentration C of the germanium atoms is such that concentration $C_9$ remains constant in the range from position $t_B$ and position $t_3$, and concentration $C_8$ linearly decreases to concentration $C_{10}$ in the range from position $t_3$ to position $t_T$.

Figure 10:
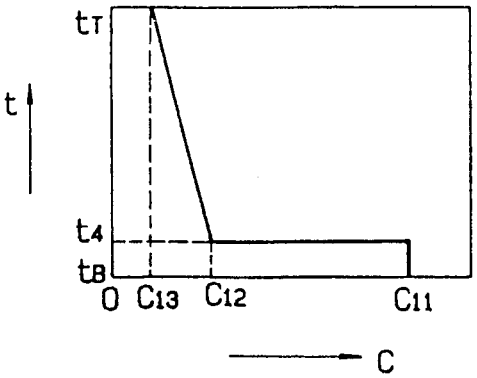

In the example shown in FIG. 10, the distribution concentration C of the germanium atoms is such that concentration $C_{11}$ remains constant in the range from position $t_B$ and position $t_4$, and it linearly decreases to concentration $C_{14}$ in the range from position $t_4$ to position $t_T$.

Figure 11:
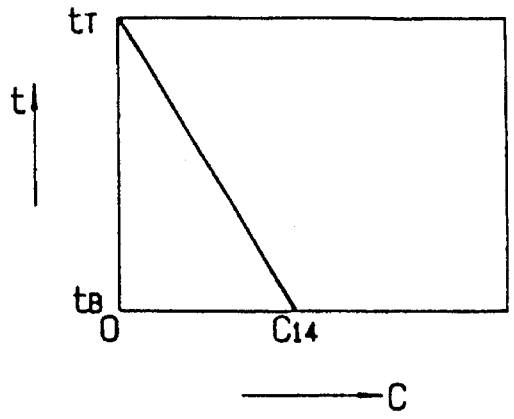

In the example shown in FIG. 11, the distribution concentration C of the germanium atoms is such that concentration $C_{14}$ linearly decreases in the range from position $t_T$, at which the concentration is substantially zero.

Figure 12:
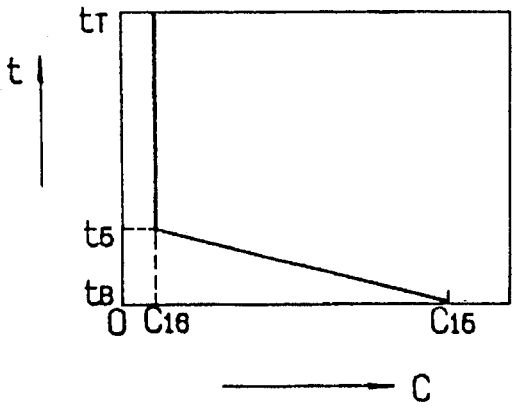

In the example shown in FIG. 12, the distribution concentration C of the germanium atoms is such that concentration $C_{15}$ linearly decreases to concentration $C_{16}$ in the range from position $t_B$ to position $t_5$ and concentration $C_{16}$ remains constant in the range from position $t_5$ to position $t_T$.

Figure 13:
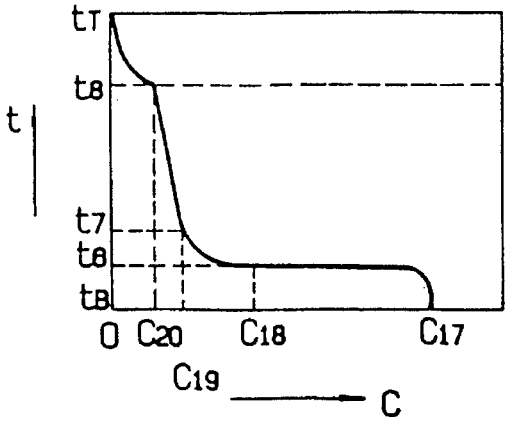

Finally, in the example shown in FIG. 13, the distribution concentration C of the germanium atoms is such that concentration $C_{17}$ slowly decreases and then sharply decreases to concentration $C_{18}$ in the range from position $t_B$ to position $t_6$. In the range from position $t_6$ to position $t_7$, the concentration sharply decreases at first and slowly decreases to $C_{19}$ at position $t_7$. The concentration slowly decreases between position $t_7$ and position $t_8$, at which the concentration is $C_{20}$. Concentration $C_{20}$ slowly decreases to substantially zero between position $t_8$ and position $t_T$.

Several examples of the thicknesswise distribution of germanium atoms in the first layer 102 or in the first constituent layer region have been illustrated in FIGS. 5 through 13. In the light receiving member of this invention, the concentration of germanium atoms in the such layer or layer region should preferably be high at the position adjacent to the substrate and considerably low at the position adjacent to the interface with the second layer 103.

In other words, it is desirable that the light receiving layer constituting the light receiving member of this invention have a region adjacent to the substrate in which germanium atoms are locally contained at a relatively high concentration.

Such a local region in the light receiving member of this invention should preferably be formed within 5 μm from the interface between the substrate and the first layer.

And, in the case where such local region is not present, it is desirable that the maximum concentration $C_{max}$ is positioned within 5 μm from the interface with the substrate.

In the light receiving member of this invention, the amount of germanium atoms in the first layer should be properly determined so that the object of the invention is effectively achieved.

In the case of incorporating germanium atoms in the entire layer region of the first layer, it is preferably 1 to $6\times10^5$ atomic ppm, more preferably 10 to $3\times10^5$ atomic ppm, and, most preferably $1\times10^2$ to $2\times10^5$ atomic ppm.

And, in the case of incorporating germanium atoms in the layer region of the first layer being adjacent to the substrate, it is preferably 1 to $9.5\times10^5$ atomic ppm, more preferably 100 to $8\times10^5$ atomic ppm, and, most preferably, 100 to $7\times10^5$ atomic ppm.

For the thickness of the first constituent layer region 105 containing germanium atoms and that of the second constituent layer region 106 not containing germanium atoms, they are important factors for effectively attaining the foregoing objects of this invention, and are desirably determined so that the resulting light receiving member becomes accompanied with desired many practically applicable characteristics.

The thickness ($T_B$) of the constituent layer region 105 containing germanium atoms is preferably $3\times10^{-3}$ to 50 μm, more preferably $4\times10^{-3}$ to 40 μm, and, most preferably, $5\times10^{-3}$ to 30 μm.

As for the thickness (T) of the constituent layer region 106, it is preferably 0.5 to 90 μm, more preferably 1 to 80 μm, and, most preferably, 2 to 50 μm.

And, the sum ($T_B$+T) of the thickness ($T_B$) for the former layer region and that (T) for the latter layer region is desirably determined based on relative and organic relationships with the characteristics required for the first layer 102.

It is preferably 1 to 100 μm, more preferably 1 to 80 μm, and, most preferably, 2 to 50 μm.

Further, for the relationship of the layer thickness $T_B$ and the layer thickness T, it is preferred to satisfy the equation: $T_B/T \geqq 1$, more preferred to satisfy the equation: $T_B/T \geqq 0.9$, and, most preferred to satisfy the equation: $T_B/T \geqq 0.8$.

In addition, for the layer thickness ($T_B$) of the layer region containing germanium atoms, it is necessary to be determined based on the amount of the germanium atoms to be contained in that layer region. For example, in the case where the amount of the germanium atoms to be contained therein is more than $1\times10^5$ atomic ppm, the layer thickness $T_B$ is desired to be remarkably large.

Specifically, it is preferably less than 30 μm, more preferably less than 25 μm, and, most preferably, less than 20 μm.

In the first layer 102 of the light receiving member of this invention, an element for controlling the conductivity is incorporated aiming at the control for the conduction type and/or conductivity of that layer, the provision of a charge injection inhibition layer at the substrate side of that layer, the enhancement of movement of electrons of the first layer 102 and the second layer 103, the formation of a composition part between the first layer and the second layer to increase an apparent dark resistance and the like. And the element for controlling the conductivity may be contained in the first layer in a uniformly or unevenly distributed state in the entire or partial layer region.

As the element for controlling the conductivity, so-called impurities in the field of the semiconductor can be mentioned and those usable herein can include atoms belonging to the Group III of the Periodic Table that provide p-type conductivity (hereinafter simply referred to as "Group III atoms") or atoms belonging to the Group V of the Periodic Table that provide n-type conductivity (hereinafter simply referred to as "Group V atoms"). Specifically, the Group III atoms can include B (boron), Al (aluminum, Ga (gallium), In (indium), and Tl (thallium), B and Ga being particularly preferred. The Group V atoms can include, for example, P (phosphorus), As (arsenic), Sb (antimony), and Bi (bismuth), P and Sb being particularly preferred.

In the case of incorporating the Group III or Group V atoms as the element for controlling the conductivity into the first layer of the light receiving member according to this invention, they are contained in the entire layer region or partial layer region depending on the purpose or the expected effects as described below and the content is also varied.

That is, if the main purpose resides in the control for the conduction type and/or conductivity of the photosensitive layer, the element is contained in the entire layer region of the first layer, in which the content of Group III or Group V atoms may be relatively small and it is preferably from $1\times10^{-3}$ to $1\times10^3$ atomic ppm, more preferably from $5\times10^{-2}$ to $5\times10^2$ atomic ppm, and, most preferably, from $1\times10^{-1}$ to 5×102 atomic ppm.

In the case of incorporating the Group III or Group V atoms in a uniformly or unevenly distributed state to a portion of the layer region 105 in contact with the substrate as shown in FIG. 2, or the atoms are contained such that the distribution density of the Group III or Group V atoms in the direction of the layer thickness is higher on the side adjacent to the substrate, the layer containing such Group III or Group V atoms or the layer region containing the Group III or Group V atoms or the layer region containing the Group III or Group V atoms at high concentration functions as a charge injection inhibition layer. That is, in the case of incorporating the Group III atoms, movement of electrons injected from the side of the substrate into the first layer can effectively be inhibited upon applying the charging treatment of a positive polarity at the free surface of the layer. While on the other hand, in the case of incorporating the Group III atoms, movement of positive holes injected from the side of the substrate into the first layer can effectively be inhibited. The content in this case is relatively great. Specifically, it is generally from 30 to $5\times10^4$ atomic ppm, preferably from 50 to $1\times10^4$ atomic ppm, and most suitably from $1\times10^2$ to $5\times10^3$ atomic ppm.

In order to further effectively attain the above purpose, for the relationship between the layer thickness (t) of the layer region 105 and the layer thickness ($t_0$) of the other layer region of the first layer, it is preferred to satisfy the equation: $t/t+t_0 \geqq 0.35$, and, most preferred to satisfy the equation: $t/t+t_0 \geqq 030$.

Specifically, the layer thickness of the layer region 105 is preferably $3\times10^{-3}$ to 10 μm, more preferably $4\times10^{-3}$ to 8 μm, and, most preferably, $5\times10^{-3}$ to 5 μm.

Figure 3:
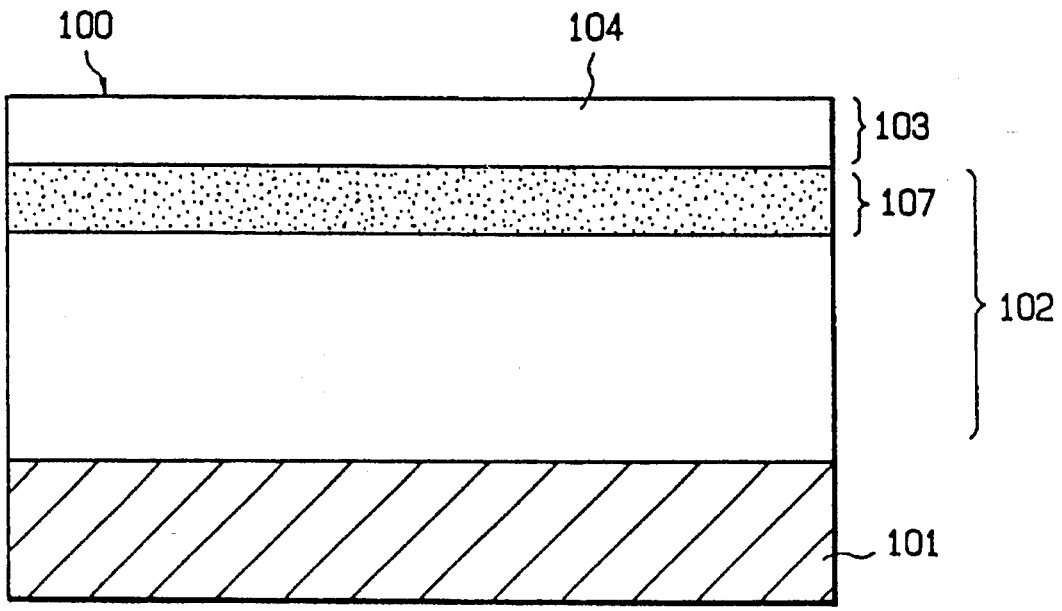

Further, in order to improve the matching of energy level between the first layer 102 and the second layer 103 to thereby promote movement of an electric charge between the two layers, the Group III or Group V atoms are incorporated into the partial layer region 107 adjacent to the second layer 103 as shown in FIG. 3 in a uniformly or unevenly distributed state. The uneven incorporation of such atoms can be carried out based on the typical examples for germanium atoms as shown in FIGS. 5 through 13 or by properly modifying the examples. For example, the thicknesswise distributing concentration of the Group III or Group V atoms is decreased toward the substrate side from the side of the second layer. In order to effectively attain the above purpose, the conduction type of the element for controlling the conductivity to be contained in the first layer is necessary to be the same as that of the element for controlling the conductivity to be contained in the second layer. In that case, when the layer thickness of the second layer is large and the dark resistance is high, the effects become significant. As for the amount of the Group III or Group V atoms to be contained it is sufficient to be relatively small. Specifically, it is preferably $5\times10^{-3}$ to $1\times10^3$ atomic ppm, more preferably $5\times10^{-2}$ to $5\times10^2$ atomic ppm, and, most preferably, $1\times10^{-1}$ to $2\times10^2$ atomic ppm.

Further, in order to improve the apparent dark resistance at the time of electrification process by purposely disposing a composition partially between the first layer and the second layer, the partial layer region 107 being adjacent to the second layer 103 as shown in FIG. 3, an element having a different conduction type from the element for controlling the conductivity to be contained in the second layer is incorporated in a uniformly or unevenly distributed state.

In that case, the amount of the Group III or Group V atoms is sufficient to be relatively small. Specifically, it is preferably $1\times10^{-3}$ to $1\times10^2$ atomic ppm, more preferably $5\times10^{-2}$ to $5\times10^2$ atomic ppm, and, most preferably, $1\times10^{-1}$ to $2\times10^2$ atomic ppm.

While the individual effects have been described above for the distribution state of the Group III or Group V atoms the distribution state of the Group III or Group V atoms and the amount of the Group III or Group V atoms are, of course, combined properly as required for obtaining the light receiving member having performances capable of attaining a desired purpose.

For instance, in the case of aiming at both the control of the conduction type and the disposition of a charge injection inhibition layer, the Group III or Group V atoms are distributed at a relatively high distributing concentration in the layer region at the substrate side, and such atoms are distributed at a relatively low distributing concentration in the interface side with the second layer, or such a distributed state that does not purposely contain such atoms in the interface side with the second layer is established.

The first layer of the light receiving member of this invention may be incorporated with at least one kind selected from oxygen atoms and nitrogen atoms. This is effective in increasing the photosensitivity and dark resistance of the light receiving member and also in improving adhesion between the substrate and the first layer or that between the first layer and the second layer.

In the case of incorporating at least one kind selected from oxygen atoms and nitrogen atoms into the first layer or its partial layer region, it is performed at a uniform distribution or uneven distribution in the direction of the layer thickness depending on the purpose or the expected effects as described above with reference to FIGS. 5 through 13 for germanium atoms, and accordingly, the content is varied depending on them.

That is, in the case of increasing the photosensitivity and the dark resistance of the first layer, they are contained at a uniform distribution over the entire layer region of the first layer. In this case, the amount of at least one kind selected from oxygen atoms and nitrogen atoms contained in the first layer may be relatively small.

In the case of improving the adhesion between the substrate and the first layer, at least one kind selected from oxygen atoms and nitrogen atoms is contained uniformly in the layer region 105 constituting the first layer adjacent to the support or at least one kind selected from oxygen atoms and nitrogen atoms is contained such that the distribution concentration is higher at the end of the first layer on the side of the substrate.

In the case of improving the adhesion between the first layer and the second layer, at least one kind selected from oxygen atoms and nitrogen atoms are uniformly incorporated in the partial layer region 107 adjacent to the second layer as shown in FIG. 3, or they are incorporated in such an unevenly distributed state that their distributing concentration becomes higher in the layer region of the first layer in the second layer side. Further, the above objects can be attained also by uniformly incorporating at least one kind selected from oxygen atoms and nitrogen atoms in the second layer as later described.

In any case, in order to secure the promotion of the adhesion, it is desirable for the amount of oxygen atoms and/or nitrogen atoms to be incorporated to be relatively high.

The uneven incorporation of oxygen atoms and/or nitrogen atoms can be carried out based on the typical examples as described above for germanium atoms with reference to FIGS. 5 through 13.

That is, according to a desired purpose, it is possible to decrease their distributing concentration from the second layer side toward the substrate side. In addition, a further improvement in the above adhesion between the substrate and the first layer can be achieved by establishing a localized region in the first layer in which oxygen atoms and/or nitrogen atoms are contained at a high concentration. Explaining the localized region with reference to FIGS. 5 through 13, it is desirable to be disposed within 5 μm from the position of interface $t_B$. And such localized region may be either the entirety of the partial layer region 105 or a part of the partial layer region 105 respectively containing oxygen atoms and/or nitrogen atoms.

While the individual effects have been described above for the distributing state of oxygen atoms and/or nitrogen atoms, the distributing state of the oxygen atoms and/or the nitrogen atoms and their amount are, of course, combined properly as required for obtaining the light receiving member having performances capable of attaining a desired purpose.

For instance, in the case of aiming at both the promotion of the adhesion between the substrate and the first layer and the improvements in the photosensitivity and dark resistance, oxygen atoms and/or nitrogen atoms are distributed at a relatively high distributing concentration in the layer region at the substrate side, and such atoms are distributed at a relatively low distributing concentration in the interface side of the first layer with the second layer, or such a distributed state that does not purposely contain such atoms in the interface side of the first layer with the second layer.

The amount of oxygen atoms and/or nitrogen atoms to be contained in the first layer is properly determined not only depending on the characteristics required for the first layer itself but also having regards for the related factors, for example, elective and organic relationships with an adjacent layer or with the properties of the substrate. This is so especially where oxygen atoms and/or nitrogen atoms are incorporated in the partial layer region of the first layer adjacent to the substrate or the second layer.

It is preferably $1\times10^{-3}$ to 50 atomic %, more preferably $2\times10^{-3}$ to 40 atomic %, and, most preferably, $3\times10^{-3}$ to 30 atomic %.

In the case where the entire layer region of the first layer is incorporated with oxygen atoms and/or nitrogen atoms or in the case where the proportion occupied by the partial layer region containing oxygen atoms and/or nitrogen atoms in the first layer is sufficiently large, the maximum amount of the oxygen atoms and/or the nitrogen atoms to be contained is desirable to be lower enough than the above value. For instance, in the case where the layer thickness of the partial layer region containing oxygen atoms and/or nitrogen atoms corresponds to a value of more than 2/5 of the layer thickness of the first layer, the upper limit of the amount of the oxygen atoms and/or the nitrogen atoms to be contained in that partial layer region is preferably less than 30 atomic %, more preferably less than 20 atomic %, and, most preferably, less than 10 atomic %.

Further, in the case where a localized region containing oxygen atoms and/or nitrogen atoms at a high concentration is established, the maximum concentration $C_{max}$ for the distributing concentration of the oxygen atoms and/or the nitrogen atoms in a thicknesswise distributed state is preferably more than 500 atomic ppm, more preferably more than 800 atomic ppm, and, most preferably, more than 1000 atomic ppm.

As above explained, the first layer of the light receiving member of this invention is incorporated with germanium atoms, the Group III or Group V atoms, and optionally, oxygen atoms and/or nitrogen atoms, but these atoms are selectively incorporated in that layer based on relative and organic relationships of the amount and the distributing state of each kind of the atoms. And, the layer region in which each kind of the atoms is incorporated may be different or partially overlapped.

Now, the typical example will be explained with reference to FIG. 4, but the invention is not intended to limit the scope only thereto.

Figure 4:
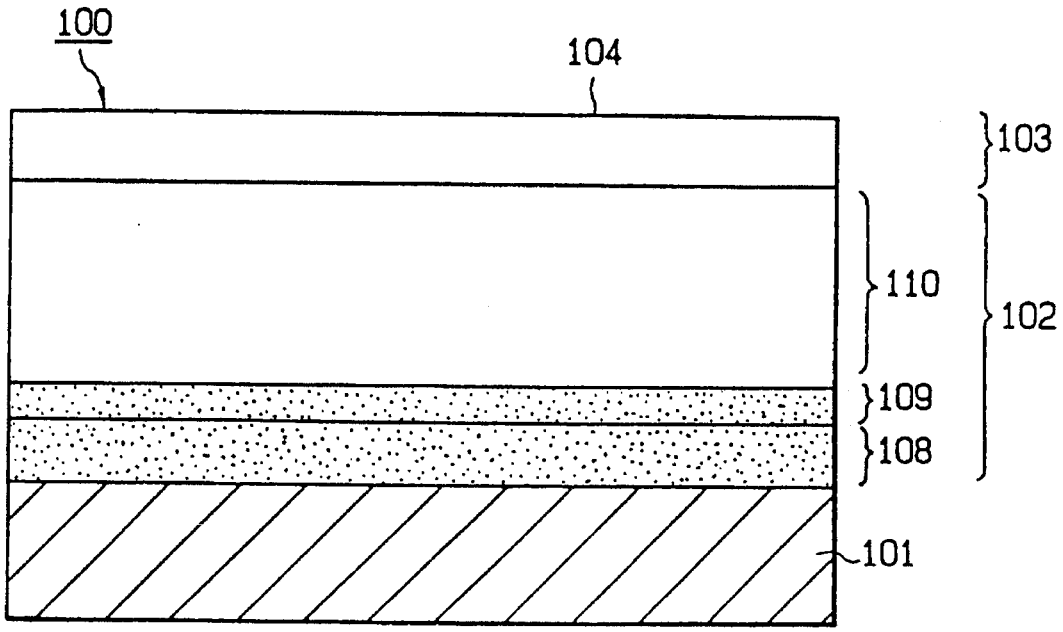

Referring to FIG. 4, there is shown the light receiving member 100 which comprises the substrate 101, the first layer constituted by first constituent layer region 108, second constituent layer region 109 and third constituent layer region 110, and the second layer 103 having the free surface 104. In this typical example, the layer region 108 contains germanium atoms, the Group III or Group V atoms, and oxygen atoms. The layer region 109 which is disposed on the layer region 108 contains germanium atoms and oxygen atoms but neither the Group III atoms nor the Group V atoms. The layer region 110 contains only germanium atoms. In any of the above-mentioned layer regions, the germanium atoms are in the entirety of the layer region in an unevenly distributed state.

In this invention, the layer thickness of the first layer is an important factor for effectively attaining the objects of this invention and should be properly determined having due regard for obtaining a light receiving member having desirable characteristics.

In view of the above, it is preferably 1 to 100 μm, more preferably 1 to 80 μm, and, most preferably 2 to 50 μm.

Second Layer

The second layer 103 having the free surface 104 is disposed on the first layer 102 to attain the objects chiefly of moisture resistance, deterioration resistance upon repeating use, electrical voltage withstanding property, use environmental characteristics and durability for the light receiving member according to this invention.

The second layer is formed of an amorphous material containing silicon atoms as the constituent atoms which are also contained in the layer constituent amorphous material for the first layer, so that the chemical stability at the interface between the two layers is sufficiently secured.

Typically, the surface layer is formed of an amorphous material containing silicon atoms, carbon atoms, and hydrogen atoms and/or halogen atoms in case where necessary [hereinafter referred to as "A-SiC(H,X)"]

The foregoing objects for the second layer can be effectively attained by introducing carbon atoms structurally into the second layer.

And, in the case of introducing carbon atoms structurally into the second layer, following the increase in the amount of carbon atoms to be introduced, the above-mentioned characteristics will be promoted, but its layer quality and its electric and mechanical characteristics will be decreased if the amount is excessive.

In view of the above, the amount of carbon atoms to be contained in the second layer is preferably $1\times10^{-3}$ to 90 atomic %, more preferably 1 to 90 atomic %, and, most preferably, 10 to 80 atomic %.

For the layer thickness of the second layer, it is desirable to be thickened. But the problem due to generation of a residual voltage will occur in the case where it is excessively thick. In view of this, by incorporating an element for controlling the conductivity such as the Group III atom or the Group V atom in the second layer, the occurrence of the above problem can be effectively prevented beforehand. In that case, in addition to the above effect, the second layer becomes such that it is free from any problem due to, for example, so-called scratches which will be caused by a cleaning means such as a blade and which invite defects on the transferred images in the case of using the light receiving member in electrophotography.

In view of the above, the incorporation of the Group III or Group V atoms in the second layer is quite beneficial for forming the second layer having appropriate properties as required.

And, the amount of the Group III or Group V atoms to be contained in the second layer is preferably 1.0 to $1\times10^{4}$ atomic ppm, more preferably 10 to $5\times10^{3}$ atomic ppm, and, most preferably, $10^{2}$ to $5\times10^{3}$ atomic ppm.

The formation of the second layer should be carefully carried out so that the resulting second layer becomes such that brings about the characteristics required therefor.

By the way, the texture state of a layer constituting material which contains silicon atoms, carbon atoms, hydrogen atoms and/or halogen atoms, and the Group III atoms or the Group V atoms changes from crystal state to amorphous state which show from a semiconductive property to an insulative property for the electric and physical property and which show from a photoconductive property to a nonphotoconductive property for the optical and electric property upon the layer forming conditions and the amount of such atoms to be incorporated in the layer to be formed.

In view of the above, for the formation of a desirable layer to be the second layer 103 which has the required characteristics, it is required to choose appropriate layer forming conditions and an appropriate amount for each kind of atoms to be incorporated so that such second layer may be effectively formed.

For instance, in the case of disposing the second layer 103 aiming chiefly at the improvement in the electrical voltage withstanding property, that layer is formed of such an amorphous material that invites a significant electrically-insulative performance on the resulting layer.

Further, in the case of disposing the second layer 103 aiming chiefly at the improvement in the deterioration resistance upon repeating use, the using characteristics and the use environmental characteristics, that layer is formed of such an amorphous material that eases the foregoing electrically-insulative property to some extent but brings about certain photosensitivity of the resulting layer.

Further in addition, the adhesion of the second layer 103 with the first layer 102 may be further improved by incorporating oxygen atoms and/or nitrogen atoms in the second layer in a uniformly distributed state.

For the light receiving member of this invention, the layer thickness of the second layer is also an important factor for effectively attaining the objects of this invention.

Therefore, it is appropriately determined depending upon the desired purpose.

It is, however, also necessary that the layer thickness be determined in view of relative and organic relationships in accordance with the amounts of silicon atoms, carbon atoms, hydrogen atoms, halogen atoms, the Group III atoms, and the Group V atoms to be contained in the second layer and the characteristics required in relationship with the thickness of the first layer.

Further, it should be determined also in economical viewpoints such as productivity or mass productivity.

In view of the above, the layer thickness of the second layer is preferably $3\times10^{-3}$ to 30 μm, more preferably $45\times10^{-3}$ to 20 μm, and, most preferably, $5\times10^{-3}$ to 10 μm.

As above explained, since the light receiving member of this invention is structured by laminating a special first layer and a special second layer on a substrate, almost all the problems which are often found on the conventional light receiving member can be effectively overcome.

Further, the light receiving member of this invention exhibits not only significantly improved electric, optical and photoconductive characteristics, but also significantly improved electrical voltage withstanding property and use environmental characteristics. Further, in addition, the light receiving member of this invention has a high photosensitivity in the entire visible region of light, particularly, an excellent matching property with a semiconductor laser and shows rapid light response.

And, when the light receiving member is applied for use in electrophotography, it gives no undesired effects at all of the residual voltage to the image formation, but gives a table electrical properties, high sensitivity and high S/N ratio, excellent light fastness and property for repeating use, high image density and clear half tone. And it can provide high quality image with high resolution power repeatingly.

Preparation of First Layer (102) and Second Layer (103)

The method of forming the light receiving layer of the light receiving member will now be explained.

Each of the first layer 102 and the second layer 103 to constitute the light receiving layer of the light receiving member of this invention is properly prepared by vacuum deposition method utilizing the discharge phenomena such as glow discharging, sputtering and ion plating methods wherein relevant gaseous starting materials are selectively used.

These production methods are properly used selectively depending on the factors such as the manufacturing conditions, the installation cost required, production scale and properties required for the light receiving members to be prepared. The glow discharging method or sputtering method is suitable since the control for the condition upon preparing the layers having desired properties are relatively easy, and hydrogen atoms, halogen atoms and other atoms can be introduced easily together with silicon atoms. The glow discharging method and the sputtering method may be used together in one identical system.

Preparation of First Layer (102)

Basically, when a layer constituted with A-Si(H,X) is formed, for example, by the glow discharging method, gaseous starting material capable of supplying silicon atoms (Si) are introduced together with gaseous starting material for introducing hydrogen atoms (H) and/or halogen atoms (X) into a deposition chamber the inside pressure of which can be reduced, glow discharge is generated in the deposition chamber, and a layer composed of A-Si(H,X) is formed on the surface of a substrate placed in the deposition chamber.

The gaseous starting material for supplying Si can include gaseous or gasifiable silicon hydrides (silanes) such as $SiH_4$, $Si_2H_6$, $Si_3H_8$, $Si_4H_{10}$, etc., $SiH_4$ and $Si_2H_6$ being particularly preferred in view of the easy layer forming work and the good efficiency for the supply of Si.

Further, various halogen compounds can be mentioned as the gaseous starting material for introducing the halogen atoms, and gaseous or gasifiable halogen compounds, for example, gaseous halogen, halides, inter-halogen compounds and halogen-substituted silane derivatives are preferred. Specifically, they can include halogen gas such as of fluorine, chlorine, bromine, and iodine; inter-halogen compounds such as BrF, ClF, $ClF_3$, $BrF_2$, $BrF_3$, $IF_7$, ICl, IBr, etc.; and silicon halides such as $SiF_4$, $Si_2F_6$, $SiCl_4$, and $SiBr_4$. The use of the gaseous or gasifiable silicon halide as described above is particularly advantageous since the layer constituted with halogen atom-containing A-Si:H can be formed with no additional use of the gaseous starting silicon hydride material for supplying Si.

In the case of forming a layer constituted with an amorphous material containing halogen atoms, typically, a mixture of a gaseous silicon halide substance as the starting material for supplying Si and a gas such as Ar, $H_2$ and He is introduced into the deposition chamber having a substrate in a predetermined mixing ratio and at a predetermined gas flow rate, and the thus introduced gases are exposed to the action of glow discharge to thereby cause a gas plasma resulting in forming said layer on the substrate.

And, for incorporating hydrogen atoms in said layer, an appropriate gaseous starting material for supplying hydrogen atoms can be additionally used.

Now, the gaseous starting material usable for supplying hydrogen atoms can include those gaseous or gasifiable materials, for example, hydrogen gas ($H_2$), halides such as HF, HCl, HBr, and HI, silicon hydrides such as $SiH_4$, $Si_2H_6$, $Si_3H_{10}$, or halogen-substituted silicon hydrides such as $SiH_2F_2$, $SiH_2I_2$, $SiHCl_3$, $SiH_2Cl_3$, $SiH_2Br_2$, and $SiHBr_3$. The use of these gaseous starting materials is advantageous since the content of the hydrogen atoms (H), which are extremely effective in view of the control for the electrical or photoelectronic properties, can be controlled with ease. Then, the use of the hydrogen halide or the halogen-substituted silicon hydride as described above is particularly advantageous since the hydrogen atoms (H) are also introduced together with the introduction of the halogen atoms.

The amount of the hydrogen atoms (H) and/or the amount of the halogen atoms (X) to be contained in a layer are adjusted properly by controlling related conditions, for example, the temperature of a substrate, the amount of a gaseous starting material capable of supplying the hydrogen atoms or the halogen atoms into the deposition chamber and the electric discharging power.

In the case of forming a layer composed of A-Si(H,X) by the reactive sputtering process, the layer is formed on the substrate by using an Si target and sputtering the Si target in a plasma atmosphere.

To form said layer by the ion-plating process, the vapor of silicon is allowed to pass through a desired gas plasma atmosphere. The silicon vapor is produced by heating polycrystal silicon or single crystal silicon held in a boat. The heating is accomplished by resistance heating or electron beam method (E.B. method).

In either case where the sputtering process or the ion-plating process is employed, the layer may be incorporated with halogen atoms by introducing one of the above-mentioned gaseous halides or halogen-containing silicon compounds into the deposition chamber in which a plasma atmosphere of the gas is produced. In the case where the layer is incorporated with hydrogen atoms in accordance with the sputtering process, a feed gas to liberate hydrogen is introduced into the deposition chamber in which a plasma atmosphere of the gas is produced. The feed gas to liberate hydrogen atoms includes $H_2$ gas and the above-mentioned silanes.

For the formation of the layer in accordance with the glow discharging process, reactive sputtering process or ion plating process, the foregoing halide or halogen-containing silicon compound can be effectively used as the starting material for supplying halogen atoms. Other effective examples of said material can include hydrogen halides such as $SiH_2F_2$, $SiH_2I_2$, $SiH_2Cl_2$, $SiHCl_3$, $SiH_2Br_2$ and $SiHBr_3$, which contain hydrogen atom as the constituent element and which are in the gaseous state or gasifiable substances. The use of the gaseous or gasifiable hydrogen-containing halides is particularly advantageous since, at the time of forming a light receiving layer, the hydrogen atoms, which are extremely effective in view of controlling the electrical or photoelectrographic properties, can be introduced into that layer together with halogen atoms.

The structural introduction of hydrogen atoms into the layer can be carried out by introducing, in addition to these gaseous starting materials, $H_2$, or silicon hydrides such as $SiH_4$, $SiH_6$, $Si_3H_6$, $Si_4H_{10}$, etc. into the deposition chamber together with a gaseous or gasifiable silicon-containing substance for supplying Si, and producing a plasma atmosphere with these gases therein.

For example, in the case of the reactive sputtering process, the layer composed of A-Si(H,X) is formed on the substrate by using an Si target and by introducing a halogen atom introducing gas and $H_2$ gas, if necessary, together with an inert gas such as He or Ar into the deposition chamber to thereby form a plasma atmosphere and then sputtering the Si target.

As for hydrogen atoms (H) and halogen atoms (X) to be optionally incorporated in the layer, the amount of hydrogen atoms or halogen atoms, or the sum of the amount for hydrogen atoms and the amount for halogen atoms (H+X) is preferably 1 to 40 atomic %, and, more preferably, 5 to 30 atomic %.

The control of the amount for hydrogen atoms (H) and halogen atoms (X) to be incorporated in the layer can be carried out by controlling the temperature of a substrate, the amount if the starting material for supplying hydrogen atoms and/or halogen atoms to be introduced into the deposition chamber, discharging power, etc.

The formation of a layer composed of A-Si(H,X) containing germanium atoms, oxygen atoms or/and nitrogen atoms, the Group III atoms or the Group V atoms in accordance with the glow discharging process, reactive sputtering process or ion plating process can be carried out by using the starting material for supplying germanium atoms, the starting material for supplying oxygen atoms or/and nitrogen atoms, and the starting material for supplying the Group III or Group V atoms together with the starting materials for forming an A-Si(H,X) material and by incorporating relevant atoms in the layer to be formed while controlling their amounts properly.

To form the layer of a-SiGe (H,X) by the glow discharge process, a feed gas to liberate silicon atoms (Si), a feed gas to liberate germanium atoms (Ge), and a feed gas to liberate hydrogen atoms (H) and/or halogen atoms (X) are introduced under appropriate gaseous pressure condition into an evacuatable deposition chamber, in which the glow discharge is generated so that a layer of a-SiGe (H,X) is formed on the properly positioned substrate in the chamber.

The feed gases to supply silicon atoms, halogen atoms, and hydrogen atoms are the same as those used to form the layer of a-Si(H,X) mentioned above.

The feed gas to liberate Ge include gaseous or gasifiable germanium halides such as $GeH_4$, $Ge_2H_6$, $Ge3_2H_8$, $Ge_4H_{10}$, $Ge_5H_{12}$, $Ge_4H_{14}$, $Ge_7H_{16}$, $Ge_5H_{18}$, and $Ge_9H_{20}$, with $GeH_4$, $Ge_2H_6$ and $Ge_3H_8$, being preferable on account of their ease of handling and the effective liberation of germanium atoms.

To form the layer of a-SiGe (H,X) by the sputtering process, two targets a (a Silicon target and a germanium target) or a single target composed of silicon and germanium is subjected to sputtering in a desired gas atmosphere.

To form the layer of a-SiGe(H,X) by the ion-plating process, the vapors of silicon and germanium are allowed to pass through a desired gas plasma atmosphere. The silicon vapor is produced by heating polycrystal silicon or single crystal silicon held in a boat, and the germanium vapor is produced by heating polycrystal germanium or single crystal germanium held in a boat. The heating is accomplished by resistance heating or electron beam method (E.B. method).

In either case where the sputtering process or the ion-plating process is employed, the layer may be incorporated with halogen atoms by introducing one of the above-mentioned gaseous halides or halogen-containing silicon compounds into the deposition chamber in which a plasma atmosphere of the gas is produced. In the case where the layer is incorporated with hydrogen atoms, a feed gas to liberate hydrogen is introduced into the deposition chamber in which a plasma atmosphere of the gas is produced. The feed gas may be gaseous hydrogen, silanes, and/or germanium hydrides. The feed gas to liberate halogen atoms includes the above-mentioned halogen-containing silicon compounds. Other examples of the feed gas include hydrogen halides such as HF, HCl, HBr, and HI; Halogen-substituted silanes such as $SiH_2F_2$, $SiH_2I_2$, $SiH_2Cl_2$, $SiCl_3$, $SiH_2Br_2$, and $SiHBr_3$; germanium hydride halide such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHi_3$, $GeH_2I_2$, and $GeH_3I$; and germanium halides such as $GeF_4$, $GeCl_4$, $GeBr_4$, $GeI_4$, $GeI_4$, $GeF_2$, $GeCl_2$, Ge $Br_2$, and $GeI_2$. They are in the gaseous form or gasifiable substances.

In order to form a layer or a partial layer region constituted with A-Si(H,X) further incorporated with oxygen atoms or/and nitrogen atoms and the Group III atoms or the Group V atoms (hereinafter referred to as "A-Si(H,X)(O,N,)(M)" in which M stands for the Group III atoms or the Group V atoms) using the glow discharging process, reactive sputtering process or in plating process, the starting materials for supplying oxygen atoms or/and nitrogen atoms and for supplying the Group III atoms or the Group V atoms are used together with the starting materials for forming an A-Si(H,X) upon forming the layer or the partial layer region while controlling their amounts to be incorporated therein.

Likewise, a layer or a partial layer region constituted with A-SiGe (O,N)(M) can be properly formed.

As the starting materials for supplying oxygen atoms, nitrogen atoms, the Group III atoms and the Group V atoms, most of gaseous or gasifiable materials which contain at least such atoms as the constituent atoms can be used.

In order to form a layer or a partial layer region containing oxygen atoms using the glow discharging process, starting material for introducing the oxygen atoms is added to the materials elected as required from the starting materials for forming said layer or partial layer region as described above.

As the starting material for introducing oxygen atoms, most of those gaseous or gasifiable materials which contain at least oxygen atoms as the constituent atoms can be employed.

For instance, it is possible to use a mixture of a gaseous starting material containing silicon atoms (Si) as the constituent atoms, a gaseous starting material containing oxygen atoms (O) as the constituent atom and, as required, a gaseous starting material containing hydrogen atoms (H) and/or halogen atoms (X) as the constituent atoms in a desired mixing ration, a mixture of gaseous starting material containing silicon atoms (Si) as the constituent atoms and a gaseous starting materials containing oxygen atoms (O) and hydrogen atoms (H) as the constituent atoms in a desired mixing ratio, or a mixture of gaseous starting material containing silicon atoms (Si) as the constituent atoms and a gaseous starting material containing silicon atoms (Si), oxygen atoms (O) and hydrogen atoms (H) as the constituent atoms.

Further, it is also possible to use a mixture of a gaseous starting material containing silicon atoms (Si) and hydrogen atoms (H) as the constituent atoms and a gaseous starting material containing oxygen atoms (O) as the constituent atoms.

Specifically, there can be mentioned, for example, oxygen ($O_2$), ozone ($O_3$), nitrogen monoxide (NO), nitrogen dioxide ($NO_2$) , dinitrogen oxide ($N_2O$), dinitrogen trioxide ($N_2O_3$), dinitrogen tetraoxide ($N_2O_4$), dinitrogen pentoxide ($N_2O_5$), nitrogen trioxide ($NO_3$), lower siloxanes comprising silicon atoms (Si), oxygen atoms (O) and hydrogen atoms (H) as the constituent atoms, for example, disiloxane ($H_3SiOSiH_3$) and trisiloxane ($H_3SiOSiH_2OSiH_3$), etc.

In the case of forming a layer or a partial layer region containing oxygen atoms by way of the sputtering process, it may be carried out by sputtering a single crystal or polycrystalline Si wafer or $SiO_2$ wafer, or a wafer containing Si and $SiO_2$ in admixture is used as a target and sputtering them in various gas atmospheres.

For instance, in the case of using the Si wafer as the target, a gaseous starting material for introducing oxygen atoms and, optionally, hydrogen atoms and/or halogen atoms is diluted as required with a dilution gas, introduced into a sputtering deposition chamber, gas plasmas with these gases are formed and the Si wafer is sputtered.

Alternatively, sputtering may be carried out in the atmosphere of a dilution gas or in a gas atmosphere containing at least hydrogen atoms (H) and/or halogen atoms (X) as constituent atoms as a sputtering gas by using individually Si and $SiO_2$ targets or a single Si and $SiO_2$ mixed target. As the gaseous starting material for introducing the oxygen atoms, the gaseous starting material for introducing the oxygen atoms shown in the examples for the glow discharging process as described above can be used as the effective gas also in the sputtering.

In order to form a layer or a partial layer region containing nitrogen atoms using the glow discharging process, the starting material for introducing nitrogen atoms is added to the material selected as required from the starting materials for forming said layer or partial layer region as described above. As the starting material for introducing nitrogen atoms, most of gaseous or gasifiable materials which contain at least nitrogen atoms as the constituent atoms can be used.

For instance, it is possible to use a mixture of a gaseous starting material containing silicon atoms (Si) as the constituent atoms, a gaseous starting material containing nitrogen atoms (N) as the constituent atoms and, optionally, a gaseous starting material containing hydrogen atoms (H) and/or halogen atoms (X) as the constituent atoms in a desired mixing ratio, or a mixture of a starting gaseous material containing silicon atoms (Si) as the constituent atoms and gaseous starting material containing nitrogen atoms (N) and hydrogen atoms (H) as the constituent atoms also in a desired mixing ratio.

Alternatively, it is also possible to use a mixture of a gaseous starting material containing nitrogen atoms (N) as the constituent atoms and a gaseous starting material containing silicon atoms (Si) and hydrogen atoms (H) as the constituent atoms.

The starting material that can be used effectively as the gaseous starting material for introducing the nitrogen atoms (N) used upon forming the flayer or partial layer region containing nitrogen atoms can include gaseous or gasifiable nitrogen, nitrides and nitrogen compounds such as azide compounds comprising N as the constituent atoms or N and H as the constituent atoms, for example, nitrogen ($N_2$), ammonia ($NH_3$), hydrazine ($H_2NNH_2$), hydrogen azide ($HN_3$) and ammonium azide ($NH_4N_3$). In addition, nitrogen halide compounds such as nitrogen trifluoride ($F_3N$) and nitrogen tetrafluoride ($F_4N_2$) can also be mentioned in that they can also introduce halogen atoms (X) in addition to the introduction of nitrogen atoms (N).

The layer or partial layer region containing nitrogen atoms may be formed through the sputtering process by using a single crystal or polycrystalline Si wafer or $Si_3N_4$ wafer or a wafer containing Si and $Si_3N_4$ in admixture as a target and sputtering them in various gas atmospheres.

In the case of using an Si wafer as a target, for instance, a gaseous starting material for introducing nitrogen atoms and, as required, hydrogen atoms and/or halogen atoms is diluted optionally with a dilution gas, and introduced into a sputtering deposition chamber to form gas plasmas with these gases and the Si wafer is sputtered.

Alternatively, Si and $Si_3N_4$ may be used as individual targets or as a single target comprising Si and $Si_3N_4$ in admixture and then sputtered in the atmosphere of a dilution gas or in a gaseous atmosphere containing at least hydrogen atoms (H) and/or halogen atoms (X) as the constituent atoms as for the sputtering gas. As the gaseous starting material for introducing nitrogen atoms, those gaseous starting materials for introducing the nitrogen atoms describe previously shown in the example of the glow discharging can be used as the effective gas also in the case of the sputtering.

For instance, in the case of forming a layer or a partial layer region constituted with A-Si(H,X) (O,N) or A-SiGe(H, M) (O,N) further incorporated with the Group III atoms or Group V atoms by using the glow discharging, sputtering, or ion-plating process, the starting material for introducing the Group III or Group V atoms are used together with the starting materials for forming A-Si (H,X) (O,N) or A-SiGe (H,X) (O,N) upon forming the layer or partial layer region constituted with A-Si (H,X) (O,N) or A-SiGe (H, X) (O,N) as described above and they are incorporated while controlling their amounts.

Referring specifically to the boron atoms introducing materials as the starting material for introducing the Group III atoms, they can include baron hydrides such as $B_2H_6$, $B_4H_{10}$, $B_5H_9$, $B_5H_{11}$, $B_6H_{10}$, $B_6H_{12}$, and $B_6H_{14}$, and boron halides such as $BF_3$, $BCl_3$, and $BBr_3$. In addition, $AlCl_3$, $CaCl_3$, $G(CH_3)_2$, $INCl_3$, $TlCl_3$, and the like can also be mentioned.

Referring to the starting material for introducing the Group V atoms and, specifically, to the phosphorous atoms introducing materials, they can included, for example, phosphorus hydrides such as $PH_3$ and $P_2H_6$ and phosphorus halides such as $PH_4I$, $PF_3$, $PF_5$, $PCl_3$, $PCl_5$, $PBr_5$, and $PI_3$. In addition, $AsH_3$, $AsF_5$, $AsCl_3$, $AsBr_3$, $AsF_3$, $SbH_3$, $SbF_3$, $SbF_5$, $SbCl_3$, $SbCl_5$, $BiH_3$, $BiCl_3$, and $BiBr_3$ can also be mentioned as the effective starting material for introducing the Group V atoms.

Preparation of Second Layer (103)

The second layer 103 constituted with an amorphous material containing silicon atoms as the main constituent atoms, carbon atoms, the Group III atoms or the Group V atoms, and optionally one or more kinds selected form hydrogen atoms, halogen atoms, oxygen atoms and nitrogen atoms [hereinafter referred to as "A-SiCM(H,X)(O,N)" wherein M stands for the Group III atoms or the Group V atoms] can be formed in accordance with the glow discharging process, reactive sputtering process or ion plating process by using appropriate starting material for supplying relevant atoms together with the starting materials for forming an A-Si(H,X) material and incorporating relevant atoms in the layer to be formed while controlling their amounts properly.

For instance, in the case of forming the second layer in accordance with the glow discharging process, the gaseous starting materials for forming A-SiCM(H,X)(O,N) are introduced into the deposition chamber having a substrate, if necessary, while mixing with a dilution gas in a predetermined mixing ratio, the gaseous materials are exposed to a glow discharging power energy to thereby generate gas plasmas resulting in forming a layer to be the second layer 103 which is constituted with A-SiCm(H,X)(O,N) on the substrate.

In the typical embodiment, the second layer 103 is represented by a layer constituted with A-SiCM(H,X).

In the case of forming said layer, most of gaseous or gasifiable materials which contain at least one kind selected from silicon atoms (Si), carbon atoms (C), hydrogen atoms (H) and/or halogen atoms (X), the Group III atoms or the Group V atoms as the constituent atoms can be sued as the starting materials.

Specifically, in the case of using the glow discharging process for forming the layer constituted with A-SiCM(H, X), a mixture of a gaseous starting material containing Si as the constituent atoms, a gaseous starting material containing C as the constituent atoms, a gaseous starting material containing the Group III atoms or the Group V atoms as the constituent atoms and, optionally, a gaseous starting material containing H and/or X as the constituent atoms in a required mixing ratio: a mixture of a gaseous starting material containing C, H and/or X as the constituent atoms and a gaseous material containing the Group III atoms or the Group V atoms as the constituent atoms in a required mixing ratio: or a mixture of a gaseous material containing Si as the constituent atoms, a gaseous starting material containing Si, C and H or/and X as the constituent atoms and a gaseous starting material containing the Group III or the Group V atoms as the constituent atoms in a required mixing ratio are optionally used.

Alternatively, a mixture of a gaseous starting material containing Si, H and/or X as the constituent atoms, a gaseous starting material containing C as the constituent atoms and a gaseous starting material containing the Group III atoms or the Group V atoms as the constituent atoms in a required mixing ratio can be effectively used.

Those gaseous starting materials that are effectively usable herein can include gaseous silicon hydrides comprising C and H as the constituent atoms, such as silanes, for example, $SiH_4$, $Si_2H_6$, $Si_3H_8$ and $Si_4H_{10}$, as well as those comprising C and H as the constituent atoms, for example saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$), propane ($CH_8$), n-butane (n-$C_4H_{10}$) and pentane ($C_5H_{12}$), the ethylenic hydrocarbons can include ethylene ($C_2H_4$), propylene ($C_3H_6$, butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$).

The gaseous starting material comprising Si, C and H as the constituent atoms can include silicified alkyls, for example, $Si(Ch_3)_4$ and $Si(C_2H_5)_4$. In addition to these gaseous starting materials, $H_2$ can of course be used as the gaseous starting material for introducing H.

For the starting materials for introducing the Group III atoms, the Group V atoms, oxygen atoms and nitrogen atoms, those mentioned above in the case of forming the first layer can be used.

In the case of forming the layer constituted with A-SiCM(H,X) by way of the reactive sputtering process, it is carried out by using a single crystal or polycrystal Si wafer, a C (graphite) wafer or a wafer containing a mixture of Si and C as a target and sputtering them in a desired gas atmosphere.

In the case of using, for example, a Si wafer as a target, gaseous starting materials for introducing C, the Group III atoms or the Group V atoms, and optionally H and/or X are introduced while being optionally diluted with a dilution gas such as Ar and He into the sputtering deposition chamber to thereby generate gas plasmas with these gases and sputter the Si wafer.

As the respective gaseous material for introducing the respective atoms, those mentioned above in the case of the forming the first layer can be used.

As above explained, the first layer and the second layer to constitute the light receiving layer of the light receiving member according to this invention can be effectively formed by the glow discharging process or reactive sputtering process. The amount of germanium atoms; the Group III atoms or the Group V atoms; oxygen atoms or/and nitrogen atoms; carbon atoms; and hydrogen atoms or/and halogen atoms in the first layer or the second layer are properly controlled by regulating the gas flow rate of each of the starting materials or the gas flow ratio among the starting materials respectively entering the deposition chamber.

The conditions upon forming the first layer or the second layer of the light receiving member of the invention, for example, the temperature of the substrate, the gas pressure in the deposition chamber, and the electric discharging power are important factors for obtaining the light receiving member having desired properties and they are properly selected while considering the functions of the layer to be formed. Further, since these layer forming conditions may be varied depending on the kind and the amount of each of the atoms contained in the first layer or the second layer, the conditions have to be determined also taking the kind or the amount of the atoms to be contained into consideration.

For instance, in the case of forming the layer constituted with A-Si(H,X) or the layer constitute with A-SiCM(H, X)(O,N), the temperature of the support is preferably from 50° to 350° C. and, more preferably, form 50° to 250° C.; the gas pressure in the deposition chamber, and the electric discharging power are important factors for obtaining the light receiving member having desired properties and they are properly selected while considering the functions of the layer to be formed. Further, since these layer forming conditions may be varied depending on the kind and he amount of each of the atoms contained in the first layer or the second layer, the conditions have to be determined also taking the kind or the amount of the atoms to be contained into consideration.

For instance, in the case of forming the layer constituted with A-Si(H,X) or the layer constituted with A-SiCM(H,X)(O,N), the temperature of the support is preferably from 50° to 350° C. and more preferably, from 50° to 250° C.; the gas pressure in the deposition chamber is preferably from 0.01 to 1 Torr and, particularly preferably, from 0.1 to 0.5 Torr; and the electrical discharging power is usually from 0.005 to 50 W/cm$^2$, more preferably, form 0.01 to 30 W/cm$^2$ and, particularly preferably, from 0.01 to 20 W/cm$^2$.

In the case of forming the layer constituted with A-SiCM(H,X) or the layer constituted with A-SiCM(H,X)(O,N)(M), the temperature of the support is preferably, from 100° to 300° C.; the gas pressure in the deposition chamber is usually from 0.01 to 5 Torr, more preferably, rom 0101 to 3 Torr, most preferably from 0.1 to 1 Torr; and the electrical discharging power is preferably from 0.005 to 50 W/cm$^2$, more preferably, from 0.01 to 30 W/cm$^2$, most preferably, from 0.01 to 20 W/cm$^2$.

However, the actual conditions for forming the first layer or the second layer such as temperature of the substrate, disc having power and the gas pressure in the deposition chamber cannot usually be determined with ease independent of each other. Accordingly, the conditions optimal to the layer formation are desirably determined based on relative and organic relationships for forming the first layer and the second layer respectively having desired properties.

By the way, it is necessary that the foregoing various conditions are kept constant upon forming the light receiving layer for unifying the distribution state of germanium atoms, oxygen atoms or/and nitrogen atoms, carbon atoms, the Group III atoms or Group V atoms, or hydrogen atoms and/or nitrogen atoms at a desirably distributed state in the thicknesswise direction of the layer by varying their distributing concentration in the thicknesswise direction of the layer upon forming the first layer in this invention, the layer is formed, for example, in the case of the glow discharging process, by properly varying the gas flow rate of gaseous starting material for introducing germanium atoms, the Group III atoms or the Group V atoms, and oxygen atoms or/and nitrogen atoms upon introducing halogen atoms to be contained in the first layer or the second layer according to this invention.

Further, in the case of forming the first layer containing, except silicon atoms and optional halogen atoms or/and halogen atoms, germanium atoms and optional the Group III atoms or the Group V atoms and oxygen atoms or/and into the deposition chamber in accordance with a desired variation coefficient while maintaining other conditions constant. The, the gas flow rate may be varied, specifically, by gradually changing the opening degree of a predetermined needle value disposed to the midway of the gas flow system, for example, manually or any of other means usually employed such as in externally driven motor. In this case, the variation of the flow rate may not necessarily be linear but a desired content curve may be obtained, for example, by controlling the flow rate along with a previously design variation coefficient curve by using a microcomputer or the like.

Further, in the case of forming the first layer in accordance with the reactive sputtering process, a desirably distributed state of germanium atoms, the Group III atoms or the Group V atoms, and oxygen atoms or/and nitrogen atoms in the thicknesswise direction of the layer may be established with the distributing concentration being varied in the thicknesswise direction of the layer by using a relevant starting material for introducing germanium atoms, the Group III or Group V atoms, and oxygen atoms or/and nitrogen atoms and varying the gas flow rate upon introducing these gases in the other deposition chamber in accordance with a desired variation coefficient in the same manner as the case of using the glow discharging process.

DESCRIPTION OF THE PREFERRED EMBODIMENTS

The invention will be described more specifically while referring to Examples 1 through 66, but the invention is not intended to be limited in scope only to these Examples.

In each of the Examples, the first layer and the second layer were formed by using the glow discharging process.

Figure 14:
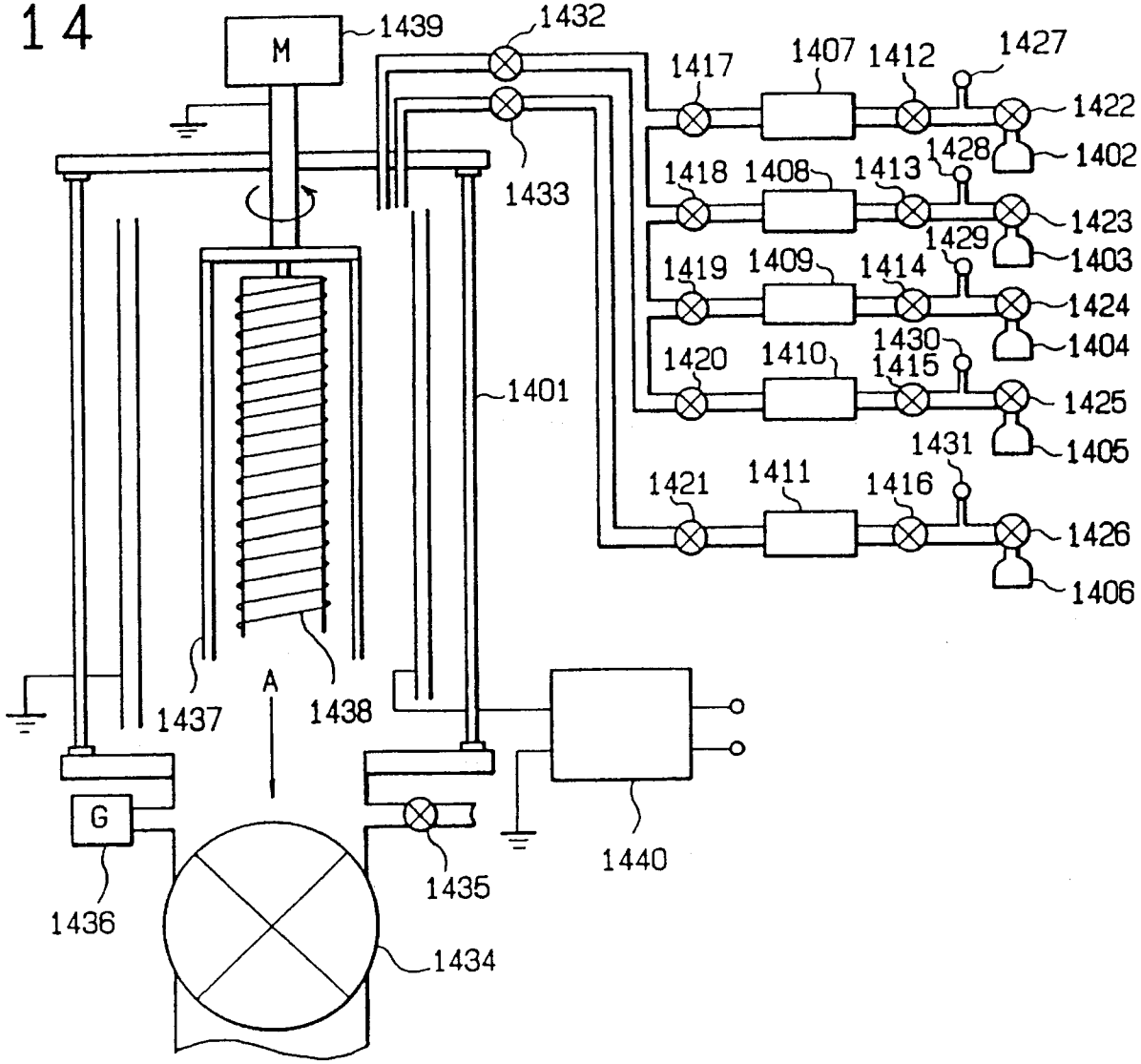
FIG. 14 is a schematic explanatory view of a fabrication device by glow discharge process as an example of the device for preparing the first layer and the second layer respectively of the light receiving member according to this invention.

FIG. 14 shows an apparatus for preparing a light receiving member according to this invention by means of the glow discharging process.

Gas reservoirs 1402, 1403, 1404, 1405, and 1406 illustrated in the figure are charged with gaseous starting materials for forming the respective layer in this invention, that is, for instance, $SiH_4$ gas (99.9999% purity) diluted with He (hereinafter referred to as "$SiH_4$/He") in gas reservoir 1402, $B_2H_6$ gas (99.999% purity) diluted with He (hereinafter referred to as "$NH_3$/He") in gas reservoir 1404, $C_2H_4$ gas (99.999% purity) in gas reservoir 1405, and $GeH_4$ gas (99.999% purity) diluted with He (hereinafter referred to as "$GeH_4$/He") in gas reservoir 1406.

In the case of incorporating halogen atoms in the layer to be formed, for example, $SiF_4$ gas in another gas reservoir is used instead of the foregoing $SiH_4$ gas.

Prior to the entrance of these gases into a reaction chamber 1401, it is confirmed that valves 1422 through 1426 for the gas reservoirs 1402 through 1406 and a leak valve 1435 are closed and that inlet valves 1412 through 1416, exit valves 1417 through 1421, and sub-valves 1432 and 1433 are opened. Then, a main valve 1434 is at first opened to evacuate the inside of the reaction chamber 1401 and gas piping.

Then, upon observing that the reading on the vacuum gauge 1436 became about $5\times10^{-6}$ Torr, the sub-valves 1432 and 1433 and the exit valves 1417 through 1421 are closed.

Now, reference is made in the following to an example in the case of forming a layer to be the first layer 102 on an Al cylinder as the substrate 1437.

At first, $SiH_4$/He gas form the gas reservoir 1402, $B_2H_6$/HE gas from the gas reservoir 1403, $NJ_3$/He gas form the gas reservoir 1404, and $GeH_4$/He gas form the gas reservoir 1406 are caused to flow into mass flow controllers 1407, 1408, 1409, and 1411 respectively by opening the inlet valves 1412, 1413, 1414, and 1416, controlling the pressure of exist pressure gauges 1427, 1428, 1429, and 1431 to 1 kg/cm$^2$. Subsequently, the exit valves 1417, 1418, 1419, and 1421, and the sub-valves 1432 and 1433 are gradually opened to enter the gases into the reaction chamber 1401. In this case, the exist valves 1417, 1418, 1419, and 1421 are adjusted so as to attain a desired value for the ratio among the $SiH_4$/He gas flow rate, $B_2H_6$/He gas flow rate, $NH_3$He gas flow rate, and Ga/He gas flow rate, and the opening of the main valve 1434 is adjusted while observing the reading on the vacuum gauge 1436 so as to obtain a desired value for the pressure inside the reaction chamber 1401. Then, after confirming that the temperature of the Al cylinder substrate 1437 has been set by heater 1438 within a range from 50° to 350° C., a power source 1440 is set to a predetermined electrical power to cause glow discharging in the reaction chamber 1401 while controlling the flow rates for $GeH_4$/He gas, $B_2H_6$/He gas, $HN_3$/He gas and $SiH_4$ gas in accordance with a previously designed variation coefficient curve by using a microcomputer (not shown), thereby forming, at first, a layer of an amorphous silicon material to be the first layer 102 containing germanium atoms, boron atoms and nitrogen atoms on the Al cylinder.

Then, a layer to be the second layer 103 is formed on the photosensitive layer. Subsequent to the procedures as described above, $SiH_4$ gas, $C_2H_4$ gas and $PH_3$ gas, for instance, are optionally diluted with a dilution gas such as He, Ar and $H_2$ respectively, entered at desired gas flow rates into the reaction chamber 1401 while controlling the gas flow rates for the $SiH_4$ gas, the $C_2H_4$ gas and the $PH_3$ gas by using a microcomputer and glow discharge being caused in accordance with predetermined conditions, by which the second layer constituted with A-SiCM(H,X) is formed.

All of the exit valves other than those required for forming the respective layers are of course closed. Further, upon forming the respective layers, the inside of the system is once evacuated to a high vacuum degree as required by closing the exit valves 1417 through 1421 while opening the sub-valves 1432 and 1433 and fully opening the main valve 1434 for avoiding that the gases having been used for forming the previous layer are left in the reaction chamber 1401 and in the gas pipeways from the exit valves 1417 through 1421 to the inside of the reaction chamber 1401.

Further, during the layer forming operation, the Al cylinder as substrate 1437 is rotated at a predetermined speed by the action of the motor 1490.

Example 1

Figure 15:
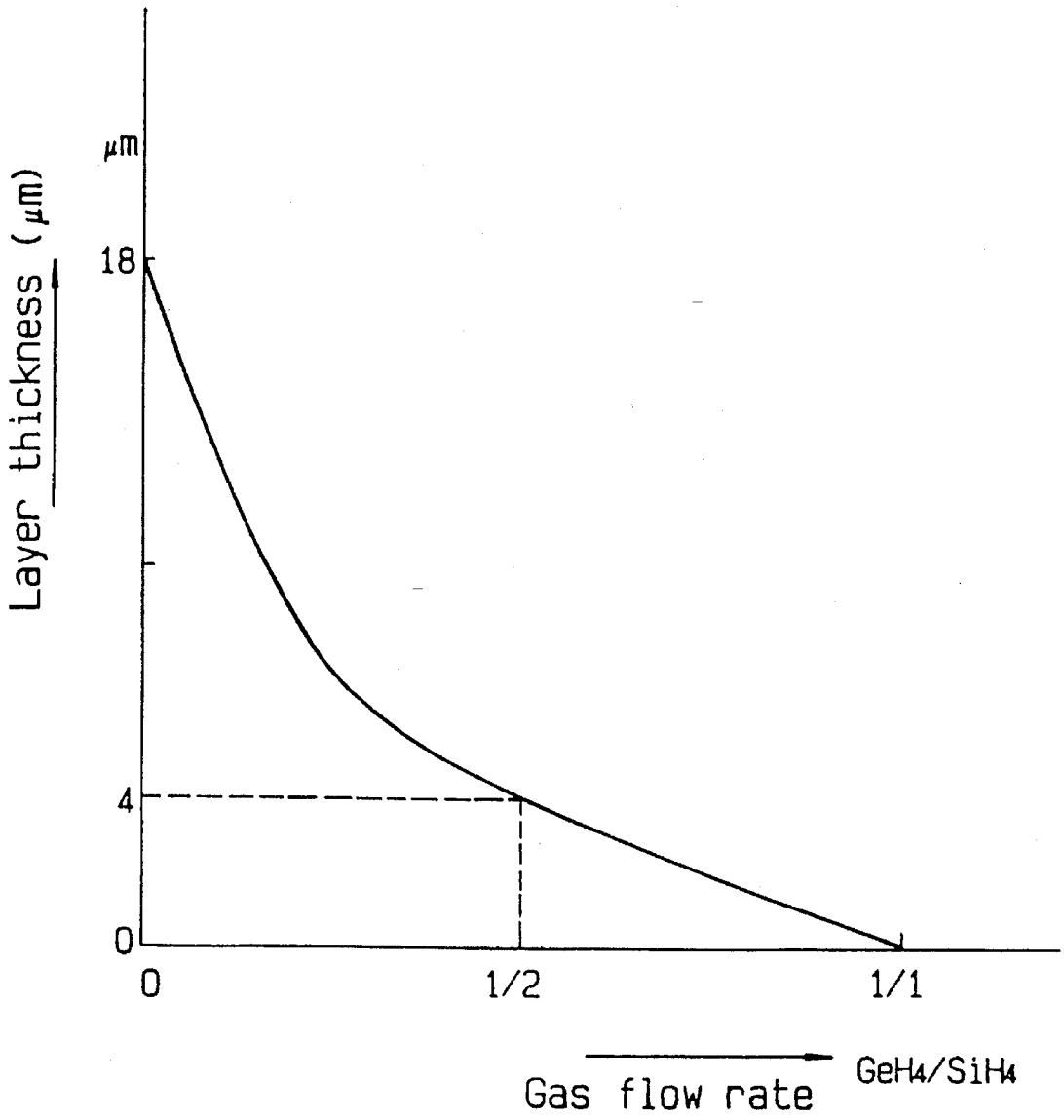
FIGS. 15 through 27 are views illustrating the variations in the gas flow rates in forming the light receiving layers according to this invention, wherein the ordinate represents the thickness of the layer and the abscissa represents the flow rate of a gas to be used.
Figure 16:
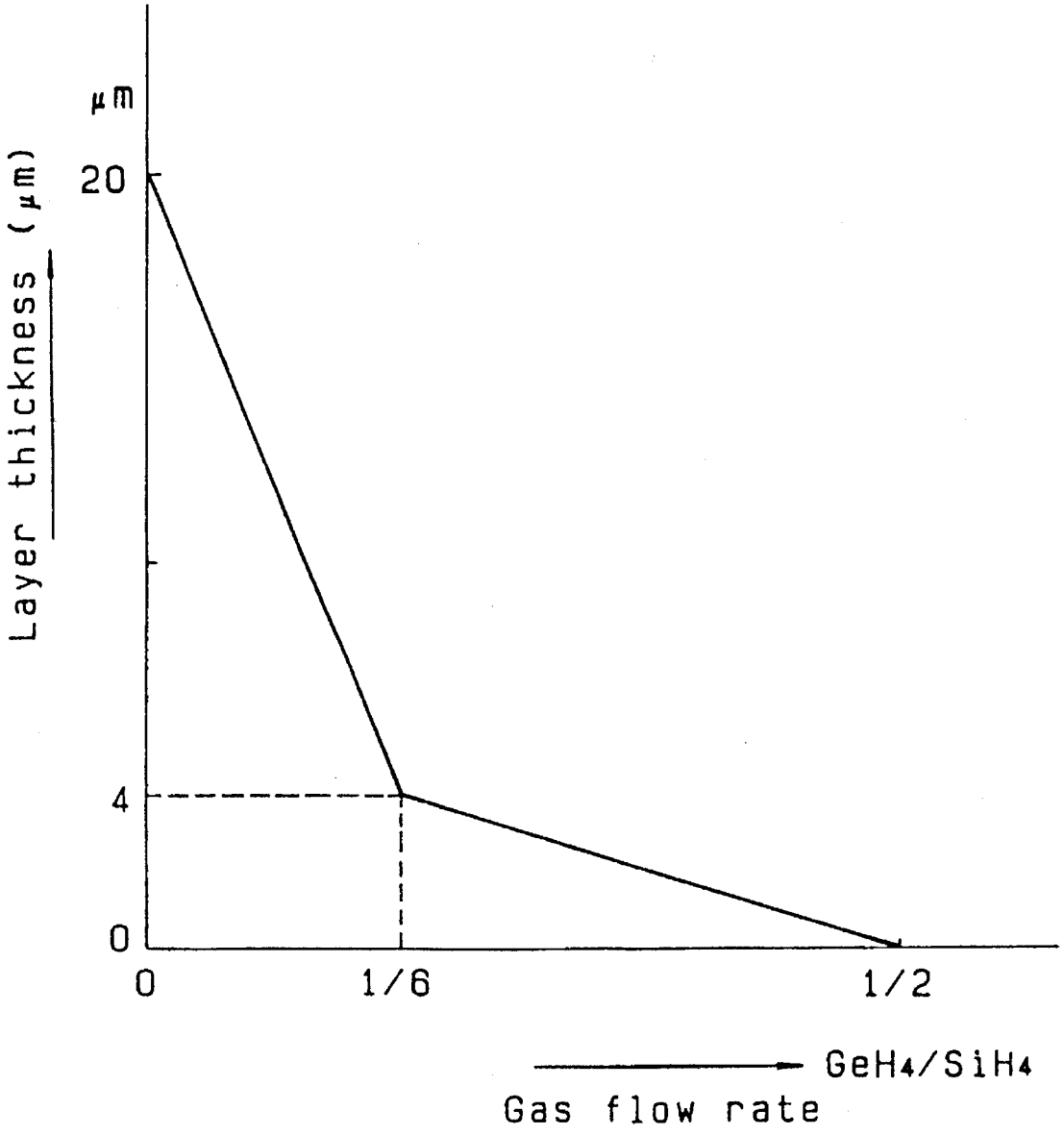
Figure 17:
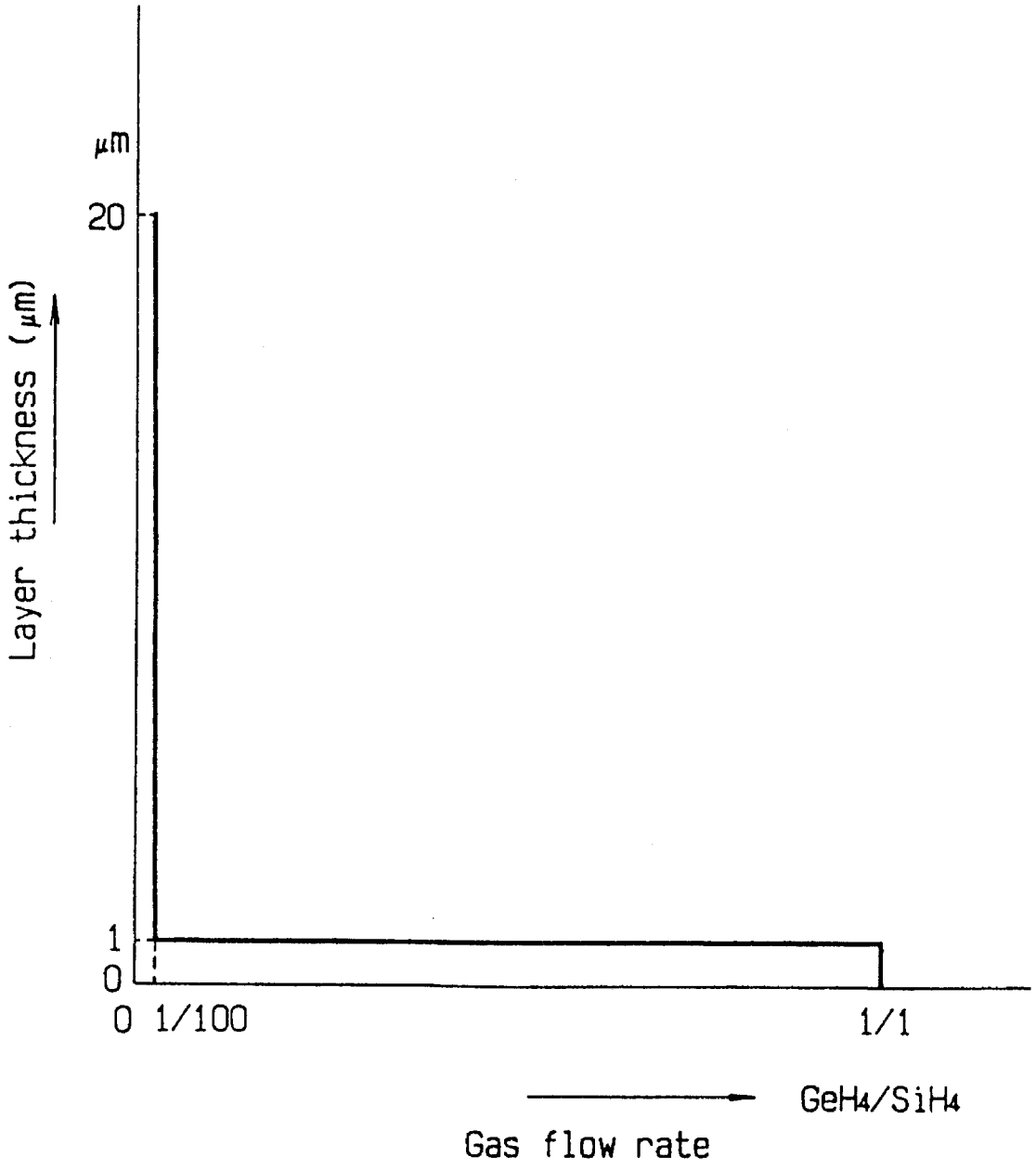
Figure 18:
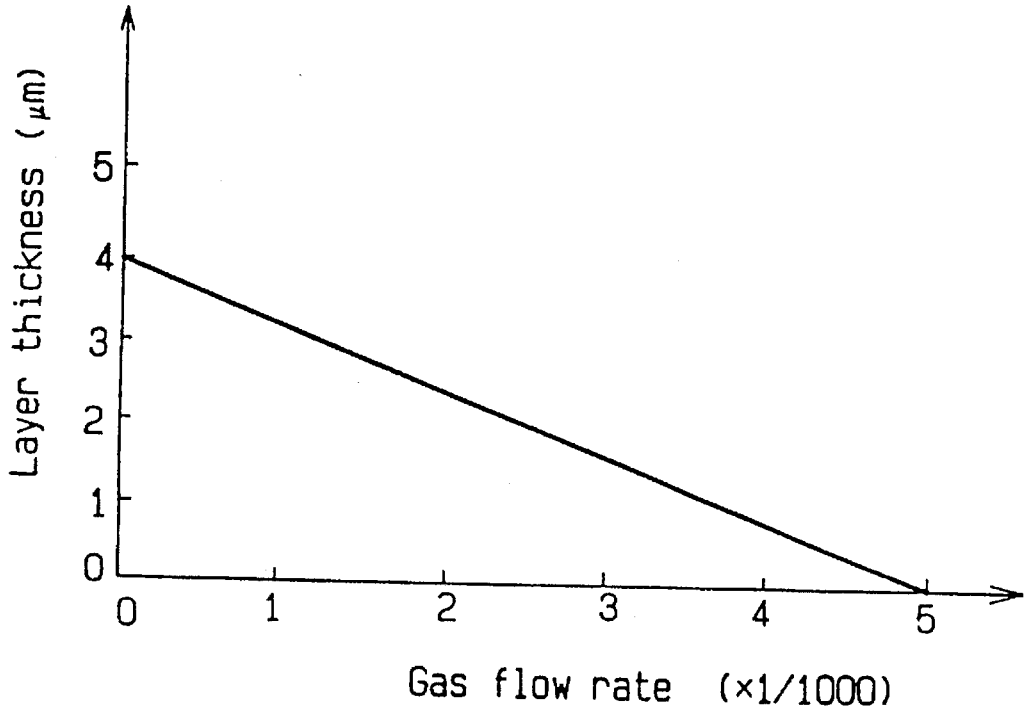
Figure 19:
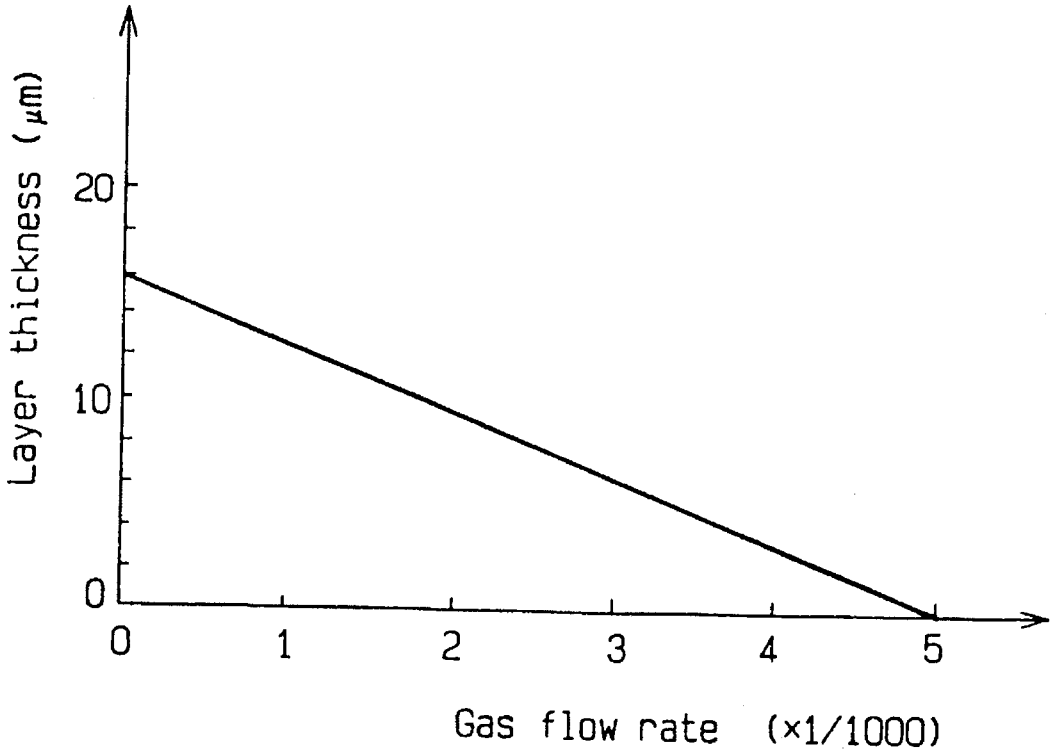
Figure 20:
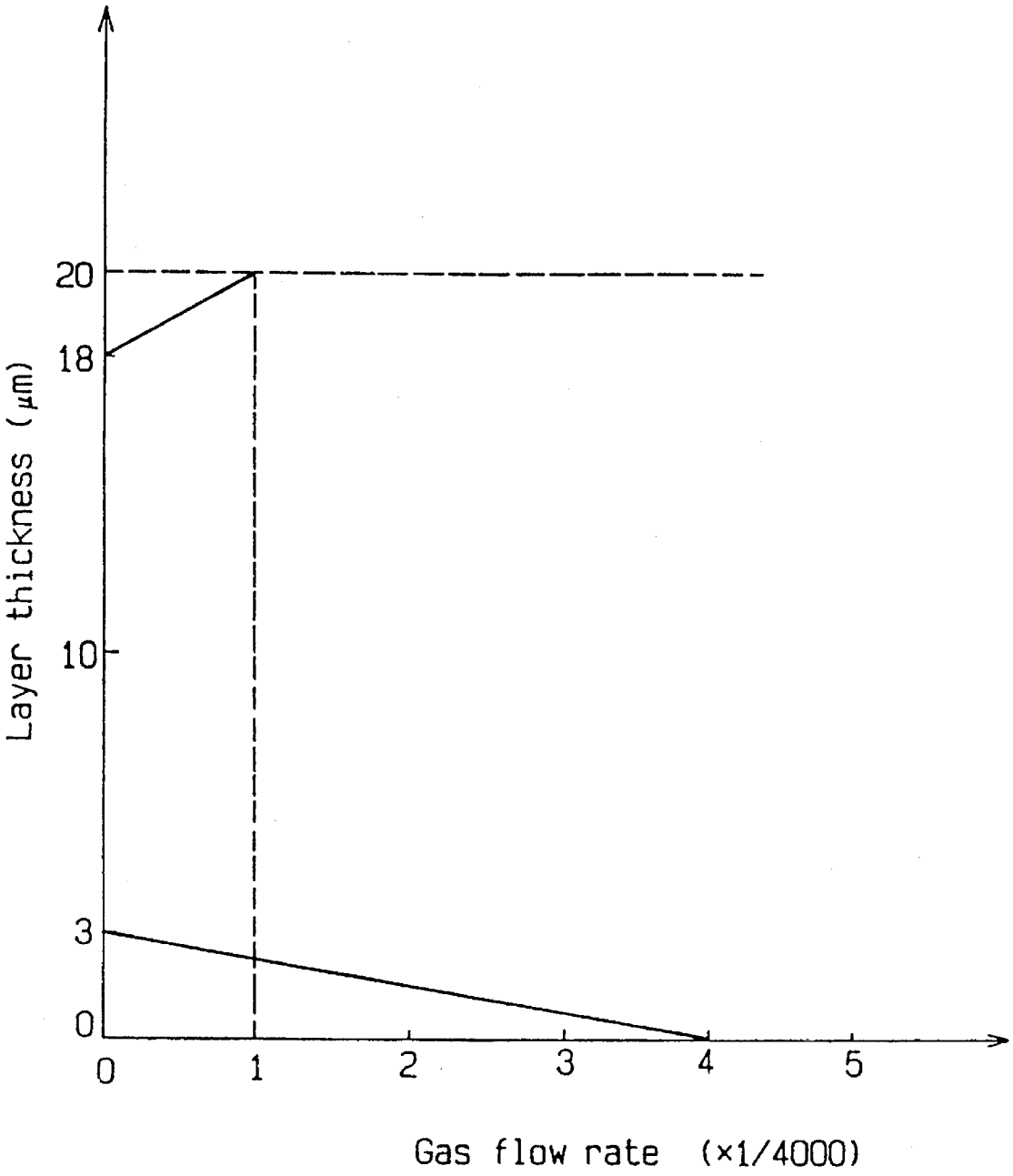
Figure 21:
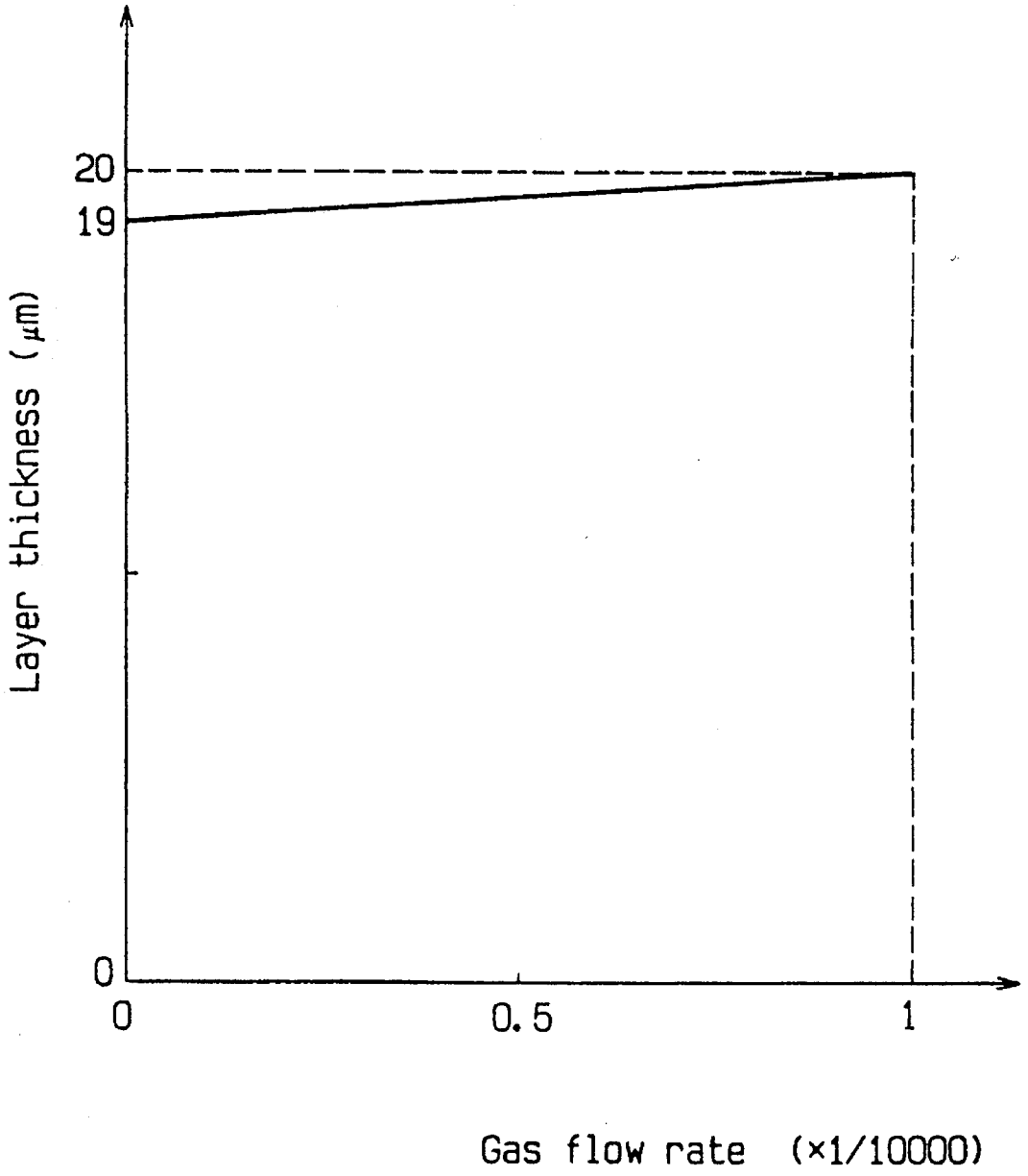
Figure 22:
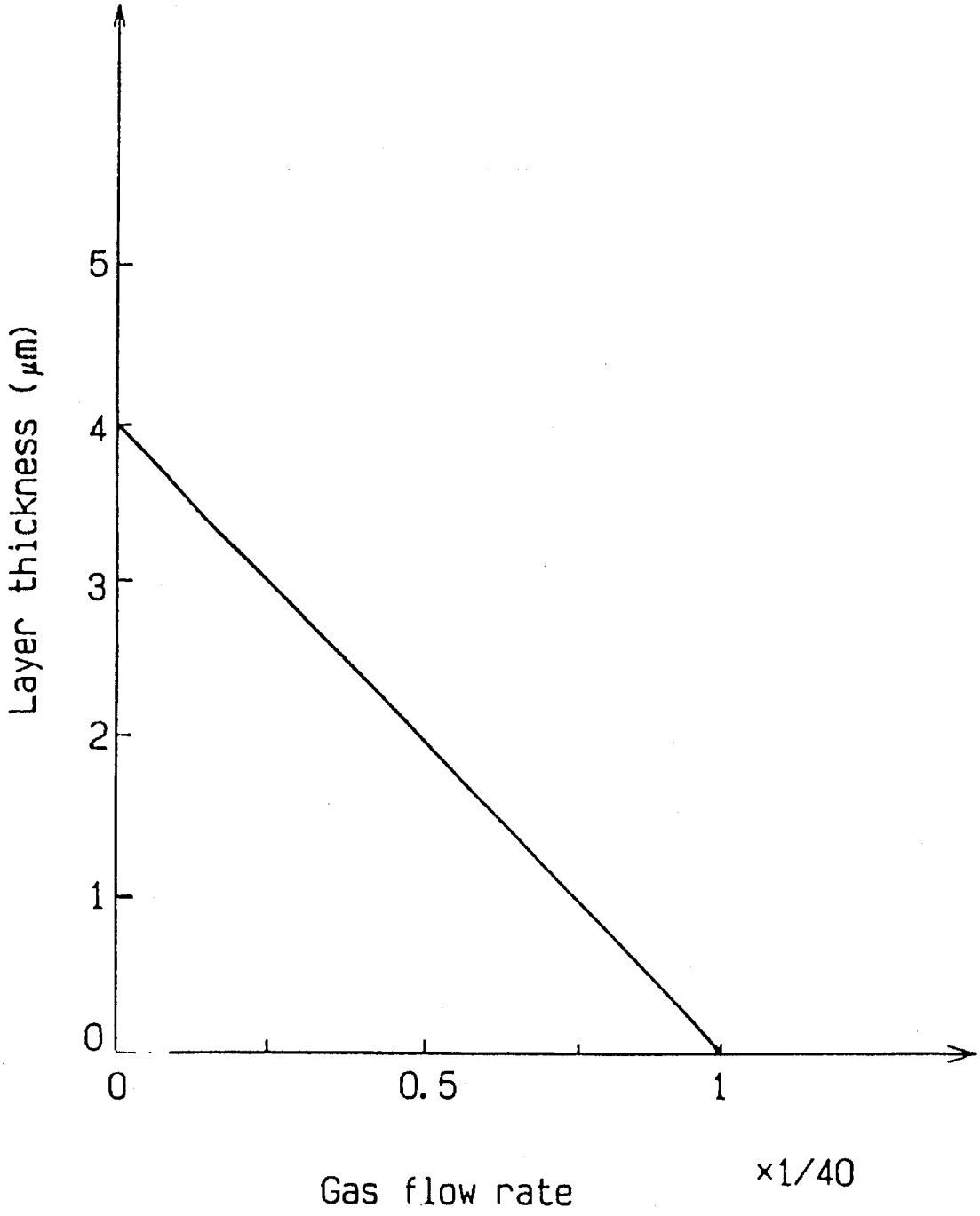
Figure 24:
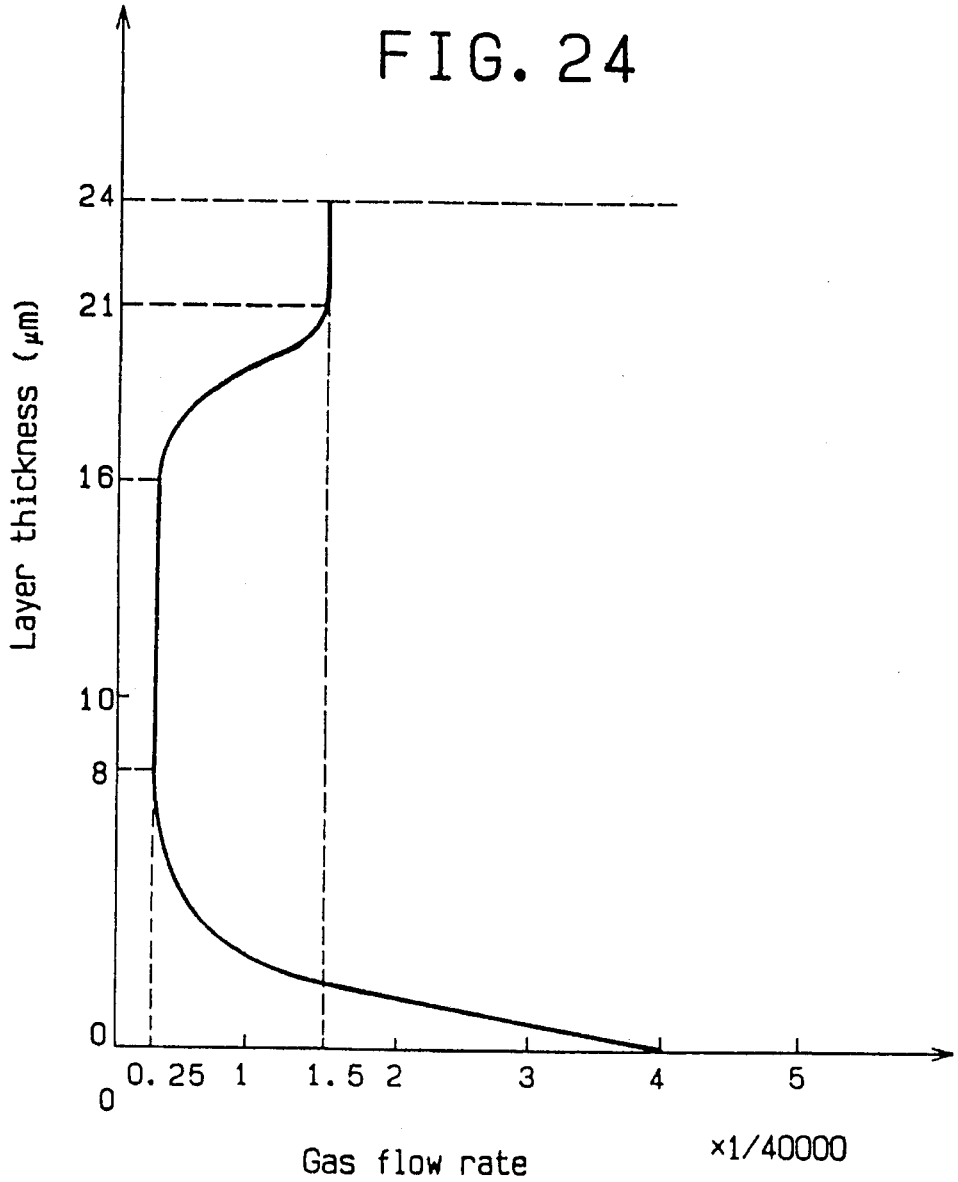
Figure 23:
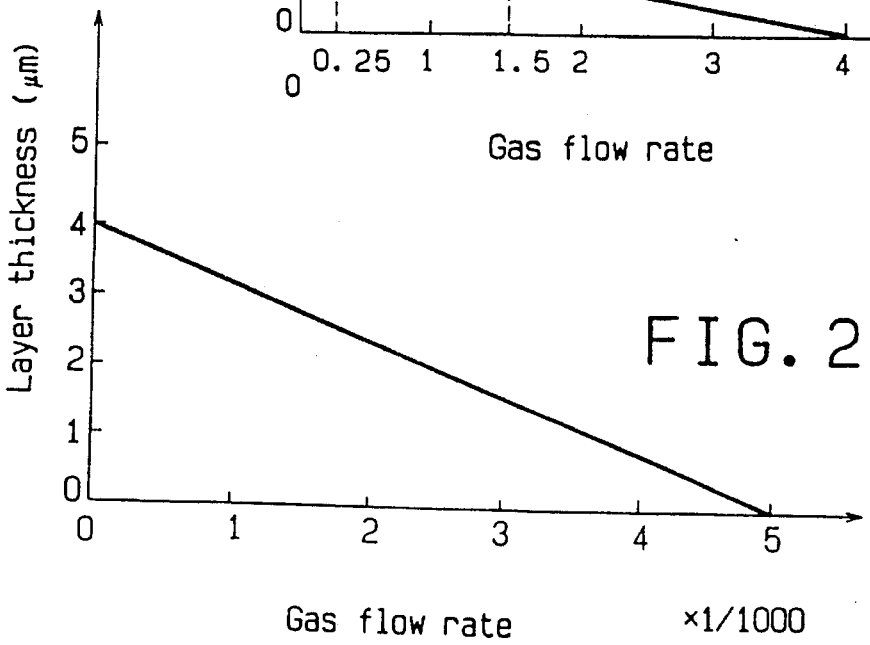

A light receiving layer was formed on a cleaned Al cylinder under the layer forming conditions shown in Table 1 using the fabrication apparatus shown in FIG. 14 to obtain a light receiving member for use in electrophotography. Wherein, the change in the gas flow ratio of $Ge_4/Si_4$ was controlled automatically using a microcomputer in accordance with the flow ratio curve shown in FIG. 15. The resulting light receiving member was set to an electrophotographic copying machine having been modified for experimental purposes, and subjected to copying tests using a test chart provided by Canon Kabushiki Kaisha of Japan under selected image forming conditions. AS the light source, a tungsten lamp was used.

As a result, there were obtained high quality visible images with an improved resolving power.

Examples 2 to 7

In each example, the same procedures as in Example 1 were repeated, except using the layer forming conditions shown in Tables 2 to 7 respectively, to thereby obtain a light receiving member in drum form for use in electrophotography.

In each example, the gas flow ratio for $GeH_4/Si_4$ and the gas flow ratio for $B_2H_{26}/Si_4$ were controlled in accordance with the flow ratio curve shown in the following Table A.

The resulting light receiving members were subjected to the same copying test as in Example 1.

As a result, there were obtained high quality and highly resolved visible images for any of the light receiving members.

TABLE A

| Example No. | Number of the Figure for the gas flow ratio curve for $GeH_4/Si_4$ | Number of the Figure for the flow ratio of $B_2H_6/Si_4$ |
|---|---|---|
| 2 | 16 | — |
| 3 | 17 | — |
| 4 | 17 | — |
| 5 | 15 | 18 |
| 6 | 16 | 19 |
| 7 | 17 | 20 |

Example 8

Light receiving members (Sample Nos. 801 to 807) for use in electrophotography were prepared by the same procedures as in Example 1, except that the layer thickness was changed as shown in Table 8 in the case of forming the second layer in the Table 1.

The resulting light receiving members were respectively evaluated in accordance with the same image forming process as in Example 1.

The results were as shown in Table 8.

Example 9

Light receiving members (Sample Nos. 901 to 907) for use in electrophotography were prepared by the same procedures as in Example 1, except that the value relative to the flow ratio for $C_2H_4/SiH_4$ in the case of forming the second layer in Table 1 was changed as shown in Table 9.

The resulting light receiving members were respectively evaluated in accordance with the same procedures as in Example 1.

As a result, it was confirmed for each of the samples that high quality visible images with clearer half tone could be repeatedly obtained.

And, in the durability test upon repeating use, it was confirmed that nay of the samples has an excellent durability and always brings about high quality visible images equivalent to initial visible images.

Examples 10 to 18

In each example, the same procedures as in Example 1 were repeated, except using the layer forming conditions shown in Tables 10 to 18 respectively, to thereby obtain a light receiving member in drum form for use in electrophotography.

In each example, the gas flow ratio for $GeH_4/Si_4$, the gas flow ratio for $B_2H_6/SiH_4$ and the gas flow ratio for $O_2/SiH_4$ were controlled in accordance with the flow ratio curve shown in the following Table B.

The resulting light receiving members were subjected to the same copying test as in Example 1.

As a result, there were obtained high quality and highly resolved visible images for any of the light receiving members.

TABLE B

| Example No. | Number of the Figure for the gas flow ratio curve for $GeH_4/SiH_4$ | Number of the Figure for the gas flow ratio curve for $B_2H_6/SiH_4$ | Number of the Figure for the gas flow ratio curve for $O_2/SiH_4$ |
|---|---|---|---|
| 10 | 15 | — | — |
| 11 | 16 | — | 22 |
| 12 | 17 | — | 23 |
| 13 | 16 | — | 24 |
| 14 | 16 | — | — |
| 15 | 15 | 18 | — |
| 16 | 17 | 19 | 22 |
| 17 | 17 | — | — |
| 18 | 15 | 20 | 22 |

TABLE C

| Example No. | Number of the Figure for the gas flow ratio curve for $GeH_4/SiH_4$ | Number of the Figure for the gas flow ratio curve for $B_2H_6/SiH_4$ | Number of the Figure for the gas flow ratio curve for $NH_3/SiH_4$ |
|---|---|---|---|
| 21 | 15 | — | — |
| 22 | 16 | — | 22 |
| 23 | 17 | — | 23 |
| 24 | 16 | — | 24 |
| 25 | 16 | — | — |
| 26 | 15 | 18 | — |
| 27 | 17 | 19 | 22 |
| 28 | 17 | 21 | — |
| 29 | 15 | 20 | 22 |
| 30 | 16 | — | — |

Example 19

Light receiving members (Sample Nos. 1901 to 1907) for use in electrophotography were prepared by almost the same procedures as in Example 1, except that the layer thickness was changed as shown in Table 19 in the case of forming the second layer in Table 10.

The resulting light receiving members were respectively evaluated in accordance with the same image forming process as in Example 1.

The results were as shown in Table 10.

Example 20

Light receiving members (Sample Nos. 2001 to 2007) for use in electrophotography were prepared by almost the same procedures as in Example 1, except that the value relative to the flow ratio for $C_2H_4/SiH_4$ in the case of forming the second layer in Table 10 was changed as shown in Table 20.

The resulting light receiving members were respectively evaluated in accordance with the same procedures as in Example 1.

As a result, it was confirmed for each of the samples that high quality visible images with clearer half tone could be repeatedly obtained.

And, in the durability test upon repeating use, it was confirmed that nay of the samples has an excellent durability and always brings about high quality visible images equivalent to initial visible images.

Examples 21 to 30

In each example, the same procedures as in Example 1 were repeated, except using the layer forming conditions shown in Tables 21 to 30 respectively, to thereby obtain a light receiving member in drum form for use in electrophotography.

In each example, the gas flow ratio for $GeH_4/SiH_4$, the gas flow ratio for $B_2H_6/SiH_4$ and the gas flow ratio for $NH_3/SiH_4$ were controlled in accordance with the flow ratio curve shown in the following Table C.

The resulting light receiving members were subjected to the same copying est as in Example 1.

As a result, there were obtained high quality an highly resolved visible images for any of the light receiving members.

Example 31

Light receiving members (Sample Nos. 3101 to 3107) for use in electrophotography were prepared by the same procedures as in Example 1, except that the layer thickness was changed as shown in Table 31 in the case of forming the second layer in Table 21.

The resulting light receiving members were respectively evaluated in accordance with the same image forming process as in Example 1.

The results were as shown in Table 31.

Example 32

Light receiving members (Sample Nos. 3201 to 3207) for use in electrophotography were prepared by the same procedures as in Example 1, except that the value relative to the flow ratio for $C_2H_4/SiH_4$ in the case of forming the second layer in Table 21 was changed as shown in Table 32.

The resulting light receiving members were respectively evaluated in accordance with the same procedures as in Example 1.

As a result, it was confirmed for each of the samples that high quality visible images with clearer half tone could be repeatedly obtained.

And, in the durability test upon repeating use, it was confirmed that any of the samples has an excellent durability and always brings about high quality visible images equivalent to initial visible images.

Examples 33 to 35

In each example, the same procedures as in Example 1 were repeated, except using the layer forming conditions shown in Tables 33 to 35 respectively, to thereby obtain a light receiving member in drum form for use in electrophotography.

Figure 25:
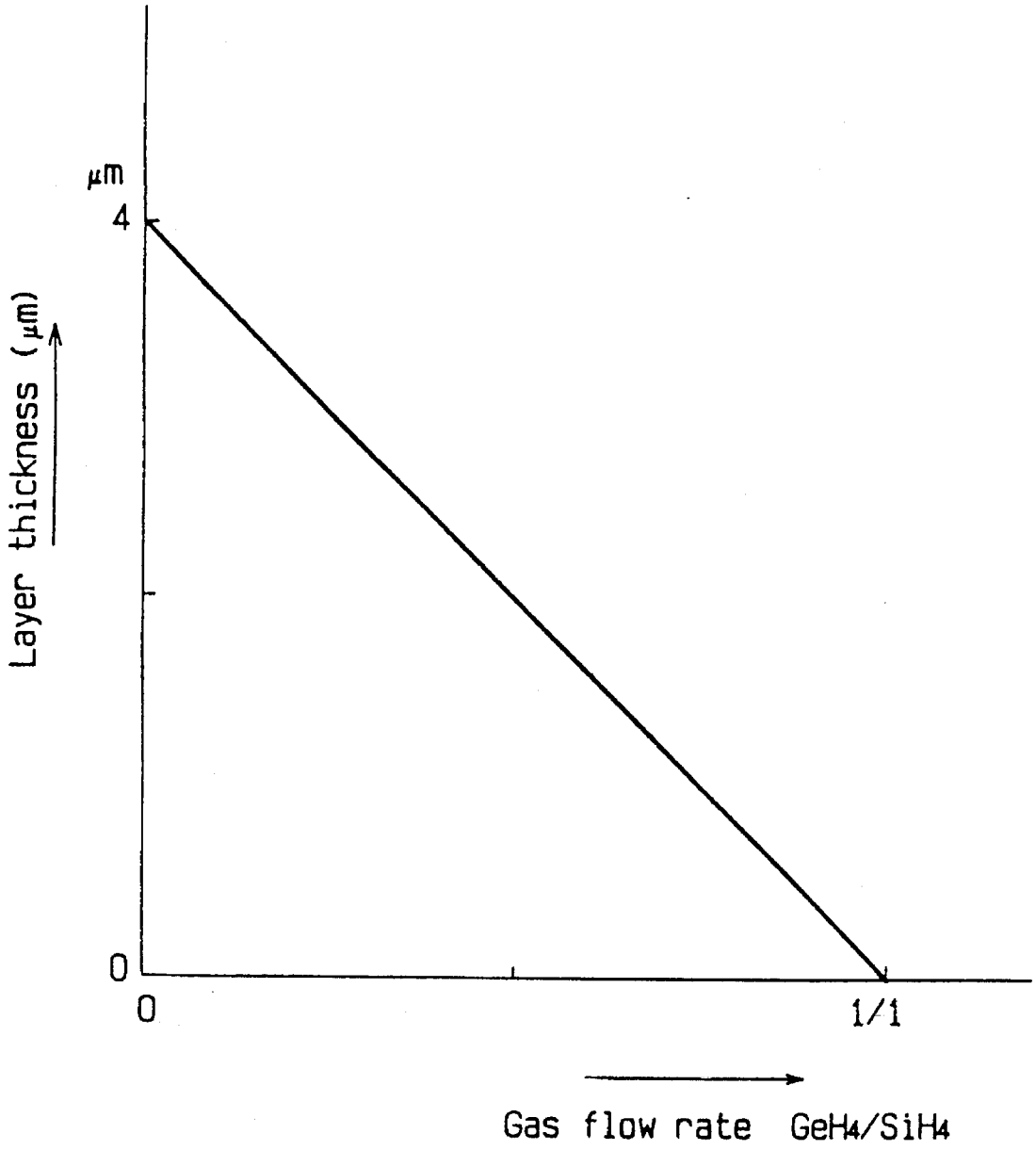
Figure 26:
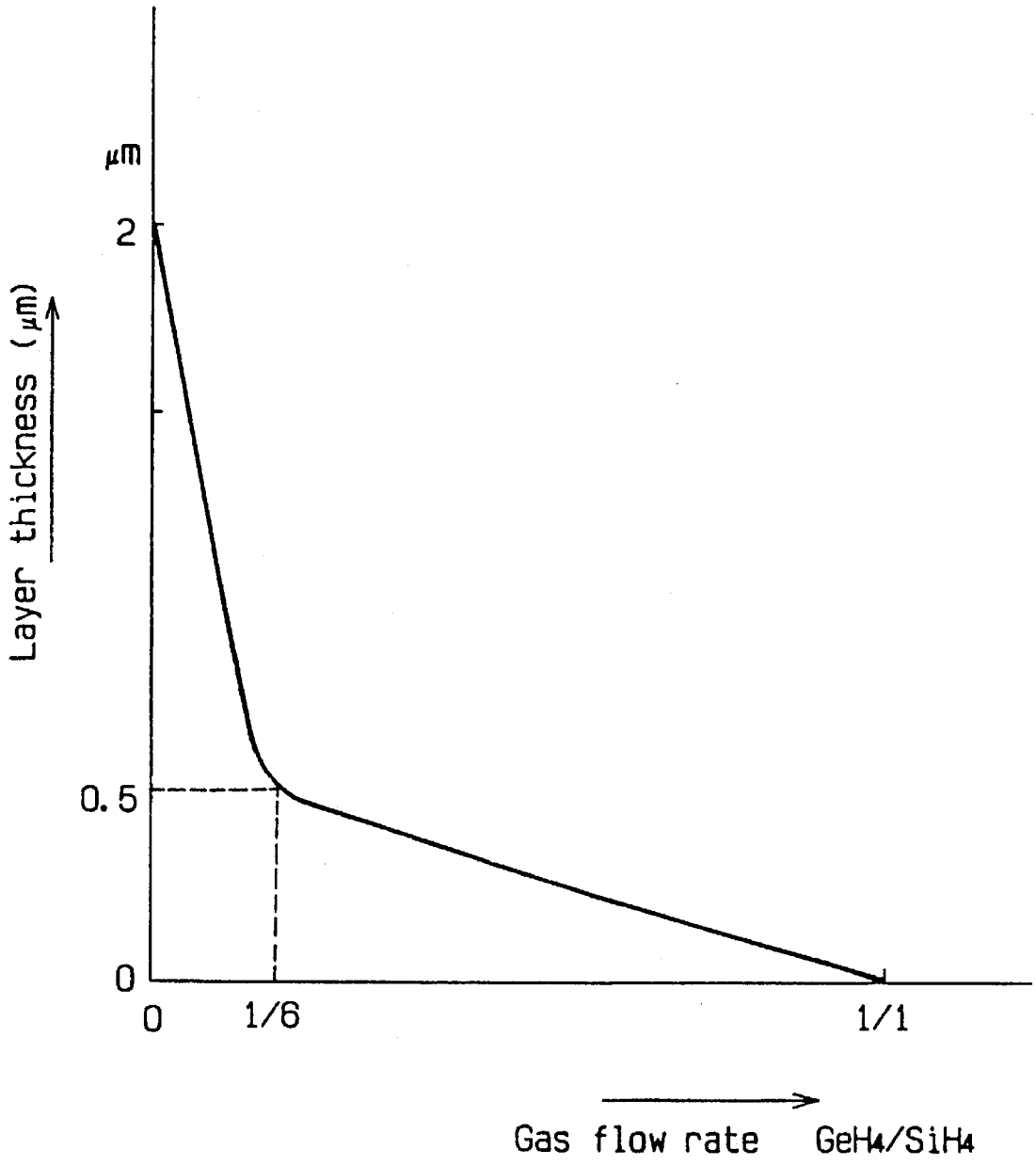
Figure 27:
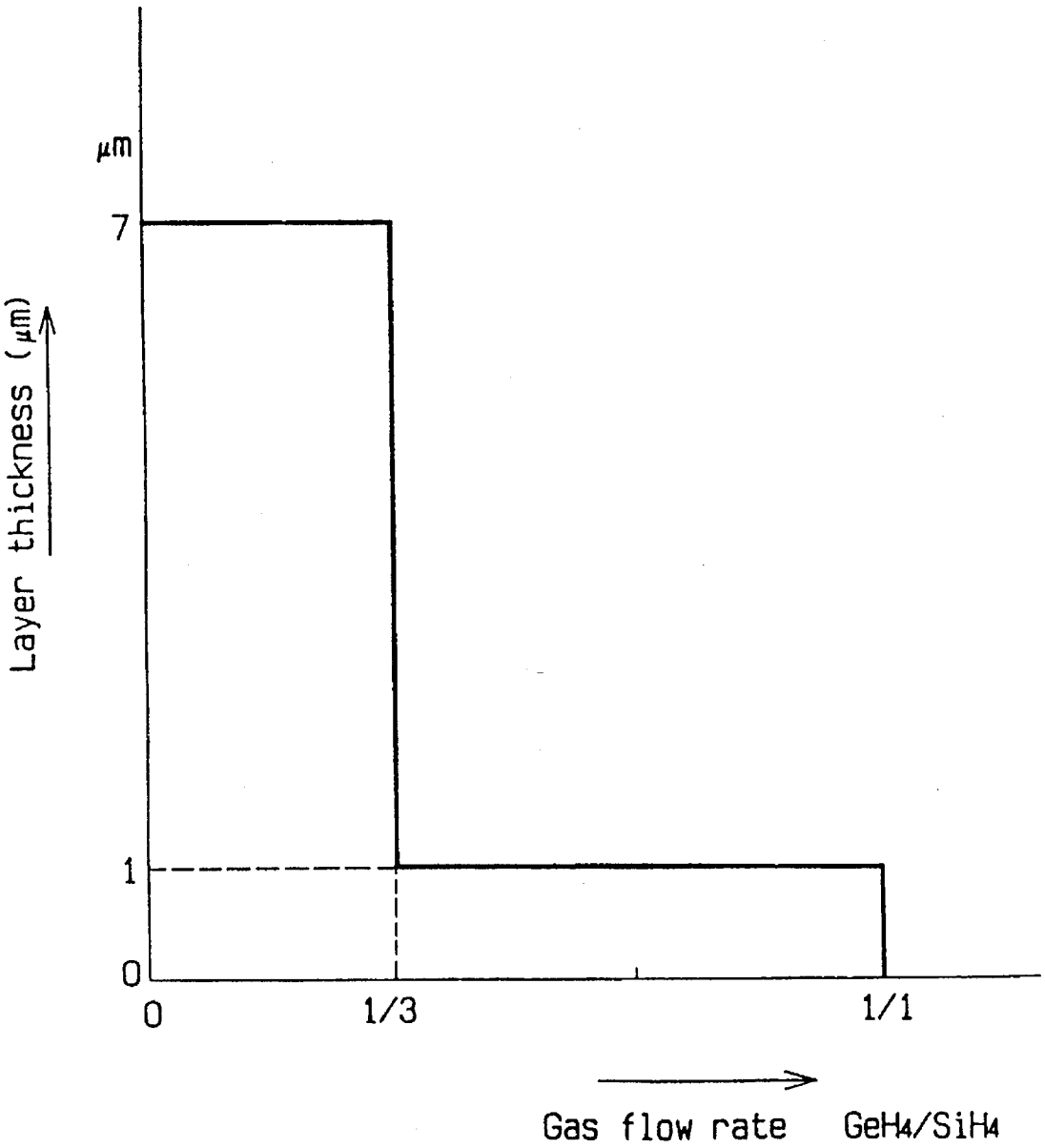

In each example, the gas flow ratio for $GeH_4/SiH_4$ was controlled in accordance with the flow ratio curves shown in FIGS. 25 to 27.

The resulting light receiving members were subjected to the same copying test as in Example 1.

As a result, there were obtained high quality and highly resolved visible images for any of the light receiving members.

Examples 36 to 42

In each example, the same procedures as in Example 1 were repeated, except using the layer forming conditions shown in Tables 36 to 42 respectively, to thereby obtain a light receiving member in drum form for use in electrophotography.

In each example, the gas flow ratio for $GeH_4/SiH_4$ and the gas flow ratio for $B_2H_6/SiH_4$ were controlled in accordance with the flow rate curve shown in the following Table D.

The resulting light receiving members were subjected to the same copying test as in Example 1.

As a result, there were obtained high quality and highly resolved visible images for any of the light receiving members.

TABLE D

| Example No. | Number of the Figure for the gas flow ratio curve for $GeH_4/SiH_4$ | Number of the Figure for the flow ratio curve for $B_2H_4/SiH_4$ |
|---|---|---|
| 36 | 25 | — |
| 37 | 26 | — |
| 38 | 27 | — |
| 39 | 27 | — |
| 40 | 25 | 18 |
| 41 | 25 | 19 |
| 42 | 26 | 20 |

Example 43

Light receiving members (Sample Nos. 4301 to 4307) for use in electrophotography were prepared by the same procedures as in Example 1, except that the layer thickness was changed as shown in Table 43 in the case of forming the second layer in Table 36.

The resulting light receiving member were respectively evaluated in accordance with the same image forming process as in Example 1.

The results were as shown in Table 43.

Example 44

Light receiving members (Sample Nos. 4401 to 4407) for use in electrophotography were prepared by the same procedures as in Example 1, except that the value relative to the flow ratio for $C_2H_4/SiH_4$ in the case of forming the second layer in Table 36 was changed as shown in Table 44.

The resulting light receiving members were respectively evaluated in accordance with the same procedures as in Example 1.

As a result, it was confirmed for each of the samples that high quality visible images with clearer half tone could be repeatedly obtained.

And, in the durability test upon repeating use, it was confirmed that any of the samples has an excellent durability and always brings about high quality visible images equivalent to initial visible images.

Examples 45 to 52

In each example, the same procedures as in Example 1 were repeated, except using the layer forming conditions shown in Tables 45 to 52 respectively, to thereby obtain a light receiving member in drum form for use in electrophotography.

In each example, the gas flow ratio for $GeH_4/SiH_4$, the gas flow ratio for $B_2H_6/SiH_4$ and the gas flow ratio for $O_2/SiH_4$ were controlled in accordance with the flow ratio curve shown in the following Table E.

The resulting light receiving members were subjected to the same copying test as in Example 1.

As a result, there were obtained high quality and highly resolved visible images for any of the light receiving members.

TABLE E

| Example No. | Number of the Figure for the gas flow ratio curve for $GeH_4/SiH_4$ | Number of the Figure for the gas flow ratio curve for $B_2H_6/SiH_4$ | Number of the Figure for the gas flow ratio curve for $O_2/SiH_4$ |
|---|---|---|---|
| 45 | 25 | — | — |
| 46 | 26 | — | 22 |
| 47 | 25 | — | 23 |
| 48 | 27 | — | 24 |
| 49 | 25 | — | — |
| 50 | 25 | 18 | — |
| 51 | 26 | 19 | 22 |
| 52 | 25 | 20 | 22 |

Example 53

Light receiving members (Sample Nos. 5301 to 5307) for use in electrophotography were prepared by the same procedures as in Example 1, except that the layer thickness was changed as shown in Table 53 in the case of forming the second layer in Table 45.

The resulting light receiving members were respectively evaluated in accordance with the same image forming process as in Example 1.

The results were as shown in Table 53.

Example 54

Light receiving members (Sample Nos. 5401 to 5407) for use in electrophotography were prepared by the same procedures as in Example 1, except that the value relative to the flow ratio for $C_2H_4/SiH_4$ in the case of forming the second layer in Table 45 was changed as shown in Table 54.

The resulting light receiving members were respectively evaluated in accordance with the same procedures as in Example 1.

As a result, it was confirmed for each of the samples that high quality visible images with clearer half tone could be repeatedly obtained.

And, in the durability test upon repeating use, it was confirmed that any of the samples has an excellent durability and always brings about high quality visible images equivalent to initial visible images.

Examples 55 to 63

In each example, the same procedures as in Example 1 were repeated, except using the layer forming conditions shown in Tables 55 to 63 respectively, to thereby obtain a light receiving member in drum form for use in electrophotography.

In each example, the gas flow ratio for $GeH_4/SiH_4$, the gas flow ratio for $B_2H_6/SiH_4$ and the gas flow ratio for $NH_3/SiH_4$ were controlled in accordance with the flow ratio curve shown in the following Table F.

The resulting light receiving members were subjected to the same copying test as in Example 1.

As a result, there were obtained high quality and highly resolved visible images for any of the light receiving members.

TABLE F

| Example No. | Number of the Figure for the gas flow ratio curve for $GeH_4/SiH_4$ | Number of the Figure for the gas flow ratio curve for $B_2H_6/SiH_4$ | Number of the Figure for the gas flow ratio curve for $NH_3/SiH_4$ |
|---|---|---|---|
| 55 | 25 | — | — |
| 56 | 26 | — | 22 |
| 57 | 25 | — | 23 |
| 58 | 27 | — | 24 |
| 59 | 25 | — | — |
| 60 | 25 | 18 | — |
| 61 | 26 | 19 | 22 |
| 62 | 25 | 20 | 22 |
| 63 | 26 | — | — |

Example 64

Light receiving members (Sample Nos. 6401 to 6407) for us in electrophotography were prepared by the same procedures as in Example 1, except that the layer thickness was changed as shown in Table 64 in the case of forming the second layer in Table 55.

The resulting light receiving members were respectively evaluated in accordance with the same image forming process as in Example 1.

The results were as shown in Table 64.

Example 65

Light receiving members (Sample Nos. 6501 to 6507) for use in electrophotography were prepared by he same procedures as in Example 1, except that the value relative to the flow ratio for $C_2H_4/SiH_4$ in the case of forming the second layer in Table 55 was changed as shown in Table 65.

The resulting light receiving members were respectively evaluated in accordance with the same procedures as in Example 1.

As a result, it was confirmed for each of the samples that high quality visible images with clearer half tone could be repeatedly obtained.

And, in the durability test upon repeating use, it was confirmed that nay of the samples has an excellent durability and always brings about high quality visible images equivalent to initial visible images.

The resulting light receiving members were respectively evaluated in accordance with the same procedures as in Example 1.

As a result, it was confirmed for each of the samples that high quality visible images with clearer half tone could be repeatedly obtained.

And, in the durability test upon repeating use, it was confirmed that nay of the samples has an excellent durability and always brings about high quality visible images equivalent to initial visible images.

TABLE 1

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$B_2H_6/He = 1/100$<br>$GeH_4/He = 1$ | $SiH_4 = 200$ | $B_2H_6/SiH_4 = 5/1000$<br>$GeH_4/SiH_4 = 1 \rightarrow 1/2$ | 0.19 | 8.5 | 4 |
| | Second step | $SiH_4/He = 1$<br>$GeH_4/He = 1$ | $SiH_4 = 200$ | $GeH_4/SiH_4$-$1/2 \rightarrow 0$ | 0.19 | 17 | 14 |
| Second layer | Third step | $SiH_4/He = 0.5$<br>$C_2H_4$<br>$PH_3/He = 1/100$ | $SiH_4 = 200$ | $C_2H_4/SiH_4 = 3/10$<br>$PH_3/(SiH_4 + C_2H_4) = 1/3000$ | 0.16 | 5 | 1 |

TABLE 2

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$B_2H_6/He = 1/100$<br>$GeH_4/He = 1$ | $SiH_4 = 200$ | $B_2H_6/SiH_4 = 5/1000$<br>$GeH_4/SiH_4 = 1 \rightarrow 1/6$ | 0.19 | 8.5 | 4 |
| | Second step | $SiH_4/He = 1$<br>$GeH_4/He = 1$ | $SiH_4 = 200$ | $GeH_4/SiH_4$-$1/6 \rightarrow 0$ | 0.19 | 17 | 16 |
| Second layer | Third step | $SiH_4/He = 0.5$<br>$C_2H_4$<br>$PH_3/He = 1/100$ | $SiH_4 = 200$ | $C_2H_4/SiH_4 = 3/10$<br>$PH_3/(SiH_4 + (C_2H_4) = 1/3000$ | 0.16 | 5 | 1.5 |

TABLE 3

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$B_2H_6/He = 1/100$<br>$GeH_4/He = 1$ | $SiH_4 = 200$ | $B_2H_6/SiH_4 = 5/1000$<br>$GeH_4/SiH_4 = 1$ | 0.19 | 8.5 | 1 |
| | Second step | $SiH_4/He = 1$<br>$GeH_4/He = 1/100$<br>$GeH_4/He = 1$ | $SiH_4 = 200$ | $B_2H_6/SiH_4$<br>$GeH_4/SiH_4 = 1/100$ | 0.19 | 8.5 | 19 |
| Second layer | Third step | $SiH_4/He = 0.5$<br>$C_2H_4$<br>$PH_3/He = 1/100$ | $SiH_4 = 200$ | $C_2H_4/SiH_4 = 3/10$<br>$B_2H_6/(SiH_4 + C_2H_4) = 1/3000$ | 0.16 | 5 | 1.5 |

TABLE 4

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| | First step | $SiH_4/He = 1$<br>$GeH_4/He = 1$ | $SiH_4 = 200$ | $GeH_4/SiH_4 = 1$ | 0.19 | 8.5 | 1 |
| First layer | Second step | $SiH_4/He = 1$<br>$GeH_4/He = 1$ | $SiH_4 = 200$ | $GeH_4/SiH_4 = 1/100$ | 0.20 | 18 | 18 |
| | Third step | $SiH_4/He = 1$<br>$B_2H_6/He = 1/100$<br>$GeH_4/He = 1$ | $SiH_4 = 200$ | $GeH_4/SiH_4 = 1/100$<br>$B_2H_6/SiH_4 = 1/10000$ | 0.16 | 12 | 1 |
| Second layer | Fourth step | $SiH_4/He = 0.5$<br>$C_2H_4$<br>$B_2H_6He = 1/100$ | $SiH_4 = 200$ | $C_2H_4/SiH_4 = 3/10$<br>$B_2H_6/(SiH_4 + C_2H_4) = 1/10000$ | 0.16 | 5 | 1 |

TABLE 5

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$B_2H_6He = 1/100$<br>$GeH_4/He = 1$ | $SiH_4 = 200$ | $B_2H_6/SiH_4 = 5/1000 \rightarrow 0$<br>$GeH_4SiH_4 = 1 \rightarrow 1/2$ | 0.19 | 8.5 | 4 |
| | Second step | $SiH_4/He = 1$<br>$GeH_4/He = 1$ | $SiH_4 = 200$ | $GeH_4SiH_4 = 1/2 \rightarrow 0$ | 0.19 | 17 | 14 |
| Second layer | Third step | $SiH_4/He = 0.5$<br>$C_2H_4$<br>$PH_3/He = 1/100$ | $SiH_4 = 200$ | $C_2H_4/SiH_4 = 3/10$<br>$PH_3/(SiH_4 + C_2H_4) = 1/30000$ | 0.16 | 5 | 1 |

TABLE 6

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4He = 1$<br>$B_2H_6/He = 1/100$<br>$GeH_4/He = 1$ | $SiH_4 = 200$ | $B_2H_6/SiH_4 = 5/1000 \rightarrow 0$<br>$GeH_4/SiH_4 = 1 \rightarrow 1/6 \rightarrow (A)$ | 0.19 | 8.5 | 16 |
| | Second step | $SiH_4/He = 1$<br>$GeH_4/He = 1$ | $SiH_4 = 200$ | $GeH_4/SiH_4 = (A) \rightarrow 0$ | 0.19 | 17 | 4 |
| Second layer | Third step | $SiH_4/He = 0.5$<br>$C_2H_4$<br>$PH_3/He = 1/100$ | $SiH_4 = 200$ | $C_2H_4/SiH_4 = 3/10$<br>$PH_3/(SiH_4 + C_2H_4) = 1/30000$ | 0.16 | 5 | 1.5 |

TABLE 7

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| | First step | $SiH_4$/He = 1<br>$B_2H_6$He = 1/100<br>$GeH_4$/He = 1 | $SiH_4$ = 200 | $GeH_4/SiH_4$ = 1 | 0.18 | 8.5 | 3 |
| First layer | Second step | $SiH_4$/He = 1<br>$GeH_4$/He = 1 | $SiH_4$ = 200 | $GeH_4/SiH_4$ = 1/100 | 0.19 | 17 | 15 |
| | Third step | $SiH_4$/He = 1<br>$B_2H_6$/He = 1/100<br>$GeH_4$/He = 1 | $SiH_4$ = 200 | $GeH_4/SiH_4$ = 1/100<br>$B_2H_6/SiH_4$ = 1/10000 | 0.18 | 16 | 2 |
| Second layer | Fourth step | $SiH_4$/He = 0.5<br>$C_2H_4$<br>$B_2H_6$/He = 1/100 | $SiH_4$ = 200 | $C_2H_4/SiH_4$ = 3/10<br>$B_2H_6/(SiH_4 + C_2H_4)$ = 1/40000 | 0.16 | 5 | 1 |

TABLE 8

| Sample No. | 801 | 802 | 803 | 804 | 805 | 806 | 807 |
|---|---|---|---|---|---|---|---|
| Thickness of the second layer (μ) | 1.1 | 0.5 | 1.5 | 2 | 3 | 4 | 5 |
| Evaluation | Δ | ○ | ⊙ | ⊙ | ○ | ○ | Δ |

⊙: Excellent
○: Good
Δ: Applicable for practical use

TABLE 9

| Sample No. | 901 | 902 | 903 | 904 | 905 | 906 | 907 |
|---|---|---|---|---|---|---|---|
| $C_2H_4/SiH_4$ Flow ratio | 1/10 | 2/10 | 4/10 | 5/10 | 10/10 | 2/1 | 3/1 |
| Evaluation | Δ | ○ | ⊙ | ⊙ | ○ | ○ | Δ |

⊙: Excellent
○: Good
Δ: Applicable for practical use

TABLE 10

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4$He = 1<br>$GeH_4$/He = 1<br>$B_2H_6$He = 1/100<br>$O_2$/He = 0.5 | $SiH_4$ = 200 | $GeH_4/SiH_4$ = 1/1 → 1/2<br>$B_2H_6/SiH_4$-5/1000<br>$O_2/SiH_4$ = 1/40 | 0.18 | 8 | 4 |
| | Second step | $SiH_4$/He = 1<br>$GeH_4$/He = 1 | $SiH_4$ = 200 | $GeH_4/SiH_4$ = 1/2 → 0 | 0.26 | 18 | 14 |
| Second layer | Third step | $SiH_4$/He = 0.5<br>$C_2H_4$<br>$PH_3$/He-1/100 | $SiH_4$ = 200 | $C_2H_4/SiH_4$ = 3/10<br>$PH_3/(C_2H_4 + SiH_4)$ = 1/30000 | 0.16 | 5 | 0.5 |

TABLE 11

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4$/He = 1<br>$GeH_4$/He = 1<br>$B_2H_6$/He = 1/100<br>$O_2$/He = 0.5 | $SiH_4$ = 200 | $GeH_4/SiH_4$ = 1/2 → 1/6<br>$B_2H_6/SiH_4$-1/10000<br>$O_2/SiH_4$ = 1/40 | 0.18 | 8 | 4 |
| | Second step | $SiH_4$/He = 1<br>$GeH_4$/He = 1<br>$B_2H_6$/He-1/100 | $SiH_4$ = 200 | $GeH_4/SiH_4$ = 1/6 → 0<br>$B_2H_6/SiH_4$ = 1/100000 | 0.20 | 18 | 16 |

TABLE 11-continued

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| Second layer | Third step | $SiH_4$/He = 0.5<br>$C_2H_4$<br>$PH_3$/He-1/100 | $SiH_4$ = 200 | $C_2H_4/SiH_4$ = 3/10<br>$PH_3/(C_2H_4 + SiH_4)$ = 1/30000 | 0.16 | 5 | 0.5 |

10

TABLE 12

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| | First step | $SiH_4$/He = 1<br>$GeH_4$/He = 1 | $SiH_4$ = 200 | $GeH_4/SiH_4$ = 1/1<br>$O_2/SiH_4$ = 5/1000 → 3.75/1000 | 0.18 | 8 | 1 |
| First layer | Second step | $O_2$He-0.5 | $SiH_4$ = 200 | $GeH_4/SiH_4$ = 1/100<br>$O_2/SiH_4$ = 1/1000 → 0 | | | 3 |
| | Third step | $SiH_4$/He = 1<br>$GeH_4$/He = 1 | $SiH_4$ = 200 | $GeH_4/SiH_4$ = 1/100 | 0.20 | 18 | 15 |
| Second layer | Fourth step | $SiH_4$/He = 1<br>$GeH_4$/He = 1<br>$B_2H_6$/He = 1/100 | $SiH_4$ = 200 | $C_2H_4/SiH_4$ = 1/100<br>$B_2H_6/(SiH_4$ = 1/10000 | 0.14 | 12 | 1 |
| Second layer | Fifth step | $SiH_4$/He = 0.5<br>$C_2H_4$<br>$B_2H_6$/He-1/100 | $SiH_4$ = 200 | $C_2H_4/SIH_4$ = 3/10<br>$B_2H_6/(SiH_4 + C_2H_4)$ = 1/10000 | 0.16 | 5 | 0.5 |

TABLE 13

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4$/He = 1<br>$GeH_4$/He = 1<br>$B_2H_6$/He = 1/100<br>$O_2$/He = 0.5 | $SiH_4$ = 200 | $GeH_4/SiH_4$ = 1/2 → 1/6 → 3/24<br>$B_2H_6$/He = 1/1000<br>$O_2/SiH_4$ = 4/40000 → 0.25/40000 | 0.16 | 7 | 8 |
| | Second step | $SiH_4$/He = 1<br>$GeH_4$/He = 1<br>$O_2$He = 0.5 | $SiH_4$ = 200 | $GeH_4$/He = 3/24 → 0<br>$O_2/SiH_4$= 0.25/40000 → 1.5/40000 | 0.18 | 8 | 16 |
| Second layer | Third step | $SiH_4$/He = 0.5<br>$C_2H_4$<br>$B_2H_6$/He = 1/100 | $SiH_4$ = 200 | $C_2H_4/SiH_4$ = 3/10<br>$B_2H_6/(SiH_4 + C_2H_4)$ = 1.5/40000 = 1/30000 | 0.16 | 5 | 0.5 |

TABLE 14

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4$/He = 1<br>$GeH_4$/He = 1<br>$B_2H_6$/He = 1/100<br>$O_2$/He = 0.5 | $SiH_4$ = 200 | $B_2H_6/SiH_4$ = 5/1000<br>$GeH_4/SiH_4$ = 1/2 → 1/6<br>$O_2/SiH_4$ = 1/40 | 0.18 | 8 | 4 |
| | Second step | $SiH_4$/He = 1<br>$GeH_4$/He = 1<br>$O_2$/He = 0.5 | $SiH_4$= 200 | $GeH_4/SiH_4$ = 1/6 → 0<br>$O_2/SiH_4$ = 1/400 | 0.20 | 11 | 16 |
| Second layer | Third step | $SiH_4$/He = 0.5<br>$C_2H_4$<br>$PH_3$/He = 1/100<br>$O_2$/He = 0.5 | $SiH_4$ = 200 | $C_2H_4/SiH_4$ = 3/10<br>$PH_3/(SiH_4 + C_2H_4)$ = 1/30000<br>$O_2/SiH_4$ = 1/400 | 0.16 | 4 | 0.5 |

TABLE 15

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4$/He = 1<br>$GeH_4$/He = 1<br>$B_2H_6$/He = 1/100<br>$O_2$/He = 0.5 | $SiH_4$ = 200 | $GeH_4/SiH_4$ = 1/1 → 1/2<br>$B_2H_6/SiH_4$ = 5/1000 → 0<br>$O_2/SiH_4$ = 1/40 | 0.18 | 8 | 4 |
| | Second step | $SiH_4$/He = 1<br>$GeH_4$/He = 1<br>$O_2$/He = 0.5 | $SiH_4$ = 200 | $GeH_4/SiH_4$ = 1/2 → 0 | 0.20 | 11 | 16 |
| Second layer | Third step | $SiH_4$/He = 0.5<br>$C_2H_4$<br>$PH_3$/He = 1/100<br>$O_2$/He = 0.5 | $SiH_4$ = 200 | $(O_2 + C_2H_4)/SiH_4$ = 3/10<br>$PH_3/(SiH_4 + C_2H_4 + O_2)$ = 1/30000 | 0.17 | 5 | 0.5 |

TABLE 16

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4$/He = 1<br>$GeH_4$/He = 1<br>$B_2H_6$/He = 1/100<br>$O_2$/He = 0.5 | $SiH_4$ = 200 | $GeH_4/SiH_4$ = 1/1 → 1/2<br>$B_2H_6/SiH_4$ = 5/1000 → 0<br>$O_2/SiH_4$ = 1/40 | 0.18 | 8 | 4 |
| | Second step | $SiH_4$/He = 1<br>$GeH_4$/He = 1<br>$B_2H_6$/He = 1/100 | $SiH_4$ = 200 | $GeH_4/SiH_4$ = 1/2 → 0 | 0.20 | 18 | 16 |
| Second layer | Third step | $SiH_4$/He = 0.5<br>$C_2H_4$<br>$PH_3$/He = 1/100<br>$O_2$/He = 0.5 | $SiH_4$ = 200 | $C_2H_4/SiH_4$ = 3/10<br>$PH_3/(SiH_4 + C_2H_4$ = 1/30000 | 0.16 | 5 | 0.5 |

TABLE 17

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4$/He = 1<br>$GeH_4$/He = 1 | $SiH_4$ = 200 | $GeH_4/SiH_4$ = 1/1<br>$O_2/SiH_4$ — 1/50 | 0.18 | 8 | 1 |
| | Second step | $O_2$/He — 0.5 | $SiH_4$ = 200 | $GeH_4/SiH_4$ = 1/100<br>$O_2/SiH_4$ = 1/50 | | | 1 |
| | Third step | $SiH_4$/He = 1<br>$GeH_4$/He = 1 | $SiH_4$ = 200 | $GeH_4/SiH_4$ = 1/100 | 0.20 | 18 | 15 |
| | Fourth step | $SiH_4$/He = 1<br>$GeH_4$/He = 1<br>$B_2H_6$/He = 1/100 | $SiH_4$ = 200 | $B_2H_6/SiH_4$ = 0 → 1/10000<br>$C_2H_4/SiH_4$ = 1/100 | 0.14 | 12 | 1 |
| Second | Fifth | $SiH_4$/He = 0.5 | $SiH_4$ = 200 | $C_2H_4/SIH_4$ = 3/10 | 0.16 | 5 | 1 |

TABLE 17-continued

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| layer | step | $C_2H_4$<br>$B_2H_6$/He — 1/100 | | $B_2H_6/(SiH_4 + C_2H_4)$<br>= 1/10000 | | | |

TABLE 18

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| First layer | First step | $SiH_4$/He = 1<br>$GeH_4$/He = 1<br>$B_2H_6$/He = 1/100<br>$O_2$/He = 0.5 | $SiH_4$ = 200 | $GeH_4/SiH_4$ = 1/2 → 1/6<br>$B_2H_6/SiH_4$ = 4/4000 → 0<br>$O_2/SiH_4$ = 1/40 → 0 | 0.18 | 8 | 4 |
| | Second step | $SiH_4$/He = 1<br>$GeH_4$/He = 1<br>$B_2H_6$/He — 1/100 | $SiH_4$ = 200 | $GeH_4/SiH_4$ = 1/6 → 0<br>$B_2H_6/SiH_4$ = 0 | 0.26 | 0.18 | 16 |
| Second layer | Third step | $SiH_4$/He = 0.5<br>$C_2H_4$<br>$B_2H_6$/He — 1/100 | $SiH_4$ = 200 | $C_2H_4/SiH_4$ = 3/10<br>$B_2H6/(SiH_4 + C_2H_4)$<br>= 1/30000 | 0.16 | 5 | 0.5 |

TABLE 19

| Sample No. | 1901 | 1902 | 1903 | 1904 | 1905 | 1906 | 1907 |
|---|---|---|---|---|---|---|---|
| Thickness of the second layer (μ) | 0.1 | 0.5 | 1.5 | 2 | 3 | 4 | 5 |
| Evaluation | Δ | ○ | ⊙ | ⊙ | ○ | ○ | Δ |

⊙: Excellent
○: Good
Δ: Applicable for practical use

TABLE 20

| Sample No. | 2001 | 2002 | 2003 | 2004 | 2005 | 2006 | 2007 |
|---|---|---|---|---|---|---|---|
| $C_2H_4/SiH_4$ Flow ratio | 1/10 | 2/10 | 4/10 | 5/10 | 10/10 | 2/1 | 3/1 |
| Evaluation | Δ | ○ | ⊙ | ⊙ | ○ | ○ | Δ |

⊙: Excellent
○: Good
Δ: Applicable for practical use

TABLE 21

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| First layer | First step | $SiH_4$/He = 1<br>$GeH_4$/He = 1<br>$B_2H_6$/He = 1/100<br>$NH_3$/He = 0.5 | $SiH_4$ = 200 | $GeH_4/SiH_4$ = 1/1 → 1/2<br>$B_2H_6/SiH_4$ — 5/1000<br>$NH_3/SiH_4$ = 1/40 | 0.18 | 8 | 4 |
| | Second step | $SiH_4$/He = 1<br>$GeH_4$/He = 1 | $SiH_4$ = 200 | $GeH_4/SiH_4$ = 1/2 → 0 | 0.20 | 18 | 14 |
| Second layer | Third step | $SiH_4$/He = 0.5<br>$C_2H_4$<br>$PH_3$/He — 1/100 | $SiH_4$ = 200 | $C_2H_4/SiH_4$ = 3/10<br>$PH_3/(C_2H_4 + SiH_4)$<br>= 1/30000 | 0.16 | 5 | 0.5 |

TABLE 22

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4$/He = 1<br>$GeH_4$/He = 1<br>$B_2H_6$/He = 1/100<br>$O_2$/He = 0.5 | $SiH_4$ = 200 | $GeH_4/SiH_4$ = 1/2 → 1/2<br>$B_2H_6/SiH_4$ — 1/10000<br>$NH_3/SiH_4$ = 1/40 | 0.18 | 8 | 4 |
| | Second step | $SiH_4$/He = 1<br>$GeH_4$/He = 1<br>$B_2H_6$/He — 1/100 | $SiH_4$ = 200 | $GeH_4/SiH_4$ = 1/6 → 0<br>$B_2H_6/SiH_4$ = 1/100000 | 0.20 | 18 | 16 |
| Second layer | Third step | $SiH_4$/He = 0.5<br>$C_2H_4$<br>$PH_3$/He — 1/100 | $SiH_4$ = 200 | $C_2H_4/SiH_4$ = 3/10<br>$PH_3/(SiH_4 + C_2H_4)$<br>= 1/30000 | 0.16 | 5 | 0.5 |

TABLE 23

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4$/He = 1<br>$GeH_4$/He = 1<br>$O_2$/He — 0.5 | $SiH_4$ = 200 | $GeH_4/SiH_4$ = 1/1<br>$NH_3/SiH_4$ = 5/1000<br>→ 3.75/1000 | 0.18 | 8 | 1 |
| | Second step | | | $GeH_4/SiH_4$ = 1/100<br>$NH_3/SiH_4$ → 3.75/1000 → 0 | | | 3 |
| | Third step | $SiH_4$/He = 1<br>$GeH_4$/He = 1 | $SiH_4$ = 200 | $GeH_4/SiH_4$ = 1/100 | 0.20 | 18 | 15 |
| | Fourth step | $SiH_4$/He = 1<br>$GeH_4$/He = 1<br>$B_2H_6$/He = 1/100 | $SiH_4$ = 200 | $GeH_4/SiH_4$ = 1/100<br>$B_2H_6/SiH_4$ = 1/10000 | 0.14 | 12 | 1 |
| Second layer | Fifth step | $SiH_4$/He = 0.5<br>$C_2H_4$<br>$B_2H_6$/He — 1/100 | $SiH_4$ = 200 | $C_2H_4/SIH_4$ = 3/10<br>$B_2H_6/(SiH_4 + C_2H_4)$<br>= 1/10000 | 0.16 | 5 | 0.5 |

35

TABLE 24

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4$/He = 1<br>$GeH_4$/He = 1<br>$B_2H_6$/He = 1/100<br>$O_2$/He = 0.5 | $SiH_4$ = 200 | $GeH_4$/He = 1<br>→ 1/6 → 3/24<br>$B_2H_6$/He = 1/1000<br>$NH_3/SiH_4$ = 4/40000<br>→ 0.25/40000 | 0.16 | 7 | 8 |
| | Second step | $SiH_4$/He = 1<br>$GeH_4$/He = 1<br>$NH_3$/He = 0.5 | $SiH_4$ = 200 | $GeH_4$/He = 3/24 → 0<br>$NH_3/SiH_4$ = 0.25/400000<br>→ 1.5/40000 | 0.18 | 8 | 16 |
| Second layer | Third step | $SiH_4$/He = 0.5<br>$C_2H_4$<br>$B_2H_6$/He = 1/100 | $SiH_4$ = 200 | $C_2H_4/SiH_4$ = 3/10<br>$B_2H_6/(SiH_4 + C_2H_4)$<br>= 1.5/40000<br>= 1/30000 | 0.16 | 5 | 0.5 |

TABLE 25

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4$/He = 1<br>$GeH_4$/He = 1<br>$B_2H_6$/He = 1/100<br>$NH_3$/He = 0.5 | $SiH_4$ = 200 | $B_2H_6/SiH_4$ = 5/1000<br>$GeH_4/SiH_4$ = 1/2 → 1/6<br>$NH_3/SiH_4$ = 1/40 | 0.18 | 8 | 4 |
| | Second | $SiH_4$/He = 1 | $SiH_4$ = 200 | $GeH_4/SiH_4$ = 1/6 → 0 | 0.20 | 11 | 16 |

TABLE 25-continued

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| | step | $GeH_4$/He = 1<br>$NH_3$/He = 0.5 | | $NH_3/SiH_4$ = 1/400 | | | |
| Second layer | Third step | $SiH_4$/He = 0.5<br>$C_2H_4$<br>$PH_3$/He = 1/100<br>$NH_3$/He = 0.5 | $SiH_4$ = 200 | $C_2H_4/SiH_4$ = 3/10<br>$PH_3/SiH_4 + C_2H_4)$<br>= 1/30000<br>$NH_3/SiH_4$ = 1/400 | 0.16 | 4 | 0.5 |

TABLE 26

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| First layer | First step | $SiH_4$/He = 1<br>$GeH_4$/He = 1<br>$B_2H_6$/He = 1/100<br>$NH_3$/He = 0.5 | $SiH_4$ = 200 | $GeH_4/SiH_4$ = 1/1 → 1/2<br>$B_2H_6/SiH_4$ = 5/1000 → 0<br>$NH_3/SiH_4$ = 1/40 | 0.18 | 8 | 4 |
| | Second step | $SiH_4$/He = 1<br>$GeH_4$/He = 1 | $SiH_4$ = 200 | $GeH_4/SiH_4$ = 1/2 → 0 | 0.20 | 11 | 16 |
| Second layer | Third step | $SiH_4$/He = 0.5<br>$C_2H_4$<br>$PH_3$/He = 1/100<br>$NH_3$/He = 0.5 | $SiH_4$ = 200 | $(NH_3 + C_2H_4)/SiH_4$<br>= 3/10<br>$PH_3/(SiH_4 + C_2H_4)$<br>$NH_3)$ = 1/30000 | 0.17 | 5 | 0.5 |

TABLE 27

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| First layer | First step | $SiH_4$/He = 1<br>$GeH_4$/He = 1<br>$B_2H_6$/He = 1/100<br>$NH_3$/He = 0.5 | $SiH_4$ = 200 | $GeH_4/SiH_4$ = 1/1 → 1/00<br>$B_2H_6/SiH_4$ = 5/1000<br>→ 3.75/1000<br>$NH_3/SiH_4$ = 1/40 → 0 | 0.18 | 8 | 4 |
| | Second step | $SiH_4$/He = 1<br>$GeH_4$/He = 1<br>$B_2H_6$/He = 1/100 | $SiH_4$ = 200 | $GeH_4/SiH_4$ = 1/100<br>$B_2H_6/SiH_4$ = 3.75/1000<br>→ 0 | 0.20 | 18 | 16 |
| Second layer | Third step | $SiH_4$/He = 0.5<br>$C_2H_4$<br>$PH_3$/He = 1/100<br>$O_2$/HE = 0.5 | $SiH_4$ = 200 | $C_2H_4/SiH_4$ = 3/10<br>$PH_3/(SiH_4 + C_2H_4)$<br>= 1/30000 | 0.16 | 5 | 0.5 |

TABLE 28

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeH_4/He = 1$ | $SiH_4 = 200$ | $GeH_4/SiH_4 = 1/1$<br>$NH_3/SiH_4$ — 1/50 | 0.18 | 8 | 1 |
| | Second step | $O_2/He$ — 0.5 | | $GeH_4/SiH_4 = 1/100$<br>$NH_3/SiH_4 = 1/50$ | | | 1 |
| First layer | Third step | $SiH_4/He = 1$<br>$GeH_4/He = 1$ | $SiH_4 = 200$ | $GeH_4/SiH_4 = 1/100$ | 0.20 | 18 | 17 |
| | Fourth step | $SiH_4/He = 1$<br>$GeH_4/He = 1$<br>$B_2H_6/He = 1/100$ | $SiH_4 = 200$ | $B_2H_6/SiH_4 = 0 \rightarrow 1/10000$<br>$GeH_4/SiH_4 = 1/100$ | 0.14 | 12 | 1 |
| Second layer | Fifth step | $SiH_4/He = 0.5$<br>$C_2H_4$<br>$B_2H_6/He = 1/100$ | $SiH_4 = 200$ | $C_2H_4/SIH_4 = 3/10$<br>$B_2H_6/(SiH_4 + C_2H_4)$<br>$= 1/10000$ | 0.16 | 5 | 1 |

TABLE 29

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeH_4/He = 1$<br>$B_2H_6/He = 1/100$<br>$NH_3/He = 0.5$ | $SiH_4 = 200$ | $GeH_4/SiH_4 = 1/2 \rightarrow 1/6$<br>$B_2H_6/SiH_4 = 4/4000 \rightarrow 0$<br>$NH_3/SiH_4 = 1/40 \rightarrow 0$ | 0.18 | 8 | 4 |
| | Second step | $SiH_4/He = 1$<br>$GeH_4/He = 1$<br>$B_2H_6/He$ — 1/100 | $SiH_4 = 200$ | $GeH_4/SiH_4 = 1/6 \rightarrow 0$<br>$B_2H_6/SiH_4 = 0$ | 0.20 | 0.18 | 16 |
| Second layer | Third step | $SiH_4/He = 0.5$<br>$C_2H_4$<br>$B_2H_6/He = 1/100$ | $SiH_4 = 200$ | $C_2H_4/SiH_4 = 3/10$<br>$B_2H6/(SiH_4 + C_2H_4)$<br>$= 1/4000$ | 0.16 | 5 | 0.5 |

TABLE 30

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeH_4/He = 1$<br>$O_2/He$ — 0.5 | $SiH_4 = 200$ | $GeH_4/SiH_4 = 1/2 \rightarrow 1/3$<br>$NH_3/SiH_4$ — 1/50<br>$O_2/SiH_4 = 1/1000$ | 0.20 | 8 | 2 |
| | Second step | | | $GeH_4/SiH_4 = 1/3 \rightarrow 1/6$<br>$NH_3/SiH_4 = 1/100$<br>$O_2/SiH_4 = 1/1000$ | 0.20 | 17.5 | 2 |
| | Third step | $SiH_4/He = 1$<br>$GeH_4/He = 1$<br>$B_2H_6/He = 1/100$ | $SiH_4 = 200$ | $GeH_4/SiH_4 = 1/6 \rightarrow 0$<br>$B_2H_6/SiH_4 = 1/10000$ | 0.15 | 12.5 | 16 |
| Second layer | Fourth step | $SiH_4/He = 0.5$<br>$C_2H_4$<br>$B_2H_6/He = 1/100$ | $SiH_4 = 200$ | $C_2H_4/SiH_4 = 1/100$<br>$B_2H_6/SiH_4C_2H^4)$<br>$= 1/10000$ | 0.16 | 5 | 0.5 |

TABLE 31

| Sample No. | 3101 | 3102 | 3103 | 3104 | 3105 | 3106 | 3107 |
|---|---|---|---|---|---|---|---|
| Thickness of the second layer (μ) | 0.1 | 0.5 | 1.5 | 2 | 3 | 4 | 5 |
| Evaluation | Δ | ○ | ⊙ | ⊙ | ○ | ○ | Δ |

⊙: Excellent
○: Good
Δ: Applicable for practical use

TABLE 32

| Sample No. | 3201 | 3202 | 3203 | 3204 | 3205 | 3206 | 3207 |
|---|---|---|---|---|---|---|---|
| $C_2H_4/SiH_4$ Flow ratio | 1/10 | 2/10 | 4/10 | 5/10 | 10/10 | 2/1 | 3/1 |
| Evaluation | Δ | ○ | ⊙ | ⊙ | ○ | ○ | Δ |

⊙: Excellent
○: Good
Δ: Applicable for practical use

TABLE 33

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 0.5$<br>$GeH_4/He = 0.5$ | $SiH_4 = 200$ | $GeH_4/SiH_4 = 1/1 \rightarrow 0$<br>$B_2H_6/SiH_4$<br>$= 5/1000 \rightarrow 0$<br>$O_2/SiH_4 = 1/40$ | 0.18 | 9 | 4 |
| | Second step | $SiH_4/He = 0.5$ | $SiH_4 = 200$ | | 0.20 | 18 | 16 |
| Second layer | Third step | $SiH_4/He = 0.5$<br>$C_2H_4$<br>$B_2H_6/He = 0.01$<br>$O_2/He = 0.5$ | $SiH_4 = 200$ | $SiH^4/C^2H^4 = 1/1$<br>$B_{26}(SiH_4 + C_2H_4)$<br>$= 5/100000$<br>$= 1/30000$ | 0.18 | 6 | 1 |

TABLE 34

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 0.5$<br>$GeH_4/He = 0.5$ | $SiH_4 = 200$ | $GeH_4/SiH_4 = 1/1 \rightarrow 0$ | 0.20 | 11 | 2 |
| | Second step | $SiH_4/He = 0.5$ | $SiH_4 = 200$ | | 0.20 | 18 | 18 |
| Second layer | Third step | $SiH_4/He = 0.5$<br>$C_2H_4$<br>$B_2/He = 0.01$<br>$O_2/He = 0.5$ | $SiH_4 = 200$ | $SiH_4/C_2H_4 = 1/1$<br>$B_2H_6(SiH_4 + C_2H_4)$<br>$= 5/100000$ | 0.18 | 6 | 1 |

TABLE 35

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeH_4/He = 0.5$ | $SiH_4 = 200$ | $GeH_4/SiH_4 = 1/1$ | 0.18<br>0.19 | 9<br>10 | 1 |
| | Second step | | | $GeH_4/SiH_4 = 1/3$ | | | 6 |
| | Third step | $SiH_4/He = 0.5$ | $SiH_4 = 200$ | | 0.20 | 18 | 13 |
| Second | Fourth | $SiH_4/He = 0.5$ | $SiH_4 = 200$ | $SiH_4/C_2H_4 = 1/1$ | 0.18 | 6 | 1 |

TABLE 35-continued

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| layer | step | $C_2H_4$<br>$B_2H_6/He = 0.01$ | | $B_2H_6/(SiH_4 + GeH_4) \rightarrow$<br>1/10000<br>$C_2H_4/SiH_4 = 1/100$ | | | |

TABLE 36

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeHe/He = 1$<br>$B_2H_6/He = 1/100$<br>$O_2/He = 0.5$ | $SiH_4 = 200$ | $GeH_4/SiH_4 = 1/1 \rightarrow 0$<br>$B_2H_6/SiH_4 = 5/1000$ | 0.19 | 8 | 4 |
| | Second step | $SiH_4/He = 1$ | $SiH_4 = 200$ | $B_2H_6/SiH_4 = 0$ | 0.20 | 18 | 16 |
| Second layer | Third step | $SiH_4He = 0.5$<br>$C_2H_4$<br>$PH_3/He = 1/100$ | $SiH_4 = 200$ | $C_2H_4/SiH_4 = 3/10$<br>$PH_3/(SiH_4 + C_2H_4) =$<br>1/30000 | 0.16 | 5 | 1 |

TABLE 37

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeHe/He = 1$<br>$B_2H_6/He = 1/100$ | $SiH_4 = 200$ | $GeH_4/SiH_4 = 1/1 \rightarrow 0$<br>$B_2H_6/SiH_4 = 1/100000$ | 0.19 | 8 | |
| | Second step | $SiH_4/He = 1$<br>$B_2H_6/He = 1/100$ | $SiH_4 = 200$ | $B_2H_6SiH_4 = 1/100000$ | 0.20 | 18 | 14 |
| Second layer | Third step | $SiH_4/He = 0.5$<br>$C_2H_4$<br>$PH_3/He = 1/100$ | $SiH_4 = 200$ | $C_2H_4/SiH_4 = 3/10$<br>$PH_3/(SiH_4 + C_2H_4) =$<br>1/30000 | 0.16 | 5 | 1.5 |

TABLE 38

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First layer | First step | $SiH_4/He = 1$<br>$GeHe/He = 1$<br>$B_2H_6/He = 1/100$ | $SiH_4 = 200$ | $GeH_4/SiH_4 = 1$<br>$B_2H_6/SiH_4 = 1/100$ | 0.18 | 10 | 1 |
| | Second step | $SiH_4/He = 1$<br>$B_2H_6/He = 1/100$<br>$B_2H_6/He = 1/100$ | $SiH_4 = 200$ | | 0.20 | 18 | 10 |
| | Third step | $SiH_4/He = 1$ | $SiH_4 = 200$ | | 0.20 | 18 | 10 |
| Second layer | Fourth step | $SiH_4/He = 0.5$<br>$C_2H_4$<br>$B_2H_6/He = 1/100$ | $SiH_4 = 200$ | $C_2H_4/SiH_4 = 3/10$<br>$B_2H_6/(SiH_4 + C_2H_4) =$<br>1/30000 | 0.16 | 5 | 1.5 |

TABLE 39

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| First layer | First step | $SiH_4$/He = 1<br>$GeH_4$/He = 1 | $SiH_4$ = 200<br>$SiH_4$ = 200 | $GeH_4/SiH_4$ = 1 | 0.19<br>0.19 | 17<br>17 | 1 |
| | Second step | | | $GeH_4/SiH_4$ = 1/3 | | | 6 |
| | Third step | $SiH_4$/He = 1 | $SiH_4$ = 200 | | 0.20 | 18 | 12 |
| | Fourth step | $SiH_4$/He = 1 | $SiH_4$ = 200 | $B_2H_6/(SiH_4$ = 1/10000 | 0.14 | 12 | 1 |
| Second layer | Fifth step | $SiH_4$/He = 0.5<br>$C_2H_2H_4$<br>$B_2H_6$/He = 1/100 | $SiH_4$ = 200 | $C_2H_4/SiH_4$ = 3/10<br>$B_2H_6/(SiH_4 + C^2H_4)$ = 1/10000 | 0.16 | 5 | 1 |

TABLE 40

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| First layer | First step | $SiH_4$/He = 1<br>$GeH_4$/He = 1<br>$B_2H_6$/He = 1/100 | $SiH_4$ = 200 | $GeH_4/SiH_4$ = 1 → 0<br>$B_2H_6/SiH_4$ = 5/1000 → 0 | 0.19 | 17 | 4 |
| | Second step | $SiH_4$/He = 1 | $SiH_4$ = 200 | | 0.20 | 18 | 16 |
| | Third step | $SiH_4$/He = 0.5 | $SiH_4$ = 200 | | 0.20 | 18 | 10 |
| Second layer | Fourth step | $SiH_4$/He = 0.5<br>$C_2H_4$<br>$PH_3$/He = 1/100 | $SiH_4$ = 200 | $C_{24}/SiH_4$ = 3/10<br>$PH_3/(SiH_4 + C_2H_4)$ = 1/30000 | 0.16 | 5 | 1 |

TABLE 41

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| First | First step | $SiH_4$/He = 1<br>GeHc/He = 1<br>$B_2H_6$/He = 1/100 | $SiH_4$ = 200 | $GeH_4/SiH_4$ = 1/1 → 0<br>$B_2H_6/SiH_4$ = 75/1000 3 → 75/1000 | 0.19 | 7.5 | 4 |
| | Second step | $SiH_4$/He = 1<br>$B_2H_6$/He = 1/100 | $SiH_4$ = 200 | $B_2H_4SiH_4$ = 3.75/1000 → 0 | 0.20 | 18 | 12 |
| Second layer | Third step | $SiH_4$/He = 0.5<br>$C_2H_4$<br>$B_2H_6$/He = 1/100 | $SiH_4$ = 200 | $C_2H_4/SiH_4$ = 3/10<br>$B_2H_6/(SiH_4 + C_2H_4)$ = 1/30000 | 0.16 | 5 | 1.5 |

TABLE 42

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| First step | First step | $SiH_4$/He = 1<br>$GeHe_4$/He = 1<br>$B_2H_6$/He = 1/100 | $SiH_4$ = 200 | $GeH_4/SiH_4$ = 1/1 → 0<br>$B_2H_6/SiH_4$ = 1/1000 → 0 | 0.18 | 7 | 3 |
| | Second step | $SiH_4$/He = 1 | $SiH_4$ = 200 | | 0.20 | 18 | 15 |
| | Third step | $SiH_4$/He = 1<br>$B_2H_2$/He-1/100 | $SiH_4$ = 200 | $B_2H_6/SiH_4$ = 0 → 1/4000 | 0.14 | 12 | 2 |
| Second layer | Fourth step | $SiH_4$/He = 0.5<br>$C_2H_4$<br>$B_2H_6$/He = 1/100 | $SiH_4$ = 200 | $C_2H_4/SiH_4$ = 3/10<br>$B_2H_6/(SiH_4 + C_2H_4)$ = 1/40000 | 0.16 | 5 | 1 |

TABLE 43

| Sample No. | 4301 | 4302 | 4304 | 4305 | 4305 | 4306 | 4307 |
|---|---|---|---|---|---|---|---|
| Thickness (μ) | 0.1 | 0.5 | 1.5 | 2 | 3 | 4 | 5 |
| Evaluation | Δ | ○ | ⊙ | ⊙ | ○ | ○ | Δ |

⊙: Excellent
○: Good
Δ: Applicable for practical use

TABLE 44

| Sample No. | 4401 | 4402 | 4403 | 4404 | 4405 | 4406 | 4407 |
|---|---|---|---|---|---|---|---|
| $C_2H_4/SiH_4$ Flow ratio | 1/10 | 2/10 | 4/10 | 5/10 | 10/10 | 2/1 | 3/1 |
| Evaluation | Δ | ⊙ | ○ | ○ | ○ | ○ | Δ |

⊙: Excellent
○: Good
Δ: Applicable for practical use

TABLE 45

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First step | First step | $SiH_4$ = 1<br>$GeHe_4$/He = 1<br>$B_2H_6$/He = 1/100<br>$O_2$/He = 0.5 | $SiH_4$ = 200 | $GeH_4/SiH_{4\ =\ 1/1\ \rightarrow\ 0}$<br>$B_2H_6/SiH_4$ = 5/10000<br>$O_2/SiH_4$ = 1/40 | 0.18 | 8 | 4 |
| | Second step | $SiH_4$/He = 1 | $SiH_4$ = 200 | | 0.20 | 18 | 16 |
| Second layer | Third step | $SiH_4$/He = 0.5<br>$C_2H_4$<br>$PH_3$/He = 1/100 | $SiH_4$ = 200 | $C_2H_4/SiH_4$ = 3/10<br>$PH_3/(SiH_4 + C_2H_4)$ = 1/30000 | 0.16 | 5 | 0.5 |

TABLE 46

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First step | First step | $SiH_4$/He = 1<br>$GeHe_4$/He = 1<br>$B_2H_6$/He = 1/100<br>$O_{2/He=0.5}$ | $SiH_4$ = 200 | $GeH_4/SiH_4$ = 1/1 → 0<br>$B_2H_6/SiH_4$ = 1/10000<br>$O_2/SiH_4$ = 1/40 → 0.5/40 | 0.18 | 8 | 2 |
| | Second step | $SiH_4$/He = 1<br>$B_2H_6$/He-1/100<br>$O_2$He = 0.5 | $SiH_4$ = 200 | $O_2/SiH_4$ = 0.5/40 → 0<br>$B_2H_6/SiH_4$ = 1/100000 | 0.19 | 8 | 2 |
| | Third step | $SiH_4$/He = 1<br>$B_2H_2$/He-1/100 | $SiH_4$ = 200 | $B_2H_6/SiH_4$ = 1/100000 | 0.16 | 12 | 16 |
| Second layer | Fourth step | $SiH_4$/He = 0.5<br>$C_2H_4$<br>$PH_3$/He = 1/100 | $SiH_4$ = 200 | $C_2H_4/SiH_4$ = 3/10<br>$PH_3/SiH_4 + C_2H_4$ = 1/30000 | 0.16 | 5 | 0.5 |

TABLE 47

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First step | First step | $SiH_4$/He = 1<br>$GeHe_4$/He = 1<br>$O_2$/He = 0.5 | $SiH_4$ = 200 | $GeH_4/SiH_4$ = 1/1 → 0<br>$O_2/SiH_4$ = 5/1000 → 0 | 0.18 | 8 | 4 |
| | Second step | $SiH_4$/He = 1 | $SiH_4$ = 200 | | 0.20 | 18 | 15 |

TABLE 47-continued

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| | Third step | $SiH_4$/He = 1<br>$B_2H_2$/He-1/100 | $SiH_4$ = 200 | $B_2H_6/SiH_4$ = 1/100000 | 0.16 | 12 | 1 |
| Second layer | Fourth step | $SiH_4$/He = 0.5<br>$C_2H_4$<br>$B_2H_6$/He = 1/100 | $SiH_4$ = 200 | $C_2H_4/SiH_4$ = 3/10<br>$B_2H_6/(SiH_4 + C_2H_4)$ = 1/10000 | 0.16 | 5 | 0.5 |

TABLE 48

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| First step | First step | $SiH_4$/He = 1<br>$GeHe_4$/He = 1<br>$B_{26}$/He = 1/100<br>$O_2$/He = 0.5 | $SiH_4$ = 200 | $GeH_4/SiH_4$ = 1/1 → 1/3<br>$B_{26}/SiH_4$ = 1/1000<br>$O_2/SiH_4$ = 4/4000 | 0.16 | 7 | 8 |
| | Second step | $SiH_4$/He = 1<br>$O_2$/He-0.5 | $SiH_4$ = 200 | $O_2/SiH_4$ = 0.25/4000 | 0.18 | 8 | 16 |
| Second layer | Third step | $SiH_4$/He = 0.5<br>$C_2H_4$<br>$B_2H_6$/He = 1/100 | $SiH_4$ = 200 | $C_2H_4/SiH_4$ = 3/10<br>$B_{26}/(SiH_4 + C_2H_4()$ = 1.5/4000 | 0.16 | 5 | 0.5 |

TABLE 49

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| First step | First step | $SiH_4$/He = 1<br>$GeHe_4$/He = 1<br>$B_{26}$/He = 1/100<br>$O_2$/He = 0.5 | $SiH_4$ = 200 | $GeH_4/SiH_4$ = 1/1 → 0<br>$B_{26}/SiH_4$51/1000<br>$O_2/SiH_4$ = 1/40 | 0.18 | 8 | 4 |
| | Second step | $SiH_4$/He = 1<br>$O_2$/He-0.5 | $SiH_4$ = 200 | $O_2/SiH_4$ = 1/400 | 0.18 | 9 | 16 |
| Second layer | Third step | $SiH_4$/He = 0.5<br>$C_2H_4$<br>$PH_3$He = 1/00<br>$O_2$He-0.5 | $SiH_4$ = 200 | $C_2H_4/SiH_4$ = 3/10<br>$PH_3/(SiH_4 + C_2H_{24}$ = 1/3000<br>$O_2/SiH_4$ = 1/400 | 0.16 | 4 | 0.5 |

TABLE 50

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| First step | First step | $SiH_4$/He = 1<br>$GeHe_4$/He = 1<br>$B_2H_5$/He = 1/100<br>$O_2$/He = 0.5 | $SiH_4$ = 200 | $GeH_4/SiH_4$ = 1/1 → 0<br>$B_{26}/SiH_4$ = 5/1000 → 0<br>$O_2/SiH_4$ = 1/40 | 0.18 | 8 | 4 |
| | Second step | $SiH_4$/He = 1 | $SiH_4$ = 200 | $O_2/SiH_4$ = 1/400 | 0.20 | 18 | 16 |
| Second layer | Third step | $SiH_4$/He = 0.5<br>$C_2H_4$<br>$PH_3$/He = 1/100<br>$O_2$He-0.5 | $SiH_4$ = 200 | $(O_2 + C_2H_4)/SiH_4$ = 3/10<br>$PH_3/(SiH_4 + C_2H_{24} + O_2)$ = 1/30000<br>$O_2/SiH_4$ = 1/400 | 0.17 | 5 | 0.5 |

TABLE 51

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First step | First step | $SiH_4$/He = 1<br>$GeHe_4$/He = 1<br>$B_{26}$/He = 1/100<br>$O_2$/He = 0.5 | $SiH_4$ = 200 | $GeH_4/SiH_4$ = 1/1 → 0<br>$B_{26}/SiH_4$ = 5/1000 → 7/1600<br>$O_2/SiH_4$ = 5/40 → 0.5/40 | 0.18 | 8 | 2 |
| | Second step | $SiH_4$/He = 1<br>$B_2H_6$/He = 1/100 | $SiH_4$ = 200 | $B_2H_6/SiH_4$ = 7/1600 → 3.75/1000<br>$O_2/SiH_{4\text{-}0.5/40 \rightarrow 0}$ | 0.19 | 8 | 2 |
| | Third step | $SiH_4$/He = 0.5<br>$C_2H_4$<br>$PH_3$/He = 1/100 | $SiH_4$ = 200 | $B_2H_6/SiH_4$ =3.75/1000 → 0 | 0.20 | 18 | 16 |
| Second layer | Fourth step | $SiH_4$/He = 0.5<br>$C_2H_4$<br>$PH_3$/He = 1/100 | $SiH_{4\,=\,200}$ | $C_2H_4/SiH_4$ = 3/10<br>$PH_3/(SiH_4 + C_2H_4)$ = 1/30000 | 0.16 | 5 | 0.5 |

TABLE 52

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First step | First step | $SiH_4$/He = 1<br>$GeHe_4$/He = 1<br>$B_2H_6$/He = 1/100<br>$O_2$/He = 0.5 | $SiH_4$ = 200 | $GeH_4/SiH_4$ = 1/1 → 0<br>$B_2H_6/SiH_4$ = 4/4000 → 0<br>$O_2/SiH_4$ = 1/40 → 0<br>$O_2/SiH_4$ = 5/40 → 0.5/40 | 0.18 | 9 | 4 |
| | Second step | $SiH_4$/He = 1 | $SiH_4$ = 200 | | 0.20 | 18 | 14 |
| | Third step | $SiH_4$/He = 1<br>$B_{26}$/He = 1/100 | $SiH_4$ = 200 | $B_2H_6/SiH_4$ = 0 → 1/4000 | 0.18 | 16 | 2 |
| Second layer | Fourth step | $SiH_4$/He = 0.5<br>$C_2H_4$<br>$B_2H_6$/He = 1/100 | $SiH_4$ = 200 | $C_2H_4$ /$SiH_4$ = 3/10<br>$B_2H_6/(SiH_4 + C_2H_4)$ = 1/4000 | 0.16 | 5 | 0.5 |

TABLE 53

| Sample No. | 5301 | 5302 | 5303 | 5304 | 5305 | 5306 | 5307 |
|---|---|---|---|---|---|---|---|
| Thickness of second layer (μ) | 0.1 | 0.5 | 1.5 | 2 | 3 | 4 | 5 |
| Evaluation | Δ | ○ | ⊙ | ⊙ | ○ | ○ | Δ |

⊙: Excellent
○: Good
Δ: Applicable for practical use

TABLE 54

| Sample No. | 5401 | 5402 | 5403 | 5404 | 5405 | 5406 | 5407 |
|---|---|---|---|---|---|---|---|
| $C_2H_4/SiH_4$ Flow ratio | 1/10 | 2/10 | 4/10 | 5/10 | 10/10 | 2/1 | 3/1 |
| Evaluation | Δ | ⊙ | ⊙ | ○ | ○ | ○ | Δ |

⊙: Excellent
○: Good
Δ: Applicable for practical use

TABLE 55

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First step | First step | $SiH_4$/He = 1<br>$GeHe_4$/He = 1 | $SiH_4$ = 200 | $GeH_4/SiH_4$ = 1/1 → 0<br>$B_2H_6/SiH_4$ = 5/100000 | 0.18 | 8 | 4 |

TABLE 55-continued

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| | | $B_2H_6$/He = 1/100<br>$NH_3$/He = 0.5 | | $NH_3/SiH_4$ = 1/40 | | | |
| | Second step | $SiH_4$/He = 1 | $SiH_4$ = 200 | | 0.20 | 18 | 16 |
| Second layer | Third step | $SiH_4$/He = 0.5<br>$C_2H_4$<br>$PH_3$/He = 1/100 | $SiH_4$ = 200 | $C_2H_4/SiH_4$ = 3/10<br>$PH_3/(SiH_4 + C_2H_{24}$<br>= 1/30000<br>$O_2/SiH_4$ = 1/400 | 0.16 | 5 | 0.5 |

TABLE 56

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| First step | First step | $SiH_4$/He = 1<br>$GeHe_4$/He = 1<br>$B_2H_6$/He = 1/100<br>$NH_3$/He = 0.5 | $SiH_4$ = 200 | $GeH_4/SiH_4$ = 1/1 → 0<br>$B_2H_6/SiH_4$ = 1/100000<br>$NH_3/SiH_4$ = 1/40<br>→ 0.5/40 | 0.18 | 8 | 2 |
| | Second step | $SiH_4$/He = 1<br>$B_2H_6$/He = 1/100<br>$NH_3$/He = 0.5 | $SiH_4$ = 200 | $NH_3/SiH_4$ = 0.5/40 → 0<br>$B_2H_6/SiH_4$ = 1/100000 | 0.19 | 18 | 2 |
| | Third step | $SiH_4$/He = 1<br>$B_2H_4$/He = 1/100 | $SiH_4$ = 200 | $B_2H_6/SiH_4$ = 1/100000 | 0.16 | 5 | 16 |
| Second layer | Fourth step | $SiH_4$/He = 0.5<br>$C_2H_4$<br>$PH_3$/He = 1/100 | $SiH_4$ = 200 | $C_2H_4/SiH_4$ = 3/10<br>$PH_3/(SiH_4 + C_2H_4)$<br>= 1/30000 | 0.16 | 5 | 0.5 |

TABLE 57

| Layer constitution | Layer preparing steps | Gas used | Flow amount (SCCM) | Flow ratio | Discharging power (W/cm$^2$) | Deposition speed (Å/sec) | Layer thickness (μ) |
|---|---|---|---|---|---|---|---|
| First step | First step | $SiH_4$/He = 1<br>$GeHe_4$/He = 1<br>$NH_3$/He = 0.5 | $SiH_4$ = 200 | $GeH_4/SiH_4$ = 1/1 → 0<br>$NH_3/SiH_4$ = 5/1000 → 0<br>→ 0.5/40 | 0.18 | 8 | 4 |
| | Second step | $SiH_4$/He = 1<br>$B_2H_6$/He — 1/100 | $SiH_4$ = 200 | | 0.20 | 18 | 15 |
| | Third step | $SiH_4$/He = 1<br>$B_2H_4$/He — 1/100 | $SiH_4$ = 200 | $B_2H_6/SiH_4$ = 1/100000 | 0.16 | 12 | 1 |
| Second layer | Fourth step | $SiH_4$/He = 0.5<br>$C_2H_4$<br>$B_2H_6$/He = 1/100 | $SiH_4$ = 200 | $C_2H_4/SiH_4$ = 3/10<br>$B_2H_6/(SiH_4 + C_2H_4)$<br>= 1/10000 | 0.16 | 5 | 0.5 |

TABLE 58

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First step | First step | $SiH_4$/He = 1<br>$GeHe_4$/He = 1<br>$B_2H_6$/He = 1/100<br>$NH_3$/He = 0.5 | $SiH_4$ = 200 | $GeH_4/SiH_4$ = 1/1 → 1/3<br>$B_2H_6/SiH_4$ = 1/1000<br>$NH_3/SiH_4$ = 4/4000<br>→ 0.25/4000 | 0.16 | 7 | 8 |
| | Second step | $SiH_4$/He = 1<br>$NH_3$/He = 0.5 | $SiH_4$ = 200 | $NH_3/SiH_4$ — 0.25/4000<br>→ 1.5/4000 | 0.18 | 8 | 16 |
| Second layer | Third step | $SiH_4$/He = 0.5<br>$C_2H_4$<br>$B_2H_6$/He = 1/100 | $SiH_4$ = 200 | $C_2H_4/SiH_4$ = 3/10<br>$B_2H_6/(SiH_4 + C_2H_4)$<br>= 1.5/4000 | 0.16 | 5 | 0.5 |

TABLE 59

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First step | First step | $SiH_4$/He = 1<br>$GeHe_4$/He = 1<br>$B_2H_6$/He = 1/100<br>$NH_3$/He = 0.5 | $SiH_4$ = 200 | $GeH_4/SiH_4$ = 1/1 → 1/3<br>$B_2H_6/SiH_4$ = 1/1000<br>$O_2/SiH_4$ = 4/4000 | 0.18 | 8 | 4 |
| | Second step | $SiH_4$/He = 1<br>$NH_3$/He — 0.5 | $SiH_4$ = 200 | $O_2/SiH_4$ = 0.25/4000 | 0.18 | 9 | 16 |
| Second layer | Third step | $SiH_4$/He = 0.5<br>$C_2H_4$<br>$PH_3$/He = 1/100<br>$NH_3$/He = 0.5 | $SiH_4$ = 200 | $C_2H_4/SiH_4$ = 3/10<br>$PH_3/(SiH_4 + C_2H_4)$<br>= 1/30000<br>$NH_3/SiH_4$ = 1/400 | 0.16 | 4 | 0.5 |

TABLE 60

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First step | First step | $SiH_4$/He = 1<br>$GeHe_4$/He = 1<br>$B_2H_6$/He = 1/100<br>$NH_3$/He = 0.5 | $SiH_4$ = 200 | $GeH_4/SiH_4$ = 1/1 → 0<br>$B_2H_6/SiH_4$ = 5/1000<br>$NH_3SiH_4$ = 1/40<br>→ 0.25/4000 | 0.18 | 8 | 4 |
| | Second step | $SiH_4$/He = 1 | $SiH_4$ = 200 | $NH_3/SiH_4$ = 1.400 | 0.20 | 18 | 16 |
| Second layer | Third step | $SiH_4$/He = 0.5<br>$C_2H_4$<br>$PH_3$/He = 1/100<br>$NH_3$/He = 0.5 | $SiH_4$ = 200 | $(NH_3 + C_2H_4/SiH_4$ = 3/10<br>$PH_3/SiH_4 + C_2H_4 + O_2)$<br>= 1/3000 | 0.17 | 5 | 0.5 |

TABLE 61

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First step | First step | $SiH_4$/He = 1<br>$GeHe_4$/He = 1<br>$B_2H_6$/He — 1/100<br>$NH_3$/He = 0.5 | $SiH_4$ = 200 | $GeH_4/SiH_4$ = 1/1 → 0<br>$B_2H_6/SiH_4$ = 5/1000 → 7/1600<br>$NH_3/SiH_4$ = 1/40 → 0.5/40 | 0.18 | 8 | 2 |
| | Second step | $SiH_4$/He = 1<br>$B_2H_6$/He — 1/100<br>$NH_3$/He — 0.5 | $SiH_4$ = 200 | $B_2H_6/SiH_4$ = 7/1600 → 3.75/1000<br>$NH_3/SiH_4$ = 0.5/40 → 0 | 0.19 | 8 | 2 |
| | Third step | $SiH_4$/He = 1<br>$B_2H_4$/He — 1/100 | $SiH_4$ = 200 | $B_2H_6/SiH_4$ = 3.75/1000 → 0 | 0.20 | 18 | 16 |
| Second layer | Fourth step | $SiH_4$/He = 0.5<br>$C_2H_4$<br>$PH_3$/He = 1/100 | $SiH_4$ = 200 | $C_2H_4/SiH_4$ = 3/10<br>$PH_3/(SiH_4 + C_2H_4)$ = 1/30000 | 0.16 | 5 | 0.5 |

TABLE 62

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First step | First step | $SiH_4$/He = 1<br>$GeHe_4$/He = 1<br>$B_2H_6$/He — 1/100<br>$NH_3$/He = 0.5 | $SiH_4$ = 200 | $GeH_4/SiH_4$ = 1/1 → 0<br>$B_2H_6/SiH_4$ = 5/1000 → 7/1600<br>$NH_3/SiH_4$ = 1/40 → 0.5/40 | 0.18 | 9 | 4 |
| | Second step | $SiH_4$/He = 1 | $SiH_4$ = 200 | $B_2H_6/SiH_4$ = 7/1600 → 3.75/1000<br>$NH_3/SiH_4$ = 0.5/40 → 0 | 0.20 | 18 | 14 |
| | Third step | $SiH_4$/He = 0.5<br>$B_2H_6$/He — 1/100 | $SiH_4$ = 200 | $B_2H_6/SiH_4$ = 3.75/1000 → 0 | 0.18 | 16 | 2 |
| Second layer | Fourth step | $SiH_4$/He = 0.5<br>$C_2H_4$<br>$B_2H_6$/He = 1/100 | $SiH_4$ = 200 | $C_2H_4/SiH_4$ = 3/10<br>$B_2H_6/(SiH_4 + C_2H_4)$ = 1/4000 | 0.16 | 5 | 0.5 |

TABLE 63

| Layer constitution | Layer preparing steps | Gas used | Flow amount (SCCM) | Flow ratio | Discharging power ($W/cm^2$) | Deposition speed (Å/sec) | Layer thickness (μ) |
|---|---|---|---|---|---|---|---|
| First step | First step | $SiH_4$/He = 1<br>$GeHe_4$/He = 1<br>$NH_3$<br>$O_2$/He = 0.5 | $SiH_4$ = 200 | $GeH_4/SiH_4$ = 1/1 → 0<br>$NH_3/SiH_4$ = 1/50<br>$O_2/SiH_4$ — 1/200 | 0.20 | 8 | 2 |
| | Second step | $SiH_4$/He = 1<br>$NH_3$<br>$O_2$/He = 0.5 | $SiH_4$ = 200 | $NH_3/SiH_4$ = 1/100<br>$O_2/SiH_4$ = 1/1000 | 0.20 | 18 | 2 |
| | Third step | $SiH_4$/He = 1<br>$B_2H_6$/He = 1/100 | $SiH_4$ = 200 | $B_2H_6/SiH_4$ = 1/10000 | 0.14 | 12 | 16 |
| Second layer | Fourth step | $SiH_4$/He = 0.5<br>$C_2H_4$<br>$B_2H_6$/He = 1/100 | $SiH_4$ = 200 | $C_2H_4/SiH_4$ = 3/10<br>$B_2H_6/(SiH_4 + C_2H_4)$ = 1/10000 | 0.16 | 5 | 0.5 |

TABLE 64

| Sample No. | 6401 | 6402 | 6403 | 6404 | 6405 | 6406 | 6407 |
|---|---|---|---|---|---|---|---|
| Thickness of second layer (μ) | 0.1 | 0.5 | 1.5 | 2 | 3 | 4 | 5 |
| Evaluation | Δ | ○ | ⊙ | ⊙ | ○ | ○ | Δ |

⊙: Excellent
○: Good
Δ: Applicable for practical use

TABLE 54

| Sample No. | 6501 | 6502 | 6503 | 6504 | 6505 | 6506 | 6507 |
|---|---|---|---|---|---|---|---|
| $C_2H_4/SiH_4$ Flow ratio | 1/10 | 2/10 | 4/10 | 5/10 | 10/10 | 2/1 | 3/1 |
| Evaluation | Δ | ⊙ | ⊙ | ○ | ○ | ○ | Δ |

⊙: Excellent
○: Good
Δ: Applicable for practical use

We claim:

1. A light receiving member comprising a substrate and a light receiving layer disposed on said substrate; said light receiving layer comprising:

(a) a 1 to 100 μm thick first layer having photoconductivity formed directly on said substrate; and (b) a 0.003 to 30 μm thick second layer having an insulating property in sequence from the side of the substrate, said second layer having a free surface;

said first layer (a) consisting essentially of (i) an amorphous material containing silicon atoms, (ii) 1 to $6\times10^5$ atomic ppm of germanium atoms, (iii) at least one kind of atom selected from the group consisting of hydrogen atoms and halogen atoms in a total amount of 0.01 to 40 atomic %, and (iv) a conductivity controlling element selected from the group consisting of Al, Ga, In and Tl belonging to Group III or selected from the group consisting of P, As, Sb and Bi belonging to Group V of the Periodic Table, wherein said germanium atoms being so distributed in the thickness direction that the concentration thereof is enhanced at the position adjacent to the substrate and the concentration thereof is reduced or made substantially zero at the position adjacent to the interface with said second layer (b); wherein said second layer (b) comprises a second amorphous material containing (b-i) silicon atoms, (b-11) 0.001 to 90 atomic % of carbon atoms, (b-iii) at least one kind of atom selected from the group consisting of oxygen atoms and nitrogen atoms, said at least one kind of atom being uniformly distributed in the direction of thickness of said second layer and (b-iv) 1.0 to $1\times10^4$ atomic ppm of an atom selected from the group consisting of B, Al, Ga, In and Tl belonging to Group III or an atom selected from the group consisting of P, As, Sb and Bi belonging to Group V of the Periodic Table.

2. A light receiving member according to claim 1, wherein the substrate is electrically insulative.

3. A light receiving member according to claim 1, wherein the substrate is electroconductive.

4. A light receiving member according to claim 1, wherein the substrate is an aluminum alloy.

5. A light receiving member according to claim 1, wherein the substrate is cylindrical in form.

6. A light receiving member according to claim 1, wherein the conductivity controlling element is uniformly distributed in the thickness direction in the first layer.

7. A light receiving member according to claim 1, wherein the amount of the conductivity controlling element contained in the first layer is from 0.001 to 3000 atomic ppm.

8. A light receiving member according to claim 1, wherein the concentration of the conductivity controlling element contained in the first layer decreases from a maximum on the side of the second layer to a minimum on the side of the substrate.

9. A light receiving member according to claim 8, wherein the conduction type of the conductivity controlling element contained in the first layer is the same as that of the atom selected from the Group III and V atoms contained in the second layer.

10. A light receiving member according to claim 8, wherein the amount of the conductivity controlling element contained in said first layer is from 0.001 to 3000 atomic ppm.

11. A light receiving member according to claim 1, wherein the concentration of the conductivity controlling element contained in the first layer is relatively high at the side of the substrate and is relatively low at the interface with the second layer.

12. A light receiving member according to claim 1, wherein the concentration of the conductivity controlling element in the first layer in the thickness direction is enhanced adjacent to the substrate and is substantially zero adjacent to the interface with the second layer.

13. A light receiving member according to claim 1, wherein the first layer has a partial layer region adjacent to the second layer which contains 0,001 to 3000 ppm of the conductivity controlling element uniformly or unevenly distributed therein.

* * * * *

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL.

It is certified that error appears in the above-identified patent and that said Letters Patent is hereby corrected as shown below:

AT [57] ABSTRACT

Line 2, "comrpsing" should read --comprising--.
Line 14, "on" should read --or--.

COLUMN 1

Line 3, "A-SI AND GE" should read --A-Si AND Ge--.
Line 21, "such" should read --(such--.

COLUMN 3

Line 11, "properly" should read --property--.

COLUMN 4

Line 22, "a" should read --as--.
Line 49, "sued" should read --used--.

COLUMN 5

Line 11, "were" should read --where--.
Line 15, "were" should read --where--.
Line 52, "$Sno_2$," should read --$SnO_2$,--.

COLUMN 7

Line 46, "position tT." should read --position $t_T$.--.

UNITED STATES PATENT·AND TRADEMARK OFFICE

CERTIFICATE OF CORRECTION

PATENT NO. : 5,545,500

DATED : August 13, 1996

INVENTOR(S) : SHIGERU SHIRAI ET AL.

It is certified that error appears in the above-identified patent and that said Letters Patent is hereby corrected as shown below:

COLUMN 9

Line 41, "(aluminum," should read --(aluminum),--.
Line 60, "5X102" should read --$5x10^2$--.

COLUMN 10

Line 20, "equation:" should read --equation: $t/t+t_o \leq 0.4$, more preferred to satisfy the equation:--.
Line 21, "$t/t+t_o \geqq 0.35$," should read --$t/t+t_o \leqq 0.35$,--.
Line 22, "$t/t+t_o \geqq 030$." should read --$t/t+t_o \leqq 0.30$.--.

COLUMN 18

Line 34, "$GeI_4$," should be deleted, and "Ge $Br_2$," should read --$GeBr_2$,--.

COLUMN 19

Line 4, "ration," should read --ratio,--.
Line 6, "materials" should read --material--.

COLUMN 20

Line 8, "flayer" should read --layer--.
Line 37, "describe" should read --described--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL. Page 3 of 21

It is certified that error appears in the above-identified patent and that said Letters Patent is hereby corrected as shown below:

COLUMN 21

Line 5, "form" should read --from--.
Line 23, "A-SiCm(H,X)(O,N)" should read --A-SiCM(H,X)(O,N)--.
Line 31, "sued" should read --used--.

COLUMN 22

Line 2, "($C_3H_6$," should read --($C_3H_6$),--.
Line 8, "Si($Ch_3$)$_4$" should read --Si($CH_3$)$_4$--.
Line 28, "of the" should read --of--.
Line 55, "constitute" should read --constituted--.
Line 63, "he" should read --the--.

COLUMN 23

Line 8, "form" should read --from--.
Line 15, "0101" should read --0.01--.
Line 20, "disc" should read --discharging--.
Line 21, "having" should be deleted.
Line 49, "The," should read --Then,--.
Line 56, "design" should read --designed--.

COLUMN 24

Line 48, "form" should read --from--.
Line 47, "HE" should read --He-- and "$NJ_3$/He gas form" should read --$NH_3$/He gas from--.
Line 48, "form" should read --from--.
Line 53, "exist" should read --exit--.
Line 57, "exist" should read --exit--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL.

It is certified that error appears in the above-identified patent and that said Letters Patent is hereby corrected as shown below:

COLUMN 25

Line 48, "AS" should read --As--.
Line 62, "$GeH_4/Si_4$" should read --$GeH_4/SiH_4$--.
Line 63, "$B_2H_{26}/Si_4$" should read --$B_2H_6/SiH_4$--.

COLUMN 26

Table A, "$GeH_4/Si_4$" should read --$GeH_4/SiH_4$-- and
"$B_2H_6/Si_4$" should read --$B_2H_6/SiH_4$--.
Line 46, "nay" should read --any--.
Line 57, "$GeH_4/Si_4$," should read --$GeH_4/SiH_4$,--

COLUMN 27

Line 46, "nay" should read --any--.
Line 63, "est" should read --test--.
Line 65, "an" should read -and--.

COLUMN 29

Line 33, "member" should read --members--.

COLUMN 31

Line 22, "us" should read --use-.
Line 34, "he" should read --the--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL.

It is certified that error appears in the above-identified patent and that said Letters Patent is hereby corrected as shown below:

COLUMN 32

Line 12, "nay" should read --any--.

Line 15, "images." should read --images.

Example 66

In Examples 33 through 65, except that there were practiced formation of electrostatic latent images and reversal development using GaAs series semiconductor laser (10 mW) instead of the tungsten lamp as the light source, the same image forming process as in Example 1 was employed for each of the light receiving members and the resulting transferred toner images evaluated.

As a result, it was confirmed that any of the light receiving members always brings about high quality and highly resolved visible images with clearer half tone.--.

Line 17, lines 17 through 29 should be deleted.

Table 1, under Col. "Flow ratio", "$GeH_4/SiH_4$-1/2→0" should read --$GeH_4/SiH_4$=1/2→0-- and "$C_2H_4$)=1/3000" should read --$C_2H_4$)=1/30000--.

Table 2, under Col. "Flow ratio" "$GeH_4/SiH_4$-1/6→0" should read --$GeH_4/SiH_4$=1/6→0-- and "($C_2H_4$)=1/3000" should read --$C_2H_4$)=1/30000--.

COLUMN 33

Table 3, under Col. "Gas used" "$GeH_4$/He=1/100" should read --$B_2H_6$/He=1/100-- and "$PH_3$/He=1/100" should read --$B_2H_6$/He=1/100--.

Table 4, under Col. "Gas used" "$B_2H_6$He=1/100" should read --$B_2H_6$/He=1/100--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL. Page 6 of 21

It is certified that error appears in the above-identified patent and that said Letters Patent is hereby corrected as shown below:

COLUMN 33 continued,

Table 5, under Col. "Gas used"
"$B_2H_6He$=1/100" should read --$B_2H_6$/He=1/100--.
under Col. "Flow ratio"
"$B_2H_6/SiH_4$=5/1000→" should read
--$B_2H_6/SiH_4$=5/10000→-- and
"$GeH_4SiH_4$=1→1/2 should read --$GeH_4/SiH_4$=1→1/2
$GeH_4SiH_4$=1/2→0" $GeH_4/SiH_4$=1/2→0--.

Table 6, under Col. "Gas used"
"$SiH_4He$=1" should read --$SiH_4$/He=1--.

COLUMN 35

Table 7, under Col. "Gas used"
"$B_2H_6He$=1/100" should read --$B_2H_6$/He=1/100--.
under Col. "Flow ratio"
"$GeH_4/SiH_4$=1 should read --$B_2H_6/SiH_4$=4/4000→0
$GeH_4/SiH_4$=1/100 $GeH_4/SiH_4$=1
$GeH_4/SiH_4$=1/100 $GeH_4$/He=1→1/100
$B_2H_6/SiH_4$=1/10000" $B_2H_6/SiH_4$=1/10000
=0→1/4000
$GeH_4/SiH_4$=1/100 --
and "1/40000" should read --1/4000--.

Table 8, under Col. "801", "1.1" should read --0.1--.

Table 9, under Col. "901", "Δ" should read --O--.
under Col. "902", "O" should read --●--.
under Col. "904", "●" should read --O--.

Table 10, under Col. "Gas used"
"$SiH_4He$=1" should read --$SiH_4$/He=1--,
"$B_2H_6He$=1/100" should read --$B_2H_6$/He=1/100--, and
"$PH_3$/He-1/100" should read --$PH_3$/He=1/100--.
under Col. "Flow ratio" "$B_2H_6/SiH_4$-5/1000"
should read --$B_2H_6/SiH_4$=5/1000--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL. Page 7 of 21

It is certified that error appears in the above-identified patent and that said Letters Patent is hereby corrected as shown below:

COLUMN 35 continued,

Table 11, under Col. "Gas used"
"$B_2H_6$/He-1/100" should read --$B_2H_6$/He=1/100--.
under Col. "Flow ratio"
"$B_2H_6$/$SiH_4$-1/10000" should read
--$B_2H_6$/$SiH_4$=1/100000--.

COLUMN 37

Table 11, under Col. "Gas used"
$PH_3$/He-1/100" should read --$PH_3$/He=1/100--.
under Col. "Flow ratio"
"$PH_3$/($C_2H_4$+$SiH_4$)=" should read
--$PH_3$/($SiH_4$+$C_2H_4$)=--.

Table 12, under Col. "Layer constitution"
"Second layer" (1st occurrence) should be deleted.
under Col. "Gas used"
"$O_2$He-0.5" should read --$O_2$He=0.5-- and
"$B_2H_6$/He-1/100" should read --$B_2H_6$/He=1/100--.
under col. "Flow ratio"
"$O_2$/$SiH_4$=1/1000→0" should read
--$_2$/$SiH_4$=3.75/1000→0-- and
"$C_2H_4$/$SiH_4$=1/100 should read --$GeH_4$/$SiH_4$=1/100
$B_2H_6$/($SiH_4$=1/10000 $B_2H_6$/$SiH_4$=1/10000
$C_2H_4$/$SIH_4$=3/10" $C_2H_4$/$SiH_4$=3/10--.

Table 13, under Col. "Gas used"
"$O_2$He=0.5" should read --$O_2$/He=0.5--.
under col. "Flow ratio"
"$GeH_4$/$SiH_4$=1/2→" should read --$GeH_4$/He=1→-- and
"1.5/40000=1/30000" should read --1.5/40000--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL.

It is certified that error appears in the above-identified patent and that said Letters Patent is hereby corrected as shown below:

COLUMN 39

Table 14, under Col. "Flow ratio"
"PH3/$SiH_4$+$C_2H_4$)=" should read --PH3/($SiH_4$+$C_2H_4$)=--.

Table 15, under Col. "Gas used"
"$O_2$/He=0.5" (2nd occurrence) should be deleted.

Table 16, under Col. "Gas used"
"$O_2$/He=0.5" (2nd occurrence) should be deleted.
under Col. "Flow ratio"
"$GeH_4$/$SiH_4$=1/1→1/2" should read
--$GeH_4$/$SiH_4$=1/1→1/100--,
"=5/1000→0 should read --=5/1000→3.75/1000
$O_2$/$SiH_4$=1/40 $O_2$/$SiH_4$=1/40→0
$GeH_4$/$SiH_4$=1/2→0" $GeH_4$/$SiH_4$=1/100
$B_2H_6$/$SiH_4$=3.75/1000→0--,
and
"$PH_3$/($SiH_4$+$C_2H_4$" should read --$PH_3$/($SiH_4$+$C_2H_4$)--.

Table 17, under Col. "Gas used"
"$O_2$/He-0.5" should read --$O_2$/He=0.5--.
under Col. "Flow ratio"
"$O_2$/$SiH_4$-1/50" should read --$O_2$/$SiH_4$=1/50-- and
"$C_2H_4$/$SiH_4$=1/100 should read --$GeH_4$/$SiH_4$=1/100
$C_2H_4$/$SIH_4$=3/10" $C_2H_4$/$SiH_4$=3/10
under Col. "Layer thickness"
"15" should read --17--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL.

It is certified that error appears in the above-identified patent and that said Letters Patent is hereby corrected as shown below:

COLUMN 41

Table 17, under Col. "Gas used"
"$B_2H_6$/He-1/100" should read --$B_2H_6$/He=1/100--.

Table 18, under Col. "Gas used"
"$SiH_4$/He=1 should read --$SiH_4$=1
$GeH_4$/He=1 $GeH_4$=1
$B_2H_6$/He-1/100" $B_2H_6$/He=1/100-- and
"$B_2H_6$/He-1/100" should read --$B_2H_6$/He=1/100--.
under Col. "Flow ratio"
"$B_2H_6/SiH_4$=0" should read --$B_2H_6/SiH_4$=0→1/4000--
and "$B_2H6/(SiH_4+C_2H_4)$=1/30000" should read
--$B_2H_6/(SiH_4+C_2H_4)$=1/4000--.
under Col. "Deposition speed"
"8" should read --9--.

Table 20, in row "Evaluation,"
"Δ ○ ◎ ◎ ○ ○ Δ" should read
--○ ◎ ◎ ○ ○ ○ Δ--.

Table 21, under Col. "Gas used"
"$PH_3$/He-1/100" should read --$PH_3$/He=1/100--.
under Col. "Flow ratio"
"$B_2H_6/SiH_4$-5/1000" should read
--$B_2H_6/SiH_4$=5/1000--.

COLUMN 43

Table 22, under Col. "Gas used"
"$O_2$/He=0.5" should read --$NH_3$/He=0.5--,
"$B_2H_6$/He-1/100" should read --$B_2H_6$/He=1/100-- and
"$PH_3$/He-1/100" should read --$PH_3$/He=1/100--.
under Col. "Flow ratio"
"$B_2H_6/SiH_4$-1/10000" should read
--$B_2H_6/SiH_4$=1/100000--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL.

It is certified that error appears in the above-identified patent and that said Letters Patent is hereby corrected as shown below:

COLUMN 43 continued,

Table 23, under Col. "Gas used"
"$O_2$/He-0.5" should read --$NH_3$/He=0.5-- and
"$B_2H_6$/He-1/100" should read --$B_2H_6$/He=1/100--.
under Col. "Flow ratio"
"$C_2H_4$/$SIH_4$=3/10" should read --$C_2H_4$/$SiH_4$=3/10--.

Table 24, under Col. "Gas used"
"$O_2$/He=0.5" should read --$NH_3$/He=0.5-- and
"$GeH_4$/He=1" (2nd occurrence) should read
--$GeH_4$/He=0.5--.
under Col. "Flow ratio"
"$NH_3$/$SiH_4$=0.25/400000" should read
--$NH_3$/$SiH_4$=0.25/40000-- and
"=1/30000" should be deleted.

COLUMN 45

Table 25, under Col. "Flow ratio"
"$PH_3$/$SiH_4$+$C_2H_4$)" should read --$PH_3$/($SiH_4$+$C_2H_4$)--.

Table 26, under Col. "Flow ratio"
"$PH_3$/($SiH_4$+$C_2H_4$)" should read --$PH_3$/($SiH_4$+$C_2H_4$+--.

Table 27, under Col. "Gas used"
"$O_2$/HE=0.5" should be deleted.
under Col. "Flow ratio"
"$GeH_4$/$SiH_4$=1/1→1/00" should read
--$GeH_4$/$SiH_4$=1/1→1/100--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL.

It is certified that error appears in the above-identified patent and that said Letters Patent is hereby corrected as shown below:

COLUMN 47

Table 28, under Col. "Layer constitution"
"First Layer" (2nd occurrence) should be deleted.
under Col. "Gas used"
"$O_2$/He-0.5" should read --$O_2$/He=0.5--.
under Col. "Flow ratio"
"$NH_3$/$SiH_4$-1/50" should read --$NH_3$/$SiH_4$=1/50-- and
"$C_2H_4$/$SIH_4$=3/10" should read --$C_2H_4$/$SiH_4$=3/10--.

Table 29, under Col. "Gas used"
"$SiH_4$/He=1 GeH$_4$/He=1 $B_2H_6$/He-1/100" should read --$SiH_4$=1 GeH$_4$=1 $B_2H_6$/He=1/100--.
under Col. "Flow ratio"
"$B_2H_6$/$SiH_4$=0" should read --$B_2H_6$/$SiH_4$=0→1/4000--
and "$B_2$H6/($SiH_4$+$C_2H_4$)" should read
--$B_2H_6$/($SiH_4$+$C_2H_4$)--.

Table 30, under Col. "Gas used"
"$O_2$/He-0.5" should read --$NH_3$ $O_2$/He=0.5--.
under Col. "Flow ratio"
"$NH_3$/$SiH_4$-1/50 $O_2$/$SiH_4$=1/1000" should read --$NH_3$/$SiH_4$=1/50 $O_2$/$SiH_4$=1/200-- and
"$C_2H_4$/$SiH_4$=1/100 $B_2H_6$/$SiH_4C_2H^4$) " should read --$C_2H_4$/$SiH_4$=3/10 $B_2H_6$/($SiH_4$+$C_2H_4$)--.

COLUMN 49

Table 32, in row "Evaluation"
"Δ ○ ◎ ◎ ○ ○ Δ" should read
--○ ◎ ◎ ○ ○ ○ Δ--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL.

It is certified that error appears in the above-identified patent and that said Letters Patent is hereby corrected as shown below:

COLUMN 49 continued,

Table 33, under Col. "Gas used"

under Col. "Flow ratio"
"$B_2H_6/SiH_4$
=5/1000→0
$O_2/SiH_4$=1/40" should be deleted,
"$SiH^4/C^2H^4$=1/1 --$SiH_4/C_2H_4$=1/1
$B_{26}(SiH_4+C_2H_4)$" should read $B_2H_6(SiH_4+C_2H_4)$--
and "=1/30000" should be deleted.

Table 34, under Col. "Gas used"
"$B_2$/He=0.01 should read --$B_2H_6$/He=0.01--.
$O_2$/He=0.5"
under Col. "Gas used"

Table 35, "$SiH_4$/He=1" should read --$SiH_4$/He=0.5--.

COLUMN 51

Table 35, under Col. "Flow ratio"
"$B_2H_6/(SiH_4+GeH_4)$→ should read --$B_2H_6/(SiH_4+GeH_4)$
1/10000 =5/100000--.
$C_2H_4/SiH_4$=1/100"

Table 36, under Col. "Gas used"
"$O_2$/He=0.5" should be deleted and
"$SiH_4$He=0.5" should read --$SiH_4$/He=0.5--.
under Col. "Flow ratio"
"$B_2H_6/SiH_4$=0" should be deleted.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL.

It is certified that error appears in the above-identified patent and that said Letters Patent is hereby corrected as shown below:

COLUMN 51 continued,

Table 38, under Col. "Gas used"
"GeHe/He=1" should read --$GeH_4$/He=1-- and
"$B_2H_6$/He=1/100" (2nd occurrence) should read
--$GeH_4$/He=1--.
under Col. "Flow ratio" in row "Second step"
insert, --$GeH_4/SiH_4$=1/3
$B_2H_6/SiH_4$=1/1000-- and
under Col. "Flow ratio"
"1/30000" should read --1/3000--.
under Col. "Discharging power"
"0.20" (1st occurrence) should read --0.18--.
under Col. "Deposition speed"
"18" (1st occurrence) should read --10--.
under Col. "Layer thickness"
"10" (1st occurrence) should read --6--.

COLUMN 53, Table 39, under Col. "Gas used"
"GeHe/He=1" should read --$GeH_4$/He=1--.
under Col. "Flow ratio"
"$GeH_4/SiH_4$=1/1→0" should read --$GeH_4/SiH_4$=1→0--
and
"$B_2H_6$/($SiH_4$=1/100000" should read --$B_2H_6/SiH_4$=1/100000--.

under Col. "Layer thickness"
in row "First Layer" insert --2--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL. Page 14 of 21

It is certified that error appears in the above-identified patent and that said Letters Patent is hereby corrected as shown below:

COLUMN 53

Table 39, under Col. "Gas used"
"$SiH_4$/He=1" (3rd occurrence) should read
--$SiH_4$/He=1
$B_2H_6$/He=1/100-- and
"$C_2H_2H_4$" should read --$C_2H_4$--.
under Col. "Flow ratio"
"$B_2H_6$/($SiH_4$=1/100000" should read --$B_2H_6$/$SiH_4$=1/100000--. and
"$B_2H_6$/($SiH_4$+$C^2H_4$)" should read
--$B_2H_6$/($SiH_4$+$C_2H_4$)--.

Table 40, row "Third step" should be deleted.
under Col. "Layer preparing steps,"
"Fourth step" should read --Third step--.
under Col. "Flow ratio"
"$C_{24}$/$SiH_4$=3/10" should read --$C_2H_4$/$SiH_4$=3/10--.

Table 41, under Col. "Layer constitution"
"First" should read --First layer--.
under Col. "Gas used"
GeHe/He=1" should read --$GeH_4$/He=1--.
under Col. "Flow ratio"
"$B_2H_6$/$SiH_4$=75/1000 --$B_2H_6$/$SiH_4$=5/1000
3→75/1000 should read →3.75/1000
$B_2H_4SiH_4$=3.75/1000→" $B_2H_4$/$SiH_4$=3.75/1000→--
and "1/30000" should read --1/3000--.

Table 42, under Col. "Layer constitution"
"First step" should read --First layer--.
under Col. "Gas used"
"$GeHe_4$/He=1" should read --$GeH_4$/He=1-- and
"$B_2H_2$/He-1/100" should read --$B_2H_6$/He=1/100--.
under Col. "Flow ratio"
"1/40000" should read --1/4000--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL. Page 15 of 21

It is certified that error appears in the above-identified patent and that said Letters Patent is hereby corrected as shown below:

COLUMN 55

Table 43, in row "Sample No."
"4304 4305 4305" should read --4303 4304 4305--.

Table 44, in row "Evaluation"
"Δ ◎ O O O O Δ" should read
--◎ ◎ O O O O Δ--.

Table 45, under Col. "Layer constitution"
"First step" should read --First layer--.
under Col. "Gas used"
"$SiH_4$=1 --$SiH_4$/He=1
$GeHe_4$/He=1" should read $GeH_4$/He=1--.
under Col. "Flow ratio"
"$GeH_4/SiH_{4=1/1\rightarrow0}$
$B_2H_6/SiH_4$=5/10000" should read
--$GeH_4/SiH_4$=1/1→0
$B_2H_6/SiH_4$=5/100000--.

Table 46, under Col. "Layer constitution"
"First step" should read --First layer--.
under Col. "Gas used"
"$GeHe_4$/He=1" should read --$GeH_4$/He=1--,
"$O_{2/He=0.5}$" should read --$O_2$/He=0.5-- and
"$B_2H_6$/He-1/100 --$B_2H_6$/He=1/100
$O_2$He=0.5" should read $O_2$/He=0.5 -- and
"$B_2H_2$/He-1/100" should read --$B_2H_6$/He=1/100--.
under Col. "Flow ratio"
"$B_2H_6/SiH_4$=1/10000" should read
--$B_2H_6/SiH_4$=1/100000-- and
"$PH_3/SiH_4+C_2H_4$=" should read --$PH_3/(SiH_4+C_2H_4)$=--.

Table 47, under Col. "Layer constitution"
"First step" should read --First layer--.
under Col. "Gas used"
"$GeHe_4$/He=1" should read --$GeH_4$/He=1--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL. Page 16 of 21

It is certified that error appears in the above-identified patent and that said Letters Patent is hereby corrected as shown below:

COLUMN 57

Table 47, under Col. "Gas used"
"$B_2H_4$/He-1/100" should read --$B_2H_6$/He=1/100--.
under Col. "Flow ratio"
"1/10000" should read --1/100000--.

Table 48, under Col. "Layer constitution"
"First step" should read --First layer--.
under Col. "Gas used"
"$GeHe_4$/He=1 --$GeH_4$/He=1
$B_{26}$/He=1/100" should read $B_2H_6$/He=1/100-- and
"$O_2$/He-0.5" should read --$O_2$/He=0.5--.
under Col. "Flow ratio"
"$B_{26}$/$SiH_4$=1/1000
$O_2$/$SiH_4$=4/4000
$O_2$/$SiH_4$=0.25/4000" should read
--$B_2H_6$/$SiH_4$=1/1000
$O_2$/$SiH_4$=4/4000→0.25/4000
$O_2$/$SiH_4$=0.25/4000→1.5/4000-- and
"$B_{26}$/($SiH_4$+$C_2H_4$()=" should read
--$B_2H_6$/($SiH_4$+$C_2H_4$)=--.

Table 49, under Col. "Layer constitution"
"First step" should read --First layer--.
under Col. "Gas used"
"$GeHe_4$/He=1 --$GeH_4$/He=1
$B_{26}$/He=1/100" should read $B_2H_6$/He=1/100--,
"$O_2$/He-0.5" should read --$O_2$/He=0.5-- and
"$PH_3$He=1/00 --$PH_3$/He=1/100
$O_2$He-0.5 " should read $O_2$/He=0.5 --.
under Col. "Flow ratio"
"$B_{26}$/$SiH_4$51/1000" should read --$B_2H_6$/$SiH_4$=5/1000--,
and "$PH_3$/($SiH_4$+$C_2H_{24=}$1/3000" should read
--$PH_3$/($SiH_4$+$C_2H_4$)=1/3000--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL. Page 17 of 21

It is certified that error appears in the above-identified patent and that said Letters Patent is hereby corrected as shown below:

COLUMN 57 continued,

Table 50, under Col. "Layer constitution"
"First step" should read --First layer--.
under Col. "Gas used"
"$GeHe_4$/He=1" should read --$GeH_4$/He=1-- and
"$O_2$He-0.5" should read --$O_2$/He=0.5--.
under Col. "Flow ratio"
"$B_{26}$/$SiH_4$=5/1000→0" should read
--$B_2H_6$/$SiH_4$=5/1000→0--, "$O_2$/$SiH_4$=1/400"
(both occurrences) should be deleted, and
"$PH_3$/($SiH_4$+$C_2H_{24}$+" should read --$PH_3$/($SiH_4$+$C_2H_4$+--.

COLUMN 59

Table 51, under Col. "Layer constitution"
"First step" should read --First layer--.
under Col. "Gas used"
"$GeHe_4$/He=1 --$GeH_4$/He=1
$B_{26}$/He=1/100" should read $B_2H_6$/He=1/100--,
"$B_2H_6$/He=1/100" should read --$B_2H_6$/He=1/100
$O_2$/He=0.5 -- and
"$SiH_4$/He=0.5 should read --$SiH_4$/He=1
$C_2H_4$ $B_2H_6$/He=1/100--.
$PH_3$/He=1/100"
under Col. "Flow ratio"
"$B_{26}$/$SiH_4$=5/1000→" should read
--$B_2H_6$/$SiH_4$=5/1000→--,
"$O_2$/$SiH_4$=5/40→" should read --$O_2$/$SiH_4$=1/40→-- and
"$O_2$/$SiH_{4=0.5/40\rightarrow 0}$" should read
--$O_2$/$SiH_4$=0.5/40→0--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL. Page 18 of 21

It is certified that error appears in the above-identified patent and that said Letters Patent is hereby corrected as shown below:

COLUMN 59, continued

Table 52, under Col. "Layer constitution"
"First step" should read --First layer--.
under Col. "Gas used"
"$GeHe_4$/He=1" should read --$GeH_4$/He=1-- and
"$B_{26}$/He=1/100" should read --$B_2H_6$/He=1/100--.
under Col. "Flow ratio"
"$O_2/SiH_4$=5/40→0.5/40" should be deleted.

Table 54, under Col. "5401," "Δ" should read --O--.

Table 55, under Col. "Layer constitution"
"First step" should read --First layer--.
under Col. "Gas used"
$GeHe_4$/He=1" should read --$GeH_4$/He-1--.

COLUMN 61

Table 55, under Col. "Flow ratio"
"$PH_3/(SiH_4+C_2H_{24}$" should read --$PH_3/(SiH_4+C_2H_4)$--
and "$O_2/SiH_4$=1/400" should be deleted.

Table 56, under Col. "Layer constitution"
"First step" should read --First layer--.
under Col. "Gas used"
"$GeHe_4$/He=1" should read --$GeH_4$/He=1--.

Table 57, under Col. "Layer constitution"
"First step" should read --First layer--.
under Col. "Gas used"
"$GeHe_4$/He=1" should read --$GeH_4$/He=1--,
"$B_2H_6$/He-1/100" should read --$B_2H_6$/He=1/100-- and
"$B_2H_4$/He-1/100" should read --$B_2H_6$/He=1/100--.
under Col. "Flow ratio"
"→0.5/40" should be deleted.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL.

It is certified that error appears in the above-identified patent and that said Letters Patent is hereby corrected as shown below:

COLUMN 63

Table 58, under Col. "Layer constitution"
"First step" should read --First layer--.
under Col. "Gas used"
"$GeHe_4$/He=1" should read --$GeH_4$/He=1--.
under Col. "Flow ratio"
"$NH_3/SiH_4$-0.25/4000" should read
--$NH_3/SiH_4$=0.25/4000--.

Table 59, under Col. "Layer constitution"
"First step" should read --First layer--.
under Col. "Gas used"
"$GeHe_4$/He=1" should read --$GeH_4$/He=1-- and
$NH_3$/He-0.5" should read --$NH_3$/He=0.5--.
under Col. "Flow ratio"
"→1/3" should read ---→0--,
"$B_2H_6/SiH_4$=1/1000 --$B_2H_6/SiH_4$=5/1000
$O_2/SiH_4$=4/4000 should read $NH_3/SiH_4$=1/40
$O_2/SiH_4$=0.25/4000" $NH_3/SiH_4$=1/400 --.

Table 60, under Col. "Layer constitution"
"First step" should read --First layer--.
under Col. "Gas used"
"$GeHe_4$/He=1" should read --$GeH_4$/He=1--.
under Col. "Flow ratio"
"$B_2H_6/SiH_4$=5/1000" should read
--$B_2H_6/SiH_4$=5/1000→0--,
"→0.25/4000
$NH_3/SiH_4$=1.400" should be deleted,
"($NH_3$+$C_2H_4/SiH_4$=3/10" should read
--($NH_3$+$C_2H_4$)/$SiH_4$=3/10-- and
"=1/3000" should read --1/30000--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL. Page 20 of 21

It is certified that error appears in the above-identified patent and that said Letters Patent is hereby corrected as shown below:

COLUMN 65

Table 61, under Col. "Layer constitution"
"First step" should read --First layer--.
under Col. "Gas used"
"$GeHe_4$/He=1" --$GeH_4$/He=1
$B_2H_6$/He-1/100" should read $B_2H_6$/He=1/100--,
"$B_2H_6$/He-1/100 --$B_2H_6$/He=1/100
$NH_3$/He-0.5 " should read $NH_3$/He=0.5 --, and
"$B_2H_4$/He-1/100" should read --$B_2H_6$/He=1/100--.

Table 62, under Col. "Layer constitution"
"First step" should read --First layer--.
under Col. "Gas used"
"$GeHe_4$/He=1" --$GeH_4$/He=1
$B_2H_6$/He-1/100" should read $B_2H_6$/He=1/100--, and
"$B_2H_6$/He-1/100" should read --$B_2H_6$/He=1/100--.
under Col. "Flow ratio"
"$B_2H_6/SiH_4$=5/1000→7/1600" should read
--$B_2H_6/SiH_4$=4/4000→0--,
"→0.5/40" should read --→0--,
"$B_2H_6/SiH_4$=7/1600
→3.75/1000
$NH_3/SiH_4$=0.5/40→0" should be deleted and
--=3.75/1000→0" should read --=0→1/4000--.

Table 63, under Col. "Layer constitution"
"First step" should read --First layer--.
under Col. "Gas used"
"$GeHe_4$/He=1" should read --$GeH_4$/He=1--.
under Col. "Flow ratio"
"$O_2/SiH_4$-1/200" should read --$O_2/SiH_4$=1/200--.

UNITED STATES PATENT AND TRADEMARK OFFICE

CERTIFICATE OF CORRECTION

PATENT NO. : 5,545,500

DATED : August 13, 1996

INVENTOR(S) : SHIGERU SHIRAI ET AL. Page 21 of 21

It is certified that error appears in the above-identified patent and that said Letters Patent is hereby corrected as shown below:

COLUMN 67

Line 11, "TABLE 54" should read --TABLE 65--.
Line 47, "(b-11)" should read --(b-ii)--.
Table 64, under col. "6501," "Δ" should read --O--.

COLUMN 68

Line 47, "0,001" should read --0.001-- and
"3000 ppm" should read --3000 atomic ppm--.

Signed and Sealed this

Fourteenth Day of September, 1999

*Attest:*

Q. TODD DICKINSON

*Attesting Officer*

*Acting Commissioner of Patents and Trademarks*